US005781823A

United States Patent [19]

Isobe et al.

[11] Patent Number: 5,781,823

[45] Date of Patent: Jul. 14, 1998

[54] IMAGE FORMING APPARATUS HAVING A PLURALITY OF IMAGE FORMING SECTIONS EACH HAVING DIFFERENT MEANS OF FORMING IMAGES

[75] Inventors: Minoru Isobe; Noboru Otaki, both of Tokyo, Japan

[73] Assignee: Oki Data Corporation, Tokyo, Japan

[21] Appl. No.: 616,498

[22] Filed: Mar. 19, 1996

[30] Foreign Application Priority Data

Mar. 27, 1995 [JP] Japan ..... 7-068342

[51] Int. Cl.[6] ..... G03G 21/00

[52] U.S. Cl. ..... 399/2; 399/6; 399/401

[58] Field of Search ..... 399/2, 3, 6, 401; 346/44; 355/24

[56] References Cited

U.S. PATENT DOCUMENTS

| | | | |
|---|---|---|---|
| 5,321,467 | 6/1994 | Tanaka et al. | 399/2 |
| 5,373,350 | 12/1994 | Taylor et al. | 399/2 |
| 5,519,484 | 5/1996 | Kumagai | 355/24 X |
| 5,561,500 | 10/1996 | Ohzeki et al. | 399/85 |
| 5,570,451 | 10/1996 | Sakaizawa et al. | 399/2 |

FOREIGN PATENT DOCUMENTS

| | | |
|---|---|---|
| 61-295059 | 6/1985 | Japan . |
| 6-47302 | 6/1994 | Japan . |

*Primary Examiner*—Nestor R. Ramirez

*Attorney, Agent, or Firm*—Rabin & Champagne, P.C.

[57] ABSTRACT

A recording apparatus according to the invention includes a first recording device arranged in a first path and a second arranged upstream of the first recording device. A second path has a first end and a second end. A first feed-direction-switching device is arranged upstream of the first recording device and the second path, and downstream of the second recording device. The first feed-direction-switching device directs the medium either to the first recording device or into the first end of the second path. A second feed-direction switching device is arranged downstream of the first recording device and directs the leading end of the medium into the second end of the second path when the first and/or second recording device completes recording of the information on the first side of the medium. The medium is then transported face down through the second path back to the first path for recording on the second side thereof. A method of recording includes first, second, and third mode operations. A medium is printed in monochrome and/or in color in the first and/or second mode. The medium is then transported face down through the second path back to the first path for printing operation performed by the first and/or second recording devices.

38 Claims, 30 Drawing Sheets

247
281
OPERATING SECTION
FIXING DEVICE DRIVER
CHARGING POWER SUPPLY
TRANSFER POWER SUPLLY
DB BIASING POWER SUPLLY
SP BIASING POWER SUPLLY
MOTOR DRIVING CIRCUIT
LED-PRINT CONTROLLING CIRCUIT
PAGE MEMORY
CONTROLLER
I/F
POWER SUPLLY
DC
SENSOR DRIVER /RECEIVER
MOTOR /MAGNET DRIVING CIRCUIT
L/B(Y)
L/B(M)
L/B(C)
L/B(K)
H/C(Y)
H/C(M)
H/C(C)
H/C(K)
325
111
110
18
115
113
114
326
126
122
209
216
213
100
101
311
108
103
124Y
124M
124C
124K
127Y
127M
127C
127K
84
85
86
104
105
60
307

247
291
OPERATING SECTION
FIXING DRIVER
CHARGING POWER SUPPLY
TRANSFER POWER SUPLLY
MOTOR DRIVING CIRCUIT
LED-PRINT CONTROLLING CIRCUIT
PAGE MEMORY
DB BIASING POWER SUPLLY
SP BIASING POWER SUPLLY
CONTROLLER
I/F
POWER SUPLLY
SENSOR DRIVER /RECEIVER
MOTOR DRIVING CIRCUIT
DC
18
115
113
114
326
126
122
209
216
213
325
111
110
100
101
333
332
334
84
85
104
106

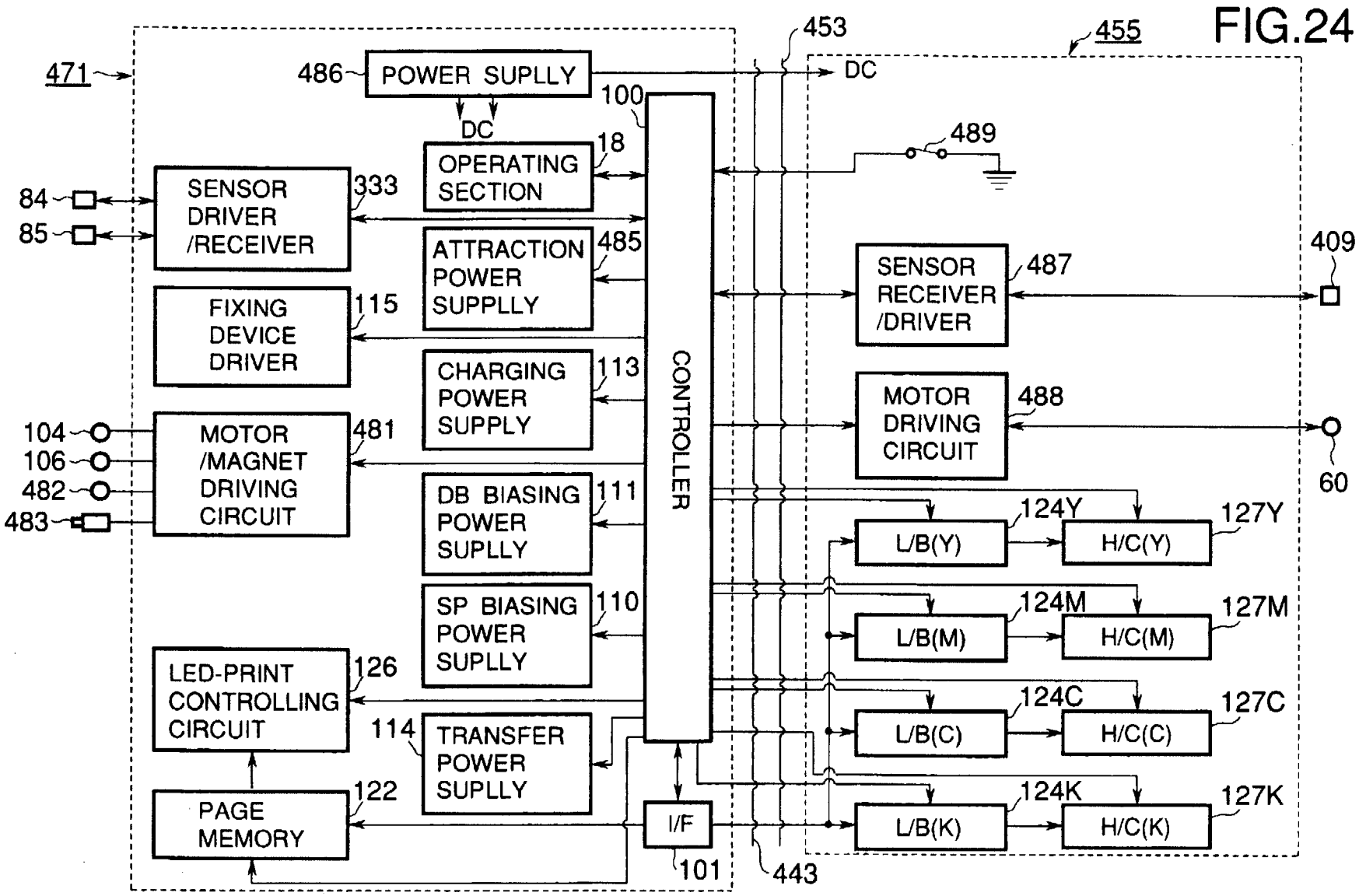
FIG.24
455
409
60
127Y
127M
127C
127K
H/C(Y)
H/C(M)
H/C(C)
H/C(K)
124Y
124M
124C
124K
L/B(Y)
L/B(M)
L/B(C)
L/B(K)
487
488
489
SENSOR RECEIVER /DRIVER
MOTOR DRIVING CIRCUIT
453
DC
443
CONTROLLER
I/F
101
100
18
485
113
111
110
114
OPERATING SECTION
ATTRACTION POWER SUPPLLY
CHARGING POWER SUPPLY
DB BIASING POWER SUPLLY
SP BIASING POWER SUPLLY
TRANSFER POWER SUPLLY
POWER SUPLLY
DC
486
333
115
481
126
122
SENSOR DRIVER /RECEIVER
FIXING DEVICE DRIVER
MOTOR /MAGNET DRIVING CIRCUIT
LED-PRINT CONTROLLING CIRCUIT
PAGE MEMORY
471
84
85
104
106
482
483

IMAGE FORMING APPARATUS HAVING A PLURALITY OF IMAGE FORMING SECTIONS EACH HAVING DIFFERENT MEANS OF FORMING IMAGES

BACKGROUND OF THE INVENTION

The present invention relates to a recording method and a recording apparatus having a serial type recording means and a line type recording means.

Conventionally, when printing a document with a part of the document highlighted, a dual color type recording apparatus is provided which prints part of the document to be highlighted in a different color from the rest of the document. This type of recording apparatus is provided with two recording means. If the two recording means are both of serial type, the recording speed is very low. If both recording means are of a line type, then a high-power power supply is needed resulting in high cost of the printing apparatus.

Japanese Patent Publication No. 6-47302 proposes a recording apparatus having a serial type recording means and a line type recording means. With this type of recording apparatus, the line type recording means is disposed upstream of the path through which the recording paper is transported and a serial type recording means downstream of the path, so that printing is first performed on the recording paper by the line type recording means and then further printing is carried out on the same paper by the serial type recording means.

A paper-halting roller is provided in the path in which the recording paper is transported so as to hold the paper while the serial type recording means is printing on the paper.

However, with the prior art recording apparatus, the two recording means can print on one side of the recording paper but not on both sides. Another problem is that if the recording means upstream of the paper-transporting path takes the form of an electrophotography type printer mechanism, the toner image must be fixed with the aid of heat, pressure and so on which causes the recording paper to shrink. Thus, subsequent printing by the serial type recording means results in misregistration of images printed by the two recording means with each other.

Further, the recording paper is prevented from moving while the serial type recording means is printing. This causes the recording paper to remain caught between the fixing rollers. Thus, the condition under which an image is fixed varies depending on whether the recording paper is moving or is halted, thereby degrading the print quality.

The recording paper passing between the fixing rollers may be made to describe a loop just before the paper halting-rollers so as to maintain a constant speed of the recording paper when the recording paper passes between the fixing rollers. However, when the recording paper is an envelope, post card, other hard or thick paper, it is very difficult to form the recording paper into a loop, and such hard and thick paper increases the load on the paper transporting mechanism. Moreover, the paper may be curled, making the subsequent printing by other recording means very difficult.

Alternatively, the distance between the fixing rollers and the paper-halting rollers may be selected to be long with the result that the whole size of recording apparatus becomes larger. A user having a monochrome image printer, must have an additional color image printer if color image printing is to be performed. This is uneconomical.

SUMMARY OF THE INVENTION

An object of the invention is to provide a recording apparatus and recording method capable of printing of images on both sides of the recording paper by the use of two recording means, and printing on thick recording paper.

Another object of the invention is to provide a recording apparatus and recording method capable of any of monochromatic image print, color print, and the combination of monochromatic image print and color print on the same sheet of paper.

Yet another object of the invention is to provide a recording apparatus which is small in size and results in the least misregistration in color print.

A medium-feeding mechanism feeds a medium such as OHP, paper, post cards, and envelopes into a first path. A first recording means (20) is arranged in the first path and a second recording means is arranged upstream of the first recording means (20). A second path has a first end and a second end. A first feed-direction-switching means is arranged upstream of the first recording means (20) and the second path, and downstream of the second recording means (50). The first feed-direction-switching means directs the medium either to the first recording means (20) or into the first end of the second path. A second feed-direction switching means (47) is arranged downstream of the first recording means (20) and directs the leading end of the medium into the second end of the second path when the first and/or second recording means completes recording of the information on the first side of the medium. The medium is then transported face down through the second path back to the first path for recording on the second side thereof. A method of recording includes a first, second, and third mode of operation. A medium is printed in monochrome and/or in color in the first and/or second mode. The medium is then transported face down through the second path back to the first path for printing operation performed by the first and/or second recording means.

BRIEF DESCRIPTION OF THE DRAWINGS

Features and other objects of the invention will become more apparent from the description of the preferred embodiments with reference to the accompanying drawings in which:

FIG. 24 is a block diagram showing a control section of the third embodiment;

DETAILED DESCRIPTION OF THE INVENTION

First Embodiment

Figure 1:
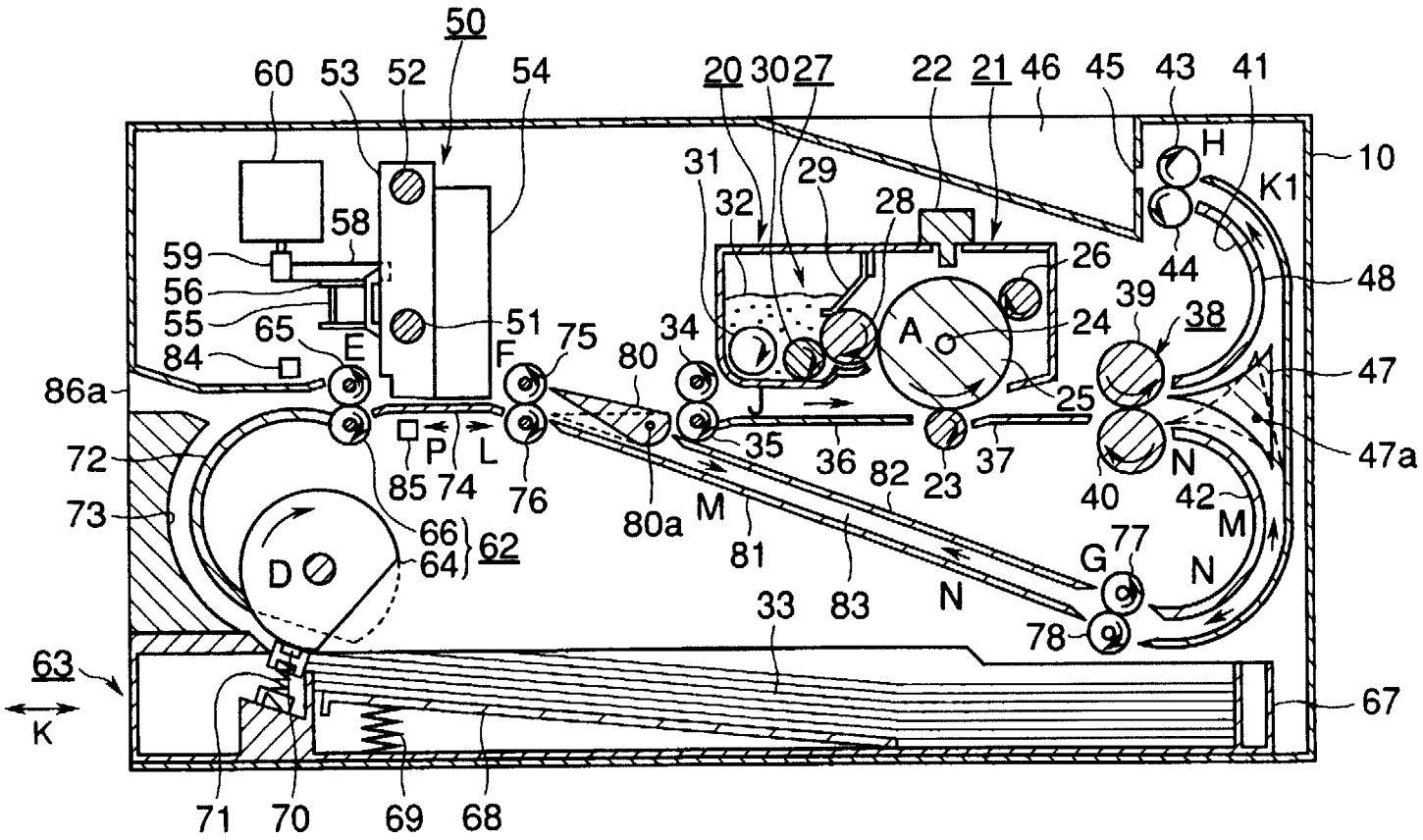
FIG. 1 is a cross-sectional view of a recording apparatus according to a first embodiment of the invention.
Figure 2:
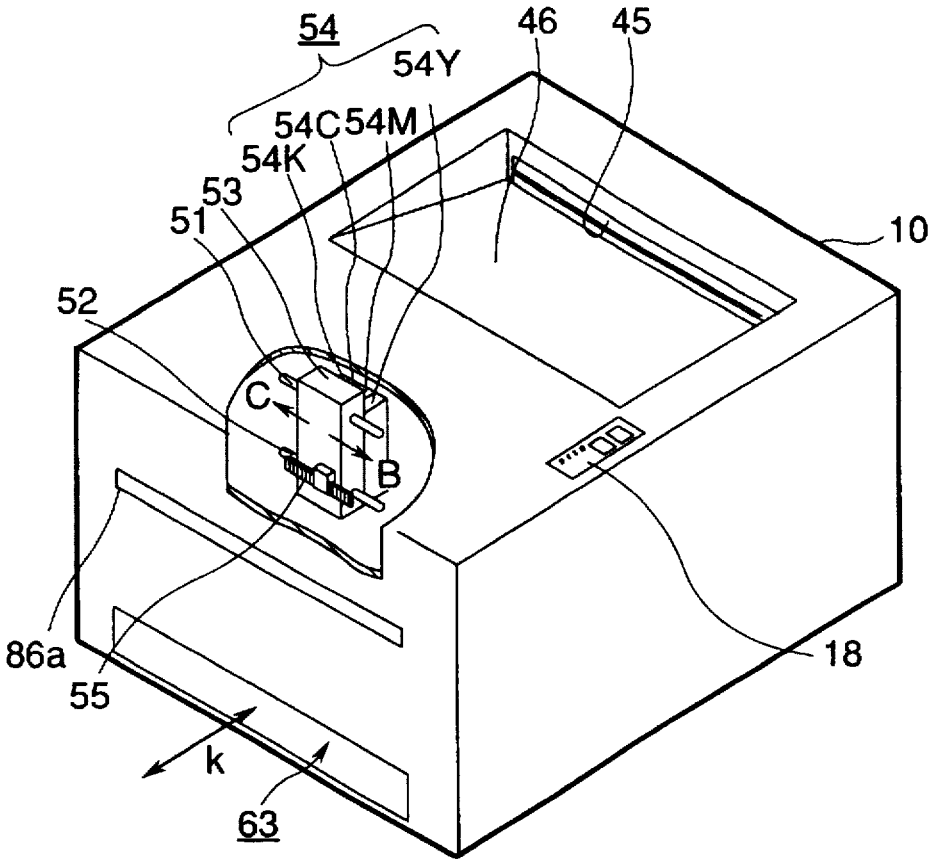
FIG. 2 is a perspective view of the recording apparatus according to the first embodiment.

A first embodiment of the invention will now be described in detail with reference to FIGS. 1–15. FIG. 1 is a cross-sectional view of a recording apparatus of the first embodiment. FIG. 2 is a perspective view of the recording apparatus of the first embodiment. In the figures, an operating section 18 is located on the top surface of the case 10. The case 10 houses an LED printing mechanism 20 that operates as a first recording means, a serial type color ink jet printing mechanism 50 that operates as a second recording means, and a paper-feeding mechanism 62.

The LED printing mechanism 20 will be described. The LED printing mechanism 20 includes an image-forming section 21, an LED head 22 that illuminates the photosensitive body 25 in accordance with image data, and image transfer roller 23 for transferring a toner image formed by the image-forming section 21 onto a printing medium 33.

The image-forming section 21 includes the photosensitive body 25 rotated in the direction of arrow A about a shaft 24, a charging roller 26 that causes the surface of the photosensitive body 25 to be evenly charged, and a developer 27. The developer 27 includes a developing roller 28, a developing blade 29, sponge roller 30, stirring shaft 31, and toner 32 of black (K) made of a non-magnetic, single compound.

The toner 32 supplied by the stirring shaft 31 reaches the developing roller 28 via the sponge roller 30, and a thin layer of the toner 32 is deposited on the surface of the developing roller 28, and is supplied to the contact between the photosensitive body 25 and the developing roller 28. When a thin layer of the toner 32 is deposited on the developing roller 28, the toner 32 is strongly rubbed by the developing roller 28 and developing blade 29 to be, for example, positively charged (friction charge). The sponge roller serves to supply a proper amount of the toner 32 to the developing blade 29. The developing roller 28 is formed of a semiconductive rubber material.

The LED head 22 includes shift registers, latches, an LED array, a printed circuit board carrying a driver thereon which drives the LED array, and a rod lens array for condensing light from the LED array. The LED head 22 drives the LED array to emit light in accordance with the image data transmitted from the host computer, not shown, so that the photosensitive body 25 is exposed to the light to form an electrostatic latent image on the surface thereof. Then, the toner 32 on the surface of the developing roller 28 is attracted to the electrostatic latent image to form a toner image thereon.

Referring to FIG. 1, pull-in rollers 34 and 35 are disposed on the left side of the LED printing mechanism 20, which rollers pull in between them the medium 33 discharged from the color ink jet print mechanism 50 and guided by a first feed-direction-switching means 80. The medium 33 is guided by the guides 36 and 37 to reach the fixing device 38 of the LED printing mechanism 20. The first feed-direction-switching means 80 is pivotally supported on a shaft 80*a*, so that the means 80 is driven by a plunger magnet, not shown, to switch between a solid line position and a dotted line position.

The medium 33 having a toner image transferred thereonto by the LED printing mechanism 20, is guided by the guide 37 to the fixing device 38 by which the toner image is fixed on the medium 33. For this purpose, the fixing device 38 includes a heat roller 39 for heating the toner 32 on the medium 33, and a pressure roller 40 that is urged against the heat roller 39 to apply a pressure to the medium 33. The medium 33 having the toner image fixed thereon is delivered to the second feed-direction-switching means 47.

The second feed-direction-switching means 47 is pivotally supported on a shaft 47*a*, so that the second feed-direction-switching means 47 is driven by a plunger magnet, not shown, to switch between a solid line position and a dotted line position. When the second feed-direction-switching means 47 is at the dotted line position, the medium 33 is guided by the second feed-direction-switching means 47 and guides 41 and 48 to the discharge rollers 43 and 44, which rotate to discharge the medium 33 through the copy exit 45 to the exit stacker 46.

The respective rollers are rotated by motors, not shown, in the directions of arrows in FIG. 1, not shown, for a period from the medium 33 is printed by the LED printing mechanism 20 till the medium 33 is discharged to the exit stacker 46. When the second feed-direction-switching means 47 is shifted to the solid line position, the medium 33 is guided by the second feed-direction-switching means 47 and guides 42 and 48 to the transportation rollers 77 and 78.

The operating section 18 primarily includes a paper feed key, on-line/off-line switching key, alarm lamps for indicating run out of paper and so on.

The color ink jet print mechanism 50 will be described.

The color ink jet print mechanism 50 includes two guide shafts 51 and 52 mounted in parallel to each other, carriage 53 driven to run in the directions of arrows B and C along the guide shaft 51 and 52, an ink jet recording head 54 mounted on the carriage 53, a belt 55 that moves the carriage 53, a pair of pulleys 56 on which a belt 55 is disposed (FIG. 1 shows only one of the pulleys 56), drive gear 58 coaxially connected directly to the pulleys 56, motor gear 59 that meshes with the drive gear 58, and a spacing motor 60 coaxially connected to the motor gear 59. Arrow B indicates the printing direction and arrow C shows the return direction of the color ink jet print mechanism.

The spacing motor 60 drives the pulleys 56 in rotation via the motor gear 59 and drive gear 58, so that the pulleys 56 drive the belt 55. Since the carriage is connected to a part of the belt 55, the carriage 53 moves together with the belt 55. In this manner, the carriage 53 can move in a direction perpendicular to the direction in which the medium 33 is transported.

The ink jet recording head 54 is for printing a color image. As shown in FIG. 2, the ink jet recording head 54 includes four recording heads 54Y, 54M, 54C, and 54K disposed in correspondence to colors yellow (Y), magenta (M), cyan (C) and black. The respective recording head has a surface opposing the medium 33 with a predetermined distance apart from the medium 33, the surface being formed with a plurality (e.g., 32 nozzles) of ink-outlets referred to as nozzle hereafter, not shown, therein. The ink-outlets are arranged in line in the direction in which the medium 33 is transported.

A paper feeding mechanism 62 is disposed in the lower space of the case 10. The paper feeding mechanism 62 includes a paper-accommodating cassette 63, hopping roller 64 having a D-cut and registering rollers 65 and 66.

The paper-accommodating cassette 63 is disposed such that the cassette 63 may be detachably inserted in the direction of K. The paper-accommodating cassette 63 includes a medium cassette 67, lift plate 68, pressing spring 69, separating means 70 and a spring 71. When the hopping roller 64 is rotated slightly less than one complete rotation in the direction of arrow D, the medium 33 is guided by the guides 72 and 73 to the pair of registering rollers 65 and 66. The guides 72 and 73 and the D-cut portion of the hopping roller 64 are positioned so that when the medium 33 passes between the registering roller 65 and 66, the D-cut portion of the hopper roller 64 moves to a position (dotted line position of FIG. 1) at which it opposes the separating means 70.

The medium 33 housed in the medium cassette 67 is urged against hopping roller 64 by the spring 69 via the lift plate 68. At this time, when the hopping roller 64 is rotated in the direction of arrow D by a motor, not shown, the separating means 70 urged against the hopping roller 64 by the spring 71, starts to feed the medium one by one. With this condition, a rotation of the hopping roller slightly less than one complete rotation causes the medium 33 caught between the hopping roller 64 and the separating means 70 to be fed through the guides 72 and 73 to the registering roller 65 and 66. The rotation of the registering rollers 65 and 66 in the directions of arrow E directs the medium 33 along the platen surface 74 to the transportation rollers 75 and 76.

The first feed-direction-switching means 80 is disposed downstream of the transportation rollers 75 and 76 in the transportation route of the medium 33. The medium 33 is directed through the guide path 83 defined between the guides 81 and 82 to the transportation rollers 77 and 78 when the first feed-direction-switching means 80 is shifted to the solid line position, and to the pull-in roller 34 and 35 when the means 80 is shifted to the dotted line position.

Gears and belts, not shown are disposed so that motors, not shown, drive the registering rollers 65 and 66, the transportation rollers 75–76 and 77–78, and discharge rollers 43 and 44 in the directions of arrows E, F, G, and H as shown in FIG. 1, respectively. Reverse rotation of the motors, not shown, cause the rollers 65–66, 75–76, 77–78, and 43–44 in the directions opposite to the directions E, F, G, and H.

Photo interrupters 84 and 85 detects the medium 33 and reference numeral 86*a* denotes a paper supply/take-up slot. The control section of the recording apparatus of the aforementioned construction will now be described.

Figure 3:
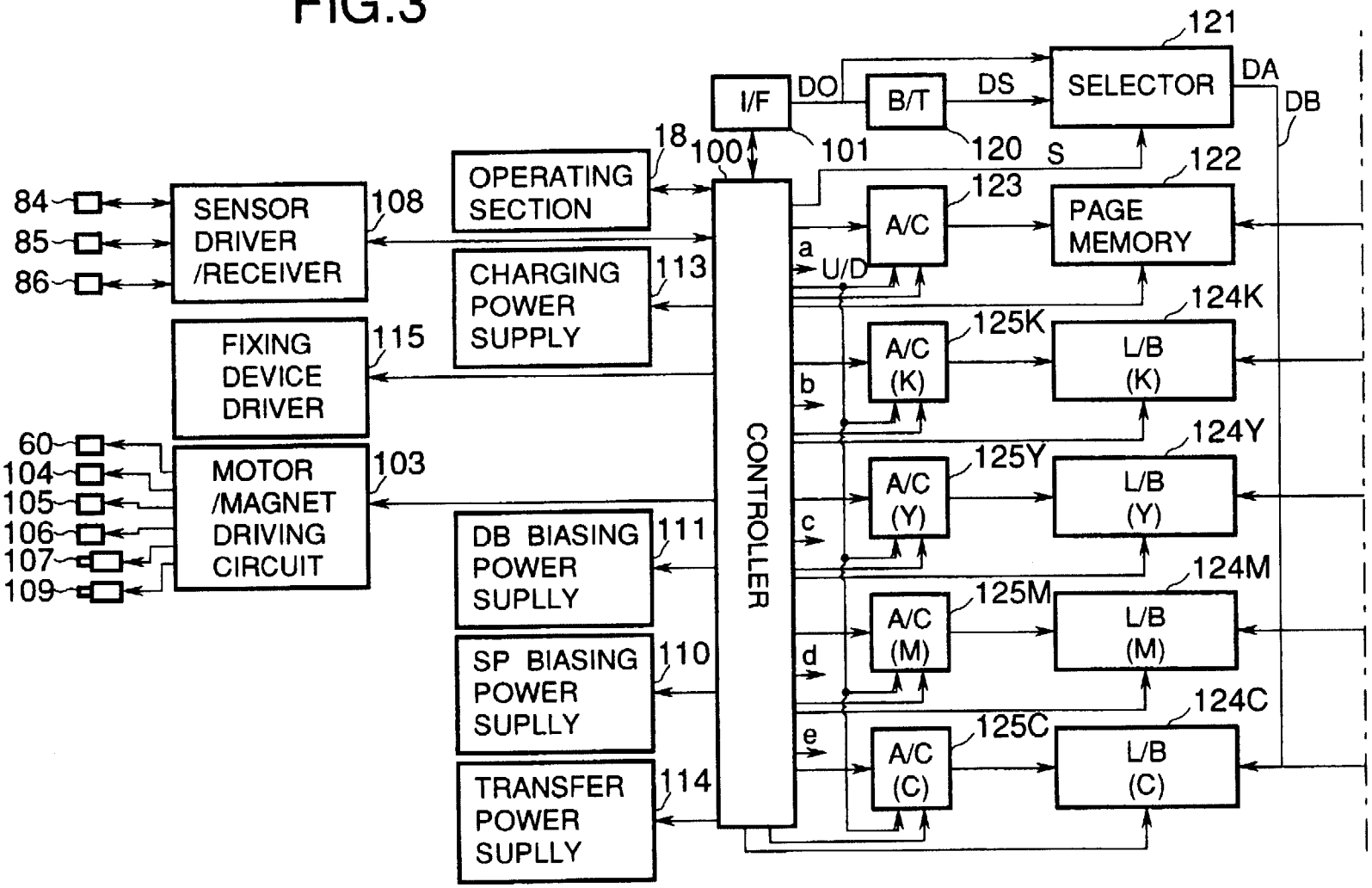
FIG. 3 is a block diagram showing a first half of a controlling section of the first embodiment.
Figure 4:
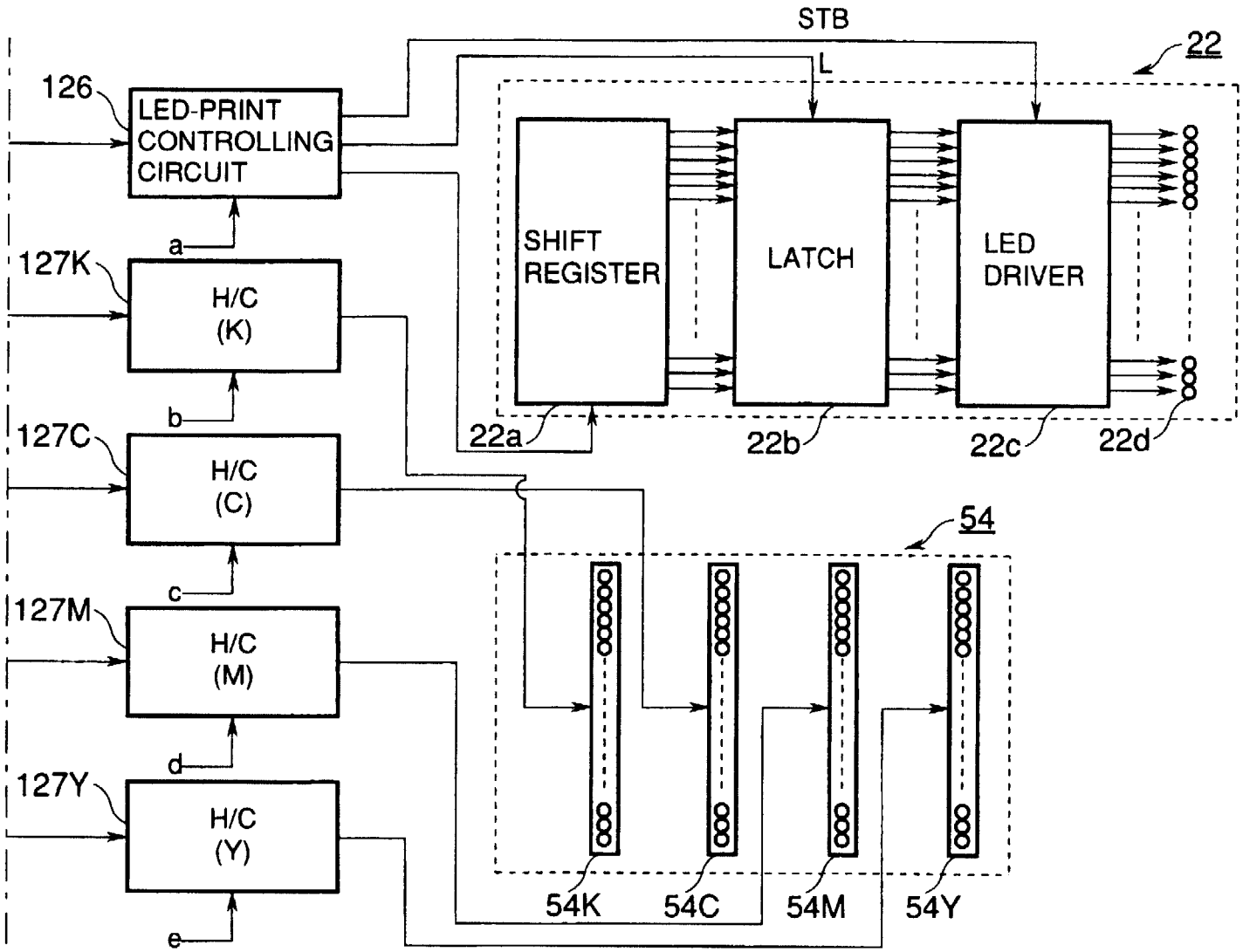
FIG. 4 is a block diagram for showing a second half of the controlling section of the first embodiment.

FIG. 3 is a block diagram showing a first half of the control section of a first embodiment and FIG. 4 is a block diagram showing a second half of the first embodiment.

In the figures, a controller 100 may take the form of, for example, a microprocessor. The controller 100 is connected with all the circuits shown in FIGS. 3 and 4 and centrally controls the entire operations of the recording apparatus. An interface (I/F) 101 receives, in response to commands from the controller 100, image data D0 transmitted from an external apparatus such as the host computer, not shown, and stores the image data D0 into page memory, line buffers (line memory) and so on.

In accordance with commands from the controller 100, a motor/magnet driving circuit 103 drives motors 60, 105, 105, and 106 and plunger magnets 107 and 108.

The motor 60 drives the carriage 53 (FIG. 2) to move in the directions of arrow B and C. The motor 104 drives the hopping roller 64 (FIG. 1) in rotation in the direction of arrow D. The motor 105 drives the registering rollers 65 and 66, transportation rollers 75 and 76, transportation rollers 77 and 78 and discharge rollers 43 and 44 in the directions of arrows E, G, G, and H and in the directions opposite to the directions of arrows E, G, G, and H. The motor 106 drives the pull-in rollers 34 and 35, photosensitive body 25, charging roller 26, developing roller 28, sponge roller 30, transfer roller 23 and heat roller 39 in rotation in the direction of arrows in FIG. 1. The plunger magnet 107 is used to pivot the first feed-direction-switching means 80 between two positions, and the plunger magnet 109 is used to pivot the second feed-direction-switching means 47 between two positions.

The motor 106 is coupled to the pull-in rollers 34 and 35, photosensitive body 25, charging roller 26, developing roller 28, sponge roller 30, transfer roller 23 and heat roller 39 by means of gears, belts and the like, not shown. A sensor driver/receiver 108 drives photo interrupters 84 and 85 and a photo interrupter 86 for detecting the home position of the carriage 53. The sensor driver/receiver 108 also receives signals (output waveforms) from the photo interrupters 84–86 and send them to the controller 100.

The control section further includes an SP biasing power supply 110 for applying a voltage to the sponge roller 30, a DB biasing power supply 111 for applying a voltage to the developing roller 28, a charging power supply 113 for applying a voltage to the charging roller 26 so that the charging roller is charged, a transfer power supply 114 for applying a voltage to the transfer roller so that the transfer roller is charged, and a fixing device driver 115 for driving a heater, not shown, in the heat roller 39 to maintain the temperature of the heat roller 39 of the fixing device 38.

A bit translator (B/T) 120 reverses the bit structure of the image data D0 supplied from the interface 101 so that higher bits are substituted by lower bits. A selector 121 receives a selection signal form the controller 100 that indicates selection of either the image data D0 sent from the interface 101 or the image data DS sent from the bit translator 120, and outputs either signal as the image data DA to data bus DB. A page memory 122 stores therein the image data DA outputted to the data bus DB and reads out the stored image data DA to the data bus DB. The page memory 122 has a memory capacity for one page of the medium. The controller 100 performs the write operation of data into the page memory 122 and the read operation of data from the page memory 122.

An address counter (A/C) 123 specifies the address of the page memory by performing up-count or down-count of the address. Line buffers (L/B) 124Y, 124M, 124C, and 124K store the image data DA outputted to the data bus DB, each of the line buffers storing the image data DA of one line to be printed by each of the respective recording heads 54Y, 54M, 54C, and 54K. The line buffers also outputs the stored image data to the data bus DB. The controller 100 performs the write operation of the image data into the line buffers 124Y, 124M, 124C and 124K and the read operation of data therefrom.

Address counters 125Y, 125M, 125C, and 125K are counted up or counted down to specify the addresses of the line buffers 124Y, 124M, 124C and 124K. A signal U/D from the controller 100 indicates whether the address counters 123, 125Y, 125M, 125C, and 125K are to be counted up or counted down.

An LED-print controlling circuit 126 converts the image data DA read out of the page memory 122 from parallel form to serial form, and transfers the serial data to the shift register 22*a* of the LED head 22. The LED-print controlling circuit 126 sends a latch signal L to a latch 22*b* which in turn latches the image data DA in the shift register 22*a*. Then, the circuit 126 sends a strobe signal STB to an LED driver 22*c* so as to control the exposure time of the LEDs 22*d* in accordance with the image data DA to form an electrostatic latent image on the surface of the photosensitive body 25.

Recording head controlling circuits (H/C) 127Y, 127M, 127C, and 127K are arranged in correspondence to the recording heads 54Y, 54M, 54C, and 54K, and receive the image data DA from the line buffers 124Y, 124M, 124C, and 124K, respectively, to drive the respective recording heads 54Y, 54M, 54C, and 54K in accordance with the commands from the controller 100 so that the ink is discharged from appropriate nozzles, not shown. The operating section 18 is also connected with the controller 100.

The operations of the recording apparatus of the aforementioned construction will now be described with reference to FIGS. 1–4.

The operations include monochrome image print by the LED printing mechanism 20, color image print by the color ink jet printing mechanism 50, and the combination of monochrome and color prints by the LED printing mechanism 20 and the color ink jet printing mechanism 50. Print can be made on one side of the medium 33 or on both sides thereof. The mode of print is selected by a command transmitted from the host computer, not shown.

Monochromatic print on one side of the medium performed by the LED printing mechanism 20 will first be described.

Upon turning on the power supply of the recording apparatus, the controller 100 carries out initial settings and then drives the fixing driver 115 so that the heat roller 39 of the fixing device 38 is warmed up to a predetermined temperature. The heat roller is controlled to a constant temperature. The initial set-up completes when the heat roller reaches the predetermined temperature, and the controller 100 waits for a command indicative of monochromatic print on one side of the medium to be performed by the LED printing mechanism 20, and image data D0 transmitted from the host computer via the interface 101.

Upon receiving the aforementioned command and image data D0, the interface 101 decodes and sends them to the controller 100. Upon receiving the command and image data D0 from the interface 101, the circuit 100 sends a selection signal S to the selector 121 while also sending a command to the address counter 123 so that the address counter counts up to write the received image data D0 into the page memory 122.

The page memory 122 stores the image data DA for one page of the medium 33 in order beginning from the smallest address thereof. When the image data for one page has been stored into the page memory 122, the controller 100 causes the plunger magnets 107 and 109 to shift the first and second feed-direction-switching means 80 and 47 to the dotted line positions in FIG. 1. The controller 100 causes the motor 104 to drive the hopping roller 64 to rotate through slightly less than one complete rotation thereof in the direction of arrow D.

Each rotation of the hopping roller 64 delivers a sheet of the medium 33 housed in the medium cassette 67 to the guides 72 and 73. The motor/magnet driving circuit 103 is controlled so that the medium 33 is advanced to the registering rollers 65 and 66 by a distance slightly longer than the length of guides 72 and 73, causing the medium 33 to slightly slack with the front edge thereof abutting the registering rollers 65 and 66. The slack eliminates the skew problem of the medium 33. The controller 100 receives a signal from the photo interrupter 84 via the sensor driver/receiver 108, the signal indicating that the medium 33 has been fed from the medium cassette 67.

Then, the controller 100 causes the motor 105 to drive the registering rollers 65 and 66, transportation rollers 75, 76, 77, and 78 and discharge rollers 43 and 44 in rotation in the directions of arrows E, F, G, and H. The medium 33 is thus guided along the surface of the platen 74 to the transportation rollers 75 and 76 and further guided by the first feed-direction-switching means 80 to the pull-in rollers 34 and 35.

The motor/magnet driving circuit 103 causes the motor 104 to stop when the hopping roller 64 takes up the position (dotted line position in FIG. 1) where the D-cut portion of the hopping roller opposes the separating means 70, and the motor 105 to stop when the trailing edge of the medium 33 passes the discharge rollers 43 and 44. The D-cut portion of the hopping roller opposing the separating means 70 creates a gap between the D-cut portion and the separating means 70. The gap allows smooth advancement of the medium 33 from the medium cassette 67 without friction while the medium 33 is being transported by the registering rollers 65 and 66.

The controller 100 causes the motor 106 to drive the pull-in rollers 34 and 35, photosensitive body 25, charging roller 26, developing roller 28, sponge roller 30, stirring shaft 31, transfer roller 23, and the heat roller 39 of the fixing device 38 in rotation in the directions of arrows in FIG. 1.

In this manner, the medium 33 is transported in the direction of arrow J. Then, the controller 100 turns on the charging power supply 113, DB biasing power supply 111, and SP biasing power supply 110 in order to apply voltages to the charging roller 26, developing roller 28 and sponge roller 30.

The controller 100 sends a command to the page memory 122 so that the page memory sends the image data DA for one line to the LED print controlling circuit 126. The LED print controlling circuit 126, in turn, converts the received image data DA into a data form that can be transmitted to the LED head 22 and sends the converted data to the LED head 22. The LED head 22 then causes the LEDs **22*d* corresponding to the received data DA to form an electrostatic latent image of one line on the surface of the photosensitive body 25**.

In this manner, the image data DA transmitted to the LED head 22 are converted into a latent image line-by-line which is formed on the surface of the photosensitive body 25, and the exposure completes when image data for a predetermined length in the sub scanning direction of the medium 33 has been converted into a latent image. Then, the toner 32 on the developing roller 28 is deposited on the surface of the photosensitive body 25 having an electrostatic latent image formed thereon. The photosensitive body 25 is rotated and therefore each line of the electrostatic latent image is developed in succession into a toner image.

When the medium 33 reaches a position between the photosensitive body 25 and the transfer roller 23, the controller 100 outputs a command to the transfer power supply 114 so that a high voltage is applied to the transfer roller 23. Thus, the toner image on the surface of the photosensitive body 25 is transferred to the medium 33. As the photosensitive body 25 rotates, the toner image is continuously transferred to the medium 33 which is being transported in the direction of arrow J, eventually completing a toner image for one page. Upon completion of the transfer of the toner image, the controller 100 turns off the power supplies 113, 110, 111 and 114.

The toner image is fixed in the fixing device 38 when the medium 33 passes between the heat roller 39 and the pressure roller 40, the heat roller 39 having been maintained to a predetermined temperature proper for fixing. Upon completion of fixing, the medium 33 is guided by the second feed-direction-switching means 47 and guides 41 and 48 in the direction of arrow K1, and is then discharged by the discharge rollers 43 and 44 through the copy exit 45 to the exit stacker 46. The photo interrupter 85 detects the trailing edge of the medium 33 and informs the controller 100 that the medium 33 has been discharged.

Upon completion of discharge of the medium 33, the controller 100 causes the motors 105 and 106 to stop, completing the printing operation.

The printing operation of a color image on one side of the medium 33 performed by the color ink jet printing mechanism 50 will now be described.

A host computer, not shown, transmits image data D0 and a command to the interface 101, the command indicating that color image printing operation on one side of the medium 33 is to be performed by the color ink jet print mechanism 50. The interface 101 decodes and sends the received command and image data D0 to the controller 100. The controller 100 causes the plunger magnets 107 and 109 to shift the first and second feed-direction-switching means 80 and 47 to the positions shown by solid lines in FIG. 1.

The controller 100 causes the spacing motor 60 to drive the carriage 53 to run. The photo interrupter 86 detects the carriage 53 and sends a signal indicating the position of the carriage 53. This position is the home position of the carriage 53. As mentioned in the description of monochromatic image printing by the LED printing mechanism, the medium 33 is delivered in the direction of arrow L to a position immediately below the nozzles of the ink jet recording head 54.

Upon receiving the image data D0 of one line from the host computer via the interface 101, the controller 100 outputs the commands to the interface 101, selector 121 and the respective line buffers. The selector 121 selects the image data D0 supplied from the interface 101 and outputs the image data D0 to the data bus DB.

The controller 100 causes the address counters 125Y–125K to count up so as to write data into the respective line buffers. The interface 101 separates the received image data D0 according to color and stores the separated image data of each color as an image data DA for one line into the corresponding one of the line buffers 124Y, 124M, 124C, and 124K. In other words, the image data DA of yellow, magenta, cyan and black are stored into the line buffers 124Y, 124M, 124C, and 124K, respectively.

Then, the controller 100 causes the spacing motor 60 to drive the carriage 53 so that the carriage 53 runs in the direction of arrow B for spacing. While the carriage 53 is performing the spacing operation, the recording heads 54Y, 54M, 54C, and 54K discharge ink through the corresponding nozzles in accordance with the data DA stored in the line buffers 124Y, 124M, 124C, and 124K, respectively.

Upon completion of the printing operation of one line, the controller 100 causes the motor 105 to drive the rollers 65–66, 75–76, 77–78, and 43–44 in rotation in the directions of arrows E, F, G, and H so as to further transport the medium a distance equal to one line in the direction of arrow L. This completes line-feed operation of the carriage.

The controller 100 drives the spacing motor 60 in reverse rotation, causing the carriage 53 to run in the direction of arrow C to the home position. This completes the return-to-home operation of the carriage 53. While the line-feed operation and the return-to-home operation of the carriage 53 are being carried out, the controller 100 receives the image data D0 for the next line, and resumes the aforementioned printing operation, line-feed operation, and return-to-home operation upon receiving the image data DA of the next line.

While the reception of the image data D0, printing operation, line-feed and return-to-home operations are repeatedly carried out, the medium 33 is transported to the transportation rollers 75 and 76 and is then guided by the first feed-direction-switching means 80 and guides 81 and 82 through the guide path 83 to the transportation rollers 77 and 78. The medium 33 is then guided by the guides 42 and 48, passing through a space between the second feed-direction-switching means 47 and the guide 48 in the direction of arrow K1. The medium 33 is finally discharged by the discharge rollers 43 and 44 to the exit stacker 46.

Upon completion of the discharge of the medium 33, the controller 100 causes the motor 105 to stop. Thus, the printing operation of one page of the medium 33 completes. The aforementioned operations are carried out for the following pages of the medium 33.

The combination of monochromatic print and color print on one side of the medium 33 will now be described, which is performed by both the LED printing mechanism 20 and the color ink jet printing mechanism 50.

First, the first feed-direction-switching means 80 is at the solid line position shown in FIG. 1 an the color ink jet printing mechanism performs color print. The ink jet recording head 54 performs color print of one page of the medium 33 in accordance with the data DA of yellow, magenta, and cyan while the medium 33 is being transported in the directions of arrows L and M. The controller 100 causes the motor 105 to drive the rollers 65–66, 75–76, 77–78, and 43–44 in rotation in the directions of arrows E, F, G, and H, transporting the medium 33 in the direction of arrow N till the leading edge of the medium 33 reaches the transportation rollers 75–76.

Subsequently, the first feed-direction-switching means 80 is shifted to the dotted line position in FIG. 1. The motor 105 drives the rollers 65–66, 75–76, 77–78, and 43–44 in rotation in the directions of arrows E, F, G, and H, respectively, so that the medium 33 is guided by the first feed-direction-switching means 80 to advance in the direction of arrow J to a position where the LED printing mechanism 20 performs the monochromatic image printing.

The combination of monochromatic print and color print on one side of the medium 33 will be described in detail.

A host computer, not shown, transmits an image data D0 and a command to the interface 101, the command indicating that the combination of monochromatic print and color print on one side of the medium 33 is to be performed by the color ink jet printing mechanism 50 and the LED printing mechanism 20. Just as in the previously mentioned color printing operation on a single side of the medium 33, the controller 100 outputs a command to the motor/magnet driving circuit 103 in order to transport the medium 33 in the direction of arrow L to a position immediately below the nozzles of the ink jet recording head 54. Then, upon receiving the image data D0 for one line via the interface 101 from the host computer, the controller 100 outputs commands to the interface 101, selector 121, page memory 122, line buffers 124Y, 124M, and 124C, and address counters 123, 125Y, 125M, and 125C. In response to the command, the selector 121 selectively outputs the image data D0, received from the interface 101, to the data bus DB. The controller 100 causes the address counters 123, 125Y, 125M, and 125C to count up so as to write the data into the page memory 122 and respective line buffers 124Y, 124M, and 124C. The interface 101 separates the received image data D0 according to color and stores the separated image data of each color as an image data DA for one line into the page memory 122 and the corresponding one of the line buffers 124Y, 124M, and 124C.

In other words, the image data DA of yellow, magenta, cyan and black are stored into the line buffer 124Y, 124M, 124C, and page memory 122, respectively. It is to be noted that the data DA of black is not stored in the line buffer 124K and therefore printing operation by the recording head 54K is not performed.

Then, the controller 100 causes the spacing motor 60 to cause the carriage 53 to run for spacing in the direction of arrow B. While the carriage 53 is spacing, the recording heads 54Y, 54M, and 54C discharge ink through the corresponding nozzles in accordance with the data DA stored in the line buffers 124Y, 124M, and 124C, respectively.

Upon completion of printing operation of one line, the controller 100 causes the motor 105 to drive the rollers 65–66, 75–76, 77–78, and 43–44 in rotation in the directions of arrows E, F, G, and H, respectively, so that the medium 33 is caused to advance in the direction of arrow L by a distance equal to one line for line-feed operation of the carriage 53.

Further, the controller 100 causes the spacing motor 60 to rotate in the reverse direction so that the carriage 53 runs in the direction of arrow C to the home position, completing return-to-home operation of the carriage 53. While the line-feed and return-to-home operations of the carriage 53 are being carried out, the controller 100 receives the image data D0 for the next line and thereafter resumes the aforementioned printing operation, line-feed operation, and return-to-home operation.

While repeatedly performing the reception of the image data D0, printing operation, line-feed operation, and return-to-home operation, the controller 100 causes the transportation rollers 75 and 76 to transport the medium 33. The medium 33 is guided by the first feed-direction-switching means 80 and guides 81 and 82 through the guide path 83 to the transportation rollers 77 and 78. While the color ink jet printing mechanism 50 is performing color printing operation, the image data DA of black is stored on a line-by-line basis into the page memory 122.

When the color ink jet printing mechanism 50 completes the printing of the final line, the controller 100 causes the motor 105 to rotate in the reverse direction, so that the registering rollers 65 and 66, transportation rollers 75 and 76, and transportation rollers 77 and 78, and discharge rollers 43 and 44 are rotated in the reverse directions. Thus, the medium 33 advances in the direction of arrow N, and the trailing end of the medium 33 moves in the direction of arrow P to project through the supply/take-up slot 86*a*. Then, the medium 33 is further transported in the direction of arrow N until the leading end of the medium 33 arrives at the transportation rollers 75 and 76, and the controller 100 causes the motor 105 to stop. The photo interrupter 85 detects the leading end and trailing end of the medium 33, and informs the controller 100 that the medium has advanced predetermined forward and rearward distances.

When the leading end of the medium 33 arrives at the transportation rollers 75 and 76, the controller 100 drives the plunger magnets 107 and 109 to shift the first feed-direction-switching means 80 and second feed-direction-switching means 47 to the dotted line positions shown in FIG. 1. The controller 100 causes the motor 105 to rotate in the forward direction so that the registering rollers 65 and 66, transportation rollers 75 and 76, the transportation rollers 77 and 78, and discharge rollers 43 and 44 are rotated in the directions of arrows E, F, G, and H. The controller 100 also causes the motor 106 to drive the rollers 34 and 35, photo sensitive body 25, charging roller 26, developing roller 28, sponge roller 30, stirring shaft 31, transfer roller 23, and heat roller 39 of the fixing device 38, all in rotation in the directions shown in FIG. 1.

Thus, the medium 33 is transported in the direction of arrow J to the LED printing mechanism 20. The motors 105 and 106 rotate so that the motors 105 and 106 transport the medium 33 at the same speed. Then, the controller 100 turns on the charging power supply 113, DB biasing power supply 111, and SP biasing power supply 110 in order to apply voltages to the charging roller 26, developing roller 28 and sponge roller 30, respectively.

The controller 100 issues a command to the page memory 122 in which the image data DA of black for one page is stored, so as to send the image data DA of one line from the page memory 122 to the LED print controlling circuit 126. The image data DA stored in the page memory 122 is of a form that the image data DA can be directly printed by the LED head 22.

Upon receiving a command from the controller 100, the LED print controlling circuit 126 transmits the image data DA received form the page memory 122 to the LED head 22, which in turn causes the LEDs 22*d* to light up in accordance with the received data DA to form an electrostatic latent image of one line on the photosensitive body 25. Thus, the image data DA transmitted to the LED head 22 on a line-by-line basis is converted into an electrostatic latent image on the surface of the photosensitive body 25. The toner 32 on the developing roller 28 is deposited to the electrostatic latent image, converting the electrostatic latent image into a toner image.

When the leading end of the medium 33 arrives at a position between the photosensitive body 25 and the transfer roller 23, the controller 100 issues a command to the transfer power supply 114 which in turn applies a high voltage to the transfer roller 23 to electrically transfer the toner image formed on the surface of the photosensitive body 25 onto the medium 33. After transfer of the toner image, the controller 100 turns off the charging power supply 113, SP biasing power supply 110, DB biasing power supply 111, and transfer power supply 114.

The toner image is then fixed as the medium 33 passes between the heat roller 39 and the pressure roller 40. After fixing, the medium 33 is guided by the second feed-direction-switching means 47 and guides 41 and 48 in the direction of arrow K, and finally discharged by the discharge rollers 43 and 44 through the copy exit 45 to the exit stacker 46. Upon completion of discharging the the medium 33, the controller 100 causes the motors 105 and 106 to stop, completing the printing operation of the medium 33.

It is to be noted that in the aforementioned combination of print mode performed by the color ink jet printing mechanism 50 and LED printing mechanism 20, the medium 33 is intermittently advanced during color print performed by the mechanism 50 but is continuously advanced during monochromatic print by the mechanism 20.

Registration of the color image with the monochromatic image in the aforementioned combination of color and monochrome prints will now be described.

When the photo interrupter 85 detects the forward end of the medium 33, the controller 100 delivers the medium 33 to a position where printing operation by the color ink jet printing mechanism 50 takes place, and the color ink jet printing mechanism 50 starts printing operation. When the mechanism 50 completes the print of the final line of the page, the medium 33 is transported in the direction of arrow N to the transportation rollers 75 and 76.

Then, the medium 33 is transported in the direction of arrows L and J so that the mechanism 20 starts printing at a position on the surface of the medium where the mechanism 50 initiated printing operation thereof. For example, if the motors 105 and 106 take the form of a stepping motor, the two print positions are registered based on the number of steps of feeding the medium. In this manner, the combination of color and monochromatic images can be performed by the use of the mechanisms 50 and 20.

The printing operation of a color image on both sides of the medium 33 performed by the color ink jet printing mechanism 50 will be described.

A host computer, not shown, transmits an image data D0 and a command to the interface 101, the command indicating that color print on both sides of the medium 33 is to be performed by the color ink jet printing mechanism 50. Then, the color print on one side of the medium 33 is performed just as in the previously described color print on one side of the medium 33.

When the color ink jet printing mechanism 50 completes the printing of the final line, the controller 100 causes the motor 105 to rotate in the reverse direction, so that the registering rollers 65 and 66, transportation rollers 75 and 76, and transportation rollers 77 and 78, and discharge rollers 43 and 44 are rotated in the directions opposite to arrows E, F, G, and H.

Thus, the medium 33 advances in the direction of arrow N, and the trailing end of the medium 33 moves in the direction of arrow P to project through the supply/take-up slot 86*a*. Then, the medium 33 is further transported in the direction of arrow N until the leading end of the medium 33 arrives at the transportation rollers 75 and 76, and the controller 100 causes the motor 105 to stop.

When the leading end of the medium 33 arrives at the transportation rollers 75 and 76, the controller 100 drives the plunger magnets 107 and 109 to shift the first feed-direction-switching means 80 to the dotted line position and the second feed-direction-switching means 47 to the solid line position.

Then, the medium 33 is transported in the direction of arrow J to the LED printing mechanism 20, being guided by the first feed-direction-switching means 80.

The controller 100 issues a command to the LED print controlling circuit 126 which in turn prevents any one of the LEDs 22*d* of the LED head 22 from lighting up. Thus, an electrostatic latent image is not formed on the surface of the photo sensitive body 25 and therefore the toner 32 is not deposited on the surface of the photosensitive body 25.

Having no toner image transferred thereon, the medium 33 arrives at a position between the heat roller 39 and the pressure roller 40, which rollers 39 and 40 cooperates with the second feed-direction-switching means 47 to transport the medium 33 in the direction of arrow N to the transportation rollers 77 and 78. The transportation rollers 75–78 are positioned such that the trailing end of the medium leaves the transportation rollers 75 and 76 when the leading end of the medium arrives at the transportation rollers 77 and 78.

When the leading end of the medium 33 reaches the transportation rollers 77 and 78, i.e., when the trailing end of the medium 33 leaves the transportation rollers 75 and 76, the controller 100 causes the motor 105 to rotate in the reverse direction so that the registering rollers 65 and 66, transportation rollers 75 and 76, transportation rollers 77 and 78, and discharge rollers 43 and 44 are rotated in the directions opposite to arrow E, F, G, and H. The controller 100 also causes the plunger magnet 107 to shift the first feed-direction-switching means 80 to the solid line position in FIG. 1. Thus, the medium 33 is guided by the transportation rollers 77 and 78 in the direction of arrow N through the guide path 83 to the transportation rollers 75 and 76. Further rotation of the motor 105 causes the medium 33 to further advance so that the leading end of the medium 33 placed face down takes up the position immediately below the nozzles of the ink jet recording head 54.

The relationship between the print direction and transportation direction of the medium 33 will now be described with respect to both side color image print performed by the color ink jet printing mechanism 50.

Figure 5:
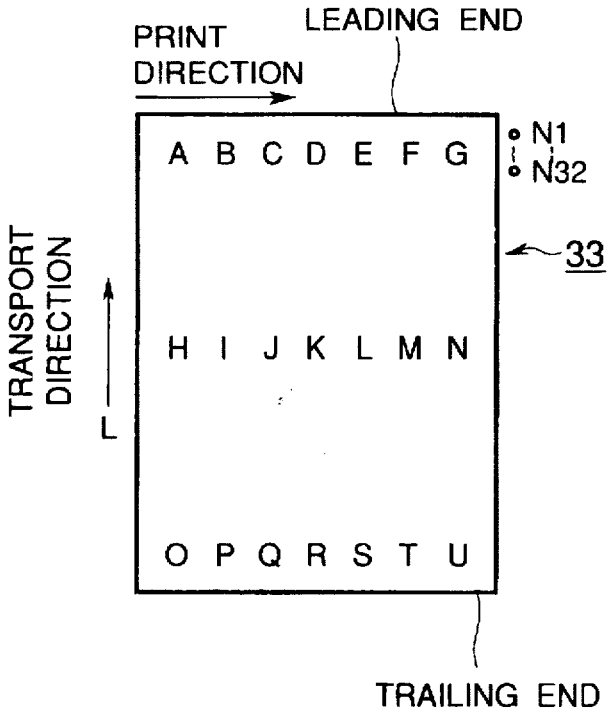
FIG. 5 shows a medium at a first position in the first embodiment.
Figure 6:
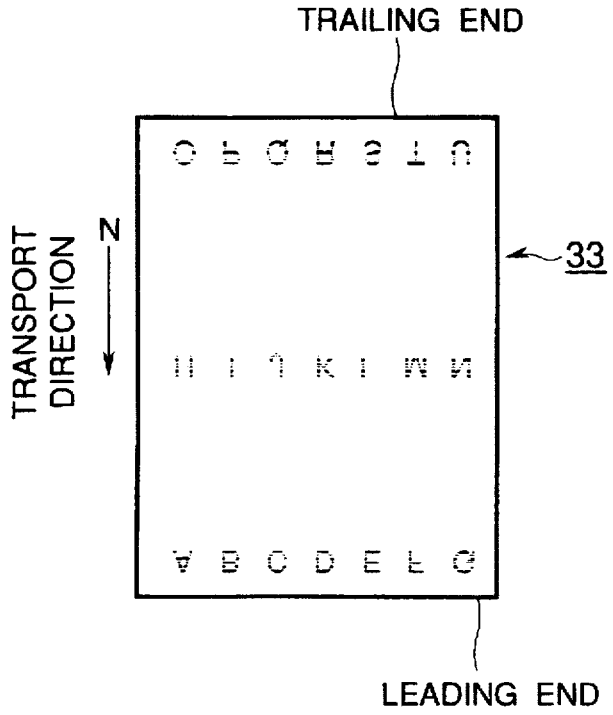
FIG. 6 shows the medium at a second position in the first embodiment.
Figure 7:
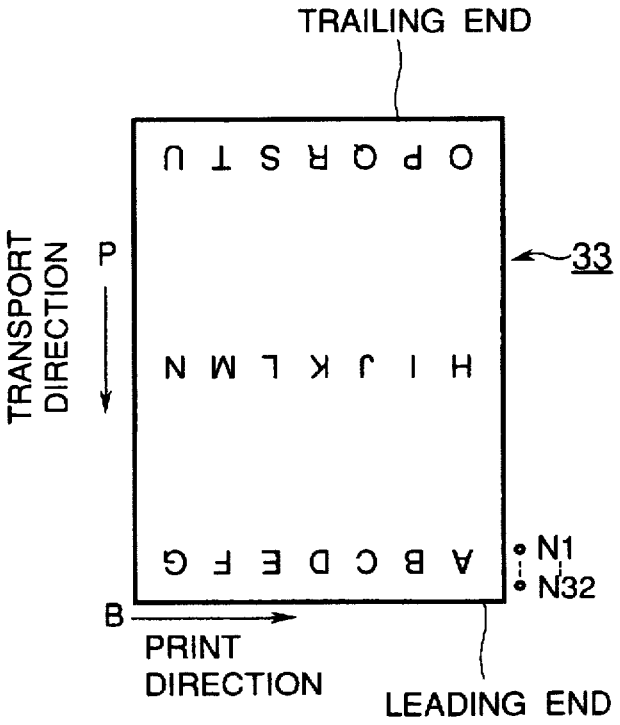
FIG. 7 shows the medium at a third position in the first embodiment.
Figure 8:
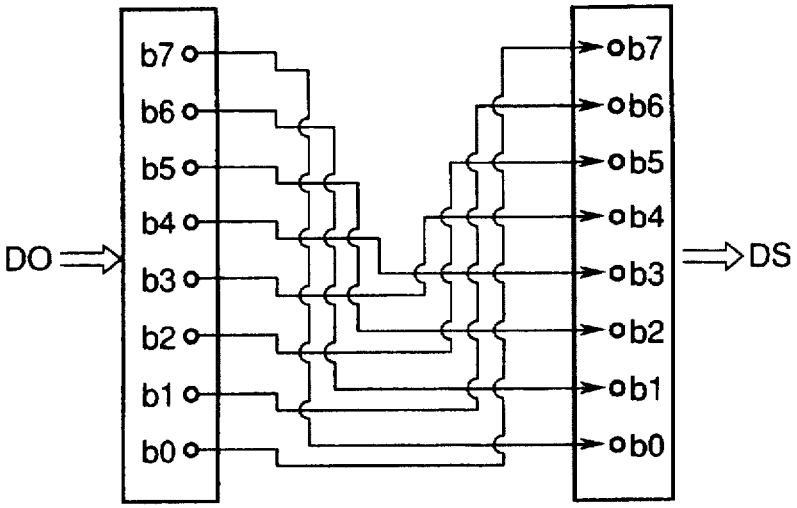
FIG. 8 shows a bit translator of the first embodiment.
Figure 9:
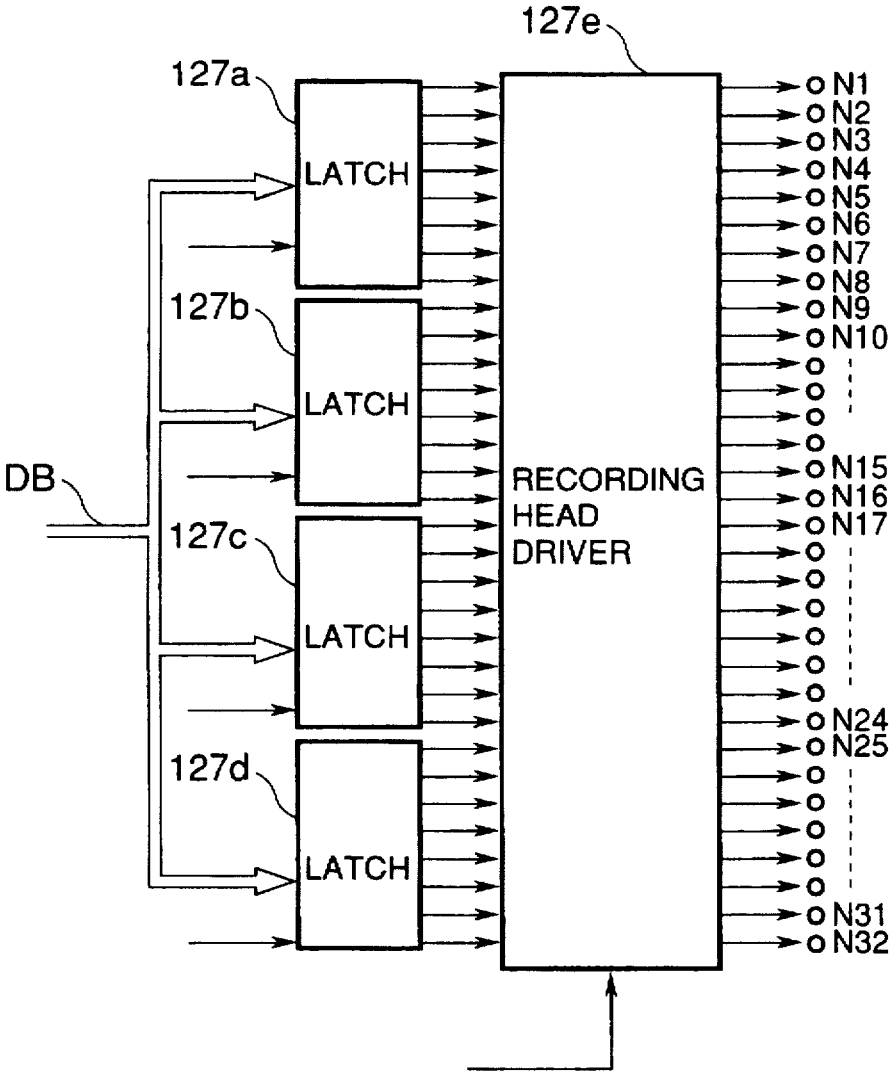
FIG. 9 shows a recording-head controlling circuit of the first embodiment.
Figure 10:
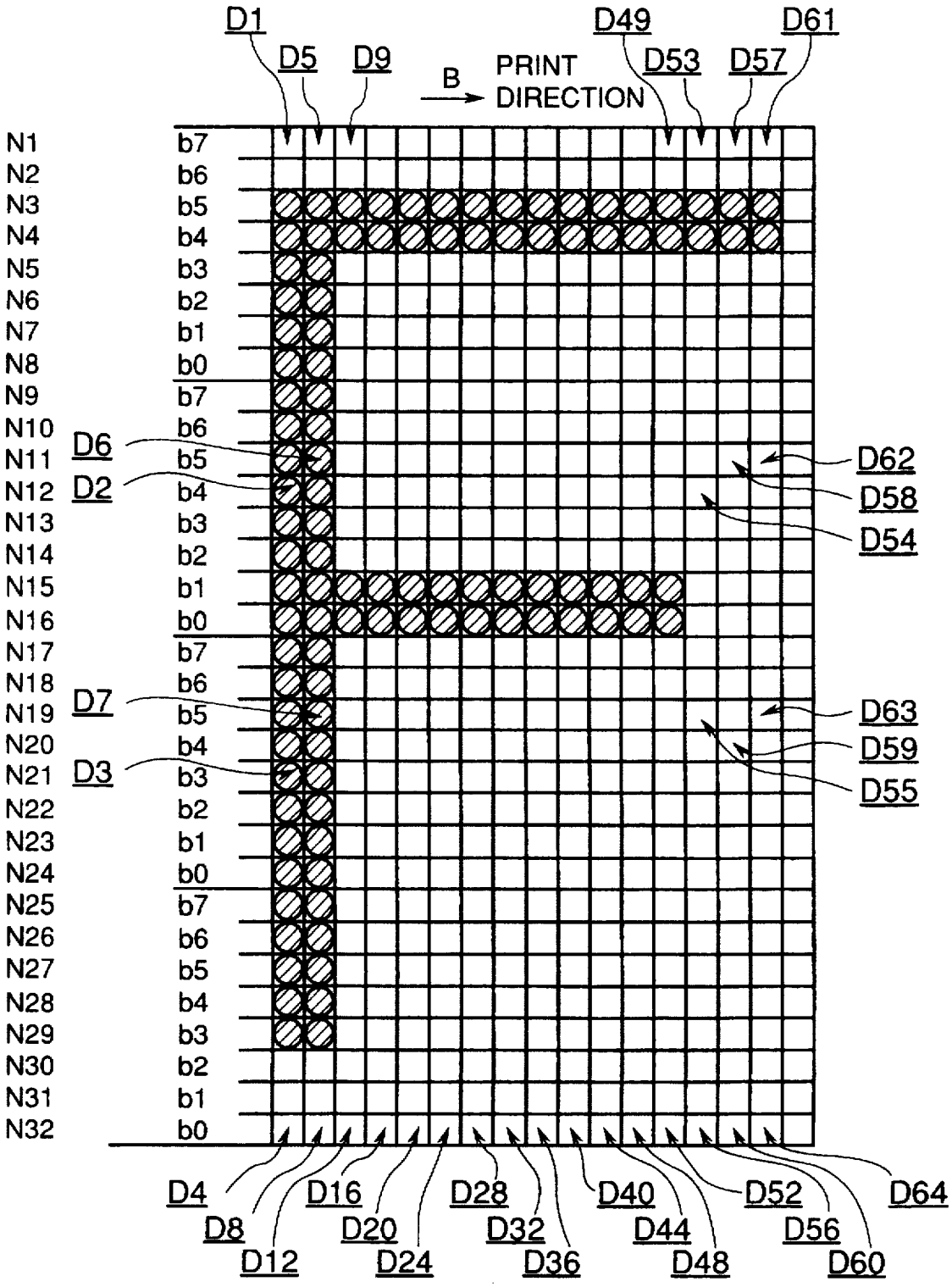
FIG. 10 shows a first example of a print image in the first embodiment.
Figure 11:
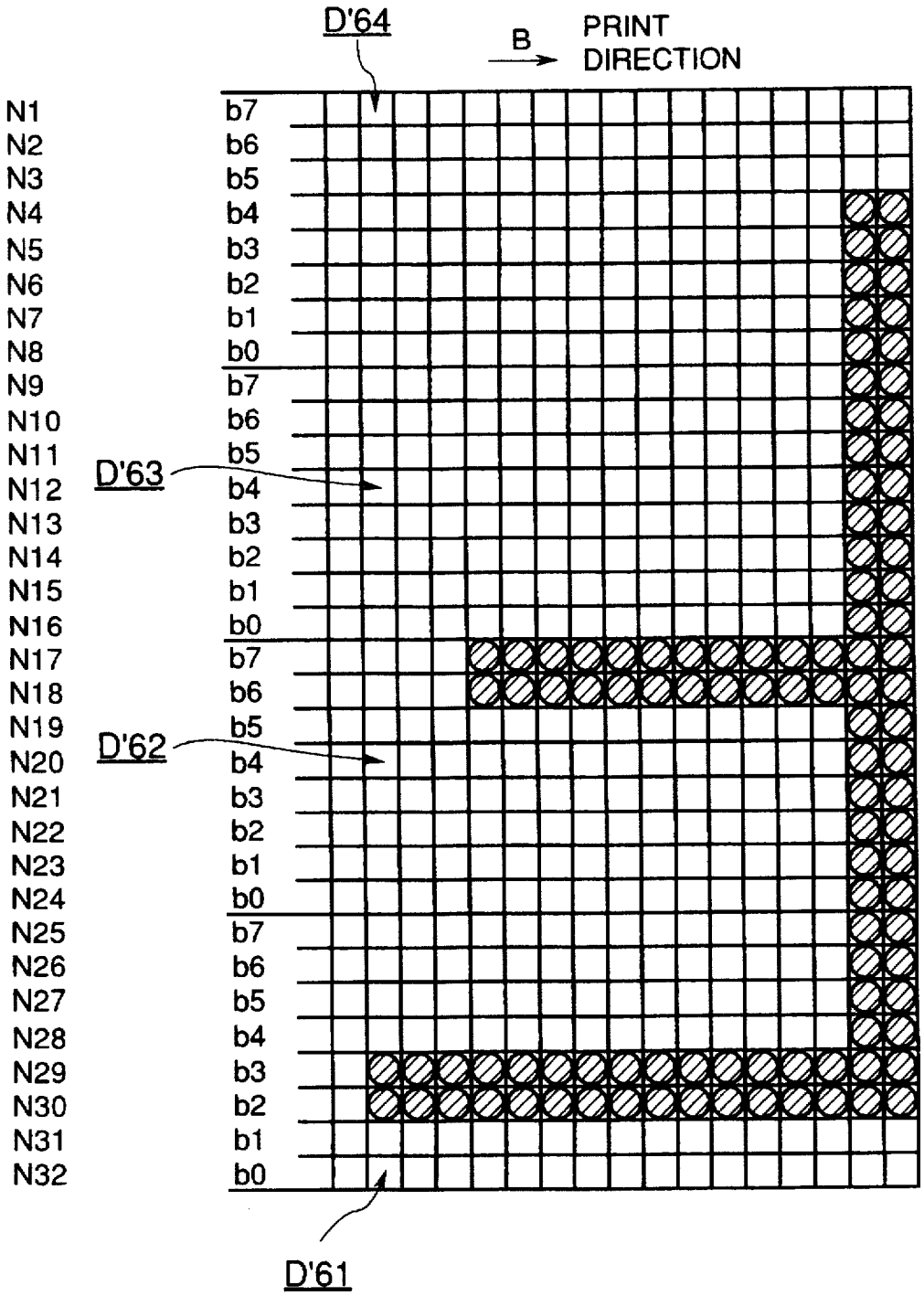
FIG. 11 shows a second example of a print image in the first embodiment.

FIG. 5 shows the medium 33 when it is at a first position of the first embodiment and FIG. 6 when the medium 33 is at a second position. FIG. 7 shows the medium 33 when it is at a third position. FIG. 8 shows a bit translator of the first embodiment and FIG. 9 shows a recording head controlling circuit of the first embodiment. FIG. 10 shows a first example of the print image of the first embodiment, FIG. 11 a second example, and FIG. 12 a third example.

When printing on the front side of the medium 33 supplied by the paper-feeding mechanism 62 (FIG. 1), the medium 33 is fed in the direction of arrow L while the carriage 53 runs in the direction of arrow B.

A total of 32 nozzles, not shown, of the ink jet recording head 54 are aligned in parallel to the direction of travel of the medium, designated N1 to N32 in order from the leading end of the medium. Upon completion of print on the front side of the medium 33, the medium 33 is advanced by the transportation rollers 77 and 78 in the direction of arrow N to the transportation rollers 75 and 76. When the medium 33 is advanced by the transportation rollers 75 and 76, the medium is transported face down so that the characters printed on the front side of the medium 33 now appears on the underside of the medium 33 as denoted by dotted lines in FIG. 6.

As shown in FIG. 7, both side print is accomplished by driving the carriage 53 in the direction of arrow B to print on the back side of the medium 33 while transporting the medium 33 in the direction of arrow P. It is to be noted that the nozzles N1–N32 are now aligned in the order of N1, N2 . . . , N32 from the trailing end to the leading end of the medium 33.

When printing, for example, character "F" on the front side of the medium 33, the nozzles N1–N32 are driven as shown in FIG. 10. The Nozzles N1–N8 correspond to bit B7–B0 of the data D1 to be first printed, nozzles N9–N16 to bit b7–b0 of the data D2 to be next printed, nozzles N17–N24 to bit b7–b0 of the data D3 to be further next printed, and nozzles N25–N32 to bit b7–b0 of the data D4 to be further next printed.

The image data DA outputted from the line buffers 124Y, 124M, 124C, an 124K (FIG. 3) are sent in the order of D1, D2, D3, and D4 to the recording head controlling circuits 127Y, 127M, 127C, and 127K (FIG. 4), respectively. As shown in FIG. 9, the recording head controlling circuits 127Y, 127M, 127C, and 127K each have latches 127*a*–127*d* so that the data D1, D2, D3, and D4 are latched in the latches 127*a*, 127*b*, 127*c*, and 127*d*, respectively. The recording head driver 127*e* receives the latched data D1–D4, and drives the nozzles N1–N32 in accordance with the data D1–D4 to jet ink for print.

Then, the controller 100 causes the spacing motor 60 to drive the carriage 53 to run by one dot in the direction of arrow B so that the nozzles N1–N32 are driven in accordance with the data D5–D8. Likewise, the spacing motor 60 drives the carriage 53 to run by one dot in the direction of arrow B to print in accordance with four bytes each time, thus printing character "F" as shown in FIG. 10.

When printing on the back side of the medium 33, the bit translator 120 translates the image data D0 received through the interface 101 into the image data DS, which in turn is outputted to the data bus DB in response to a command issued by the controller 100 to the selector 121.

As shown in FIG. 8, the bit translator (B/T) 120 reverses the structure of eight bits of image data D0 so that the highest bit b7 of the data D0 is translated to the lowest bit b0, bit b6 to bit b1, bit b5 to bit b2, bit b4 to bit b3, bit b3 to bit b4, bit b2 to bit b5, and bit b1 to bit b6, and bit b0 to bit b7.

The image data D0 transmitted via the interface 101 from the host computer, not shown, consists of the data D1–D64 as shown in FIG. 10. The data D1–D64 become data D'1 to D'64 after bit translation performed by the bit translator 120.

Figure 12:
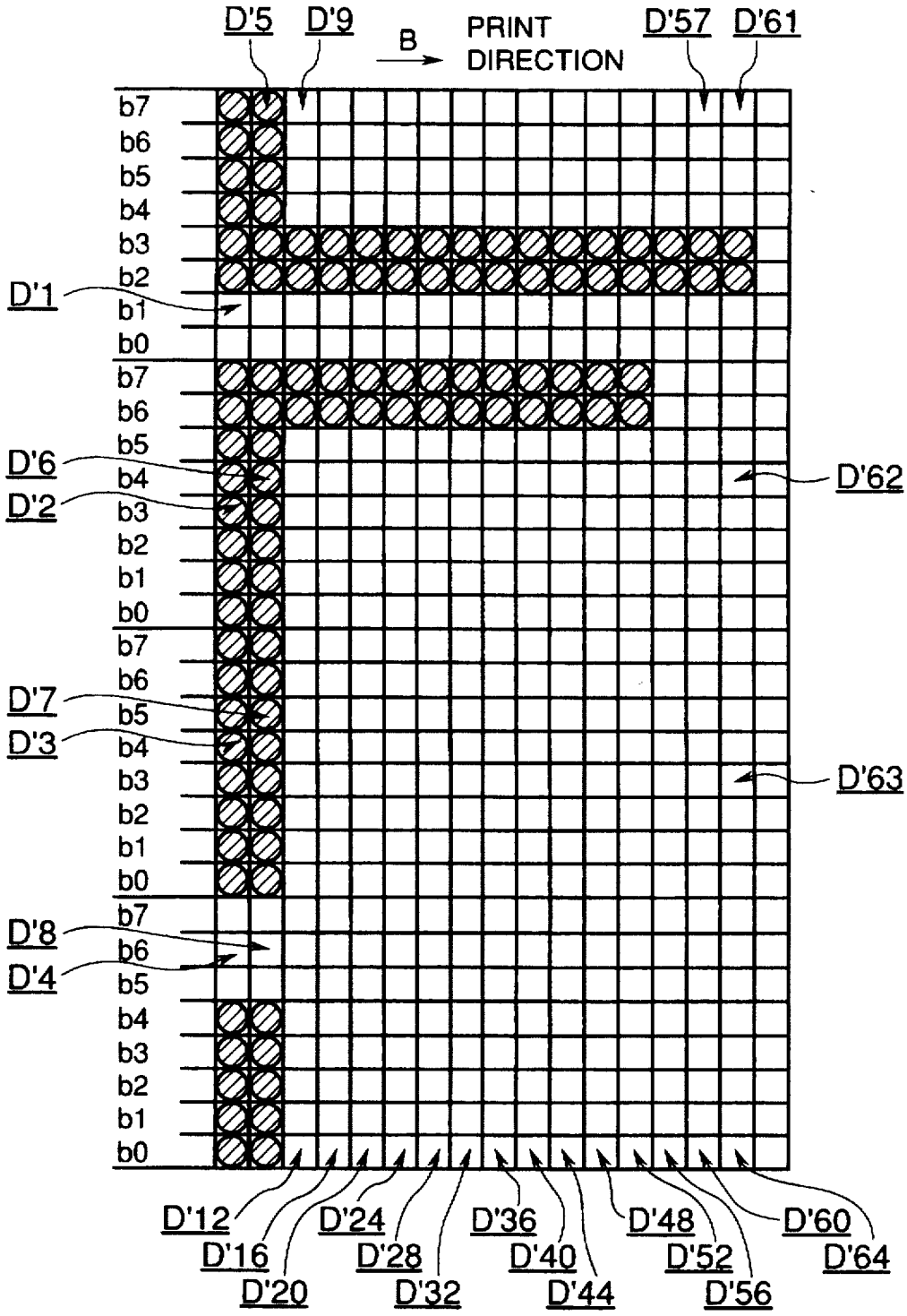
FIG. 12 shows a third example of a print image in the first embodiment.

The respective address counters 125Y, 125M, 125C, and 125K count up so that the data D'1 to D'64 are stored as image data DA in order into the line buffers 124Y, 124M, 124C, and 124K, four bytes for each buffer. When, the image data for one line has been stored into the respective line buffers 124Y, 124M, 124C, and 124K, the address counters 125Y, 125M, 125C, and 125K are caused to down count so that the image data DA stored in the buffers are read out in the reverse order. FIG. 12 shows an example where the image data DA are read out in the order of D'64, D'63 . . . , D1.

The spacing motor 60 drives the carriage 53 to run on a dot-by-dot basis in the direction of arrow B while the nozzles N1, N2, . . . , N32 are driven to print in accordance with the image data DA four bytes for each movement of the carriage, thus printing character "F" as shown in FIG. 10 on the medium 33.

When print is to be made on the back side of the medium 33, the medium 33 is transported in the direction of arrow P opposite to the case where print was made on the front side of the medium 33.

In the recording apparatus of the aforementioned construction, upon receiving the image data D0 for one line from the host computer, the controller 100 causes the bit translator 120 to translate the image data D0, and outputs a command to the selector 121 to output the bit-translated image data DS to the data bus DB.

The controller 100 causes the respective address counters 125Y, 125M, 125C, and 125K to count up so that the data D1–D4 for one line are stored into the respective line buffers 124Y, 124M, 124C, and 124K beginning from the smallest address. Then, the controller 100 causes the address counters 125Y, 125M, 125C, and 125K to down count to read the four bytes of data (D1–D4) from the line buffers 124Y, 124M, 124C and 124K beginning from the largest address of the respective line buffer (address into which the final bit of each of the data D1–D4 is stored). The four bytes of data (D1–D4) thus read out are then latched in order into the latches 127*a*, 127*b*, 127*c*, and 127*d* in the respective recording head controlling circuits 127Y, 127M, 127C, and 127K. Upon receiving the latched data D1–D4, the recording head driver 127 drives the respective nozzles N1–N32 to print in accordance with the data D1–D4.

The controller 100 causes the spacing motor 60 to drive the carriage 53 to run by one dot in the direction of arrow B, and thereafter sends the next four bytes of data D5–D8 from the line buffers 124Y, 124M, 124C, and 124K to the recording head control circuits 127Y, 127M, 127C, and 127K, and then the nozzles are driven to print in accordance with the data D5–D8. The spacing motor 60 drives the carriage 53 to run on a dot-by-dot basis in the direction of arrow B while printing in accordance with the four bytes of data. This completes print of one line.

Upon completing printing of one line, the controller 100 causes the motor 105 to rotate in the reverse direction so that the registering rollers 65 and 66, transportation rollers 75 an 76, transportation rollers 77 and 78, and discharge rollers 43 and 44 are rotated in the directions opposite to arrows E, F, G, and H to transport the medium 33 by one line in the direction of arrow P for line-feed operation.

Then, the controller 100 causes the spacing motor to rotate in the reverse direction for return-to-home operation of the carriage 53 where the carriage 53 runs in the direction of arrow C to the home position. While the line-feed operation and the return-to-home operation of the carriage 53 are being carried out, the controller 100 receives the image data D0 for the next line. While the reception of the image data D0, printing operation, line-feed operation, and return-to-home operation are performed repeatedly, the medium 33 is transported by the registering rollers 65 and 66 and transportation rollers 75–78 in the direction of arrows N and P and the leading end of the medium 33 ejected through the supply/take-up slot 86*a*.

Upon completing the print of the final line, the controller 100 causes the motor 105 to rotate in the forward direction so that the registering rollers 65 and 66, transportation rollers 75 and 76, transportation rollers 77 and 78, and discharge rollers 43 and 44 are rotated in the directions of arrows E, F, G, and H. Thus, the medium 33 having been printed by the ink jet recording head 54 is transported by the transportation rollers 75 and 78 and guided by the first feed-direction-switching means 80 in the directions of arrows L and M. The medium 33 is further guided through the guide path 83, transported by the transportation rollers 77 and 78, and guided by the guides 42 and 48. The medium 33 then passes between the second feed-direction-switching means 47 and the guide 48 in the direction of arrow K and is discharged by the discharge rollers 43 and 44 to the exit stacker 46.

In this manner, upon discharge of the medium 33, the controller 100 stops the motor 105, completing printing operation of one page. Monochromatic printing operation on both sides of the medium 33 performed by the LED printing mechanism 20 will now be described. The host computer, not shown, sends the image data D0 and a command to the interface 101, the command indicating that monochromatic printing operation on the both sides of the medium is to be performed.

The interface 101 decodes the received command and image data D0 and sends them to the controller 100. Then, the controller 100 outputs a command to the motor/magnet driving circuit 103 which in turn causes the plunger magnets 107 and 109 to shift the first feed-direction-switching means 80 to the dotted line position and the second feed-direction-switching means 47 to the solid line position in FIG. 1.

Printing operation on the front surface of the medium 33 will now be described.

Upon receiving the image data D0 from the host computer via the interface 101, the controller 100 sends a selection signal S to the selector 121. In response to the selection signal S, the selector selects the image data D0 sent from the interface 101 and outputs the image data to the data bus DB. The controller 100 causes the address counter 123 to count up so that the image data D0 is stored as image data DA into the page memory 122. The page memory 122 stores image data DA for one page to be printed on the medium 33.

Then, the controller 100 causes the motor 104 to deliver the medium 33 through the guides 72 and 73 to the registering rollers 65 and 66.

The controller 100 causes the motor 105 to further transport the medium 33 to the pull-in rollers 34 and 35. Then, the controller 100 causes the motor 106 to drive the rollers 34 and 35, photosensitive body 25, charging roller 26, developing roller 28, sponge roller 30, stirring shaft 31, transfer roller 23, and heat roller 39 of the fixing device 38 in rotation in the directions of arrows shown in FIG. 1. Thereafter, the power supplies 113, 111, 110 are turned on which apply voltages to the rollers 26, 28, 30.

The controller 100 causes the memory 122 to output the image data DA for one line in order beginning from the smallest address to the LED print controlling circuit 126. The LED print controlling circuit 126 sends the image data received from the page memory 122 to the LED head 22, which causes the LEDs 22*d* to form an electrostatic latent image of one line on the surface of the photosensitive body 25 in accordance with the image data DA.

The toner 32 on the developing roller 28 is deposited on the electrostatic latent image formed on the photosensitive body 25 so that the electrostatic latent image is converted into a toner image. When the leading end of the medium 33 arrives a position between the photosensitive body 25 and the transfer roller 23, the transfer power supply 114 applies a high voltage to the transfer roller 23 to transfer the toner image from the surface of the photosensitive body 25 onto the medium 33. Upon completion of the transfer of the toner image, the power supplies 113, 114, 110, 111 are turned off.

The medium 33 is then delivered to the fixing device 38 where the medium 33 passes between the heat roller 39 and the pressure roller 40 urged to the heat roller 39 so that the toner image is fixed on the medium 33. After fixing, the medium 33 leaves the heat roller 39 and the pressure roller 40 and is guided by the second feed-direction-switching means 47 and the guide 42 and 48 in the direction of arrow N to the transportation rollers 77 and 78.

When the leading end of the medium 33 arrives the transportation rollers 77 and 78 i.e., when the trailing end of the medium 33 leaves the transportation rollers 75 and 76, the controller 100 causes the motor 106 to stop and the motor 105 to rotate in the reverse direction so that the registering rollers 65 and 66, transportation rollers 75 and 76, transportation rollers 77 and 78 and discharge rollers 43 and 44 are rotated in the directions opposite to arrows E, F, G, and H. The controller 100 also causes the motor/magnet driving circuit 103 to drive the plunger magnet 107 to shift the first feed-direction-switching means 80 to the solid line position in FIG. 1.

Thus, the medium 33 is delivered by the transportation rollers 77 and 78 and the guide path 83 in the direction of arrow N. The motor 105 is rotated in the reverse direction so that the medium 33 is further transported by the registering rollers 65 and 66 in the direction of arrow P till the trailing end of the back side of the medium 33 projects outwardly of the apparatus through the supply/take-up slot 86*a*. Then, when the trailing end of the medium 33 arrives at a position where the medium 33 is caught between the transportation rollers 75 and 76, the controller 100 causes the motor 105 to stop.

Then, the controller 100 drives the plunger magnets 107 and 109 to shift the first feed-direction-switching means 80 and the second feed-direction-switching means 47 to the dotted line positions, respectively, in FIG. 1. Then, the controller 100 causes the motor to rotate and then the motor 105 to rotate in the forward direction so that the rollers 34 and 35, photosensitive body 25, rollers 26, 28, 30, stirring shaft 31, and rollers 23 and 39 are rotated in the directions of the arrows in FIG. 1, and the registering rollers 65 and 66, transportation rollers 75 and 76, transportation rollers 77 and 78, and discharge rollers 43 and 44 in the directions of arrows E, F, G, and H. The apparatus is now ready for printing operation of the back side of the medium 33.

The relationship between the print direction and feed direction of the medium 33 will now be described with respect to monochromatic print on both sides of the medium 33 performed by the LED printing mechanism 20.

Figure 13:
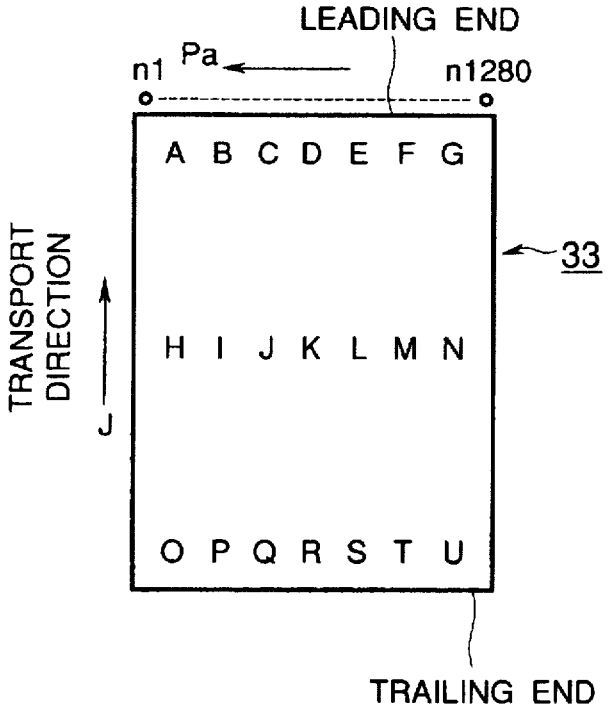
FIG. 13 shows the medium at a fourth position in the first embodiment.
Figure 14:
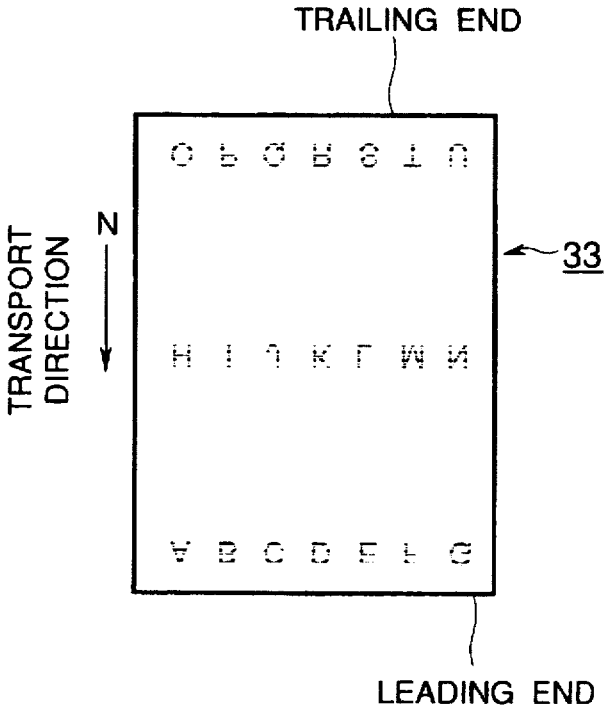
FIG. 14 shows the medium at a fifth position in the first embodiment.
Figure 15:
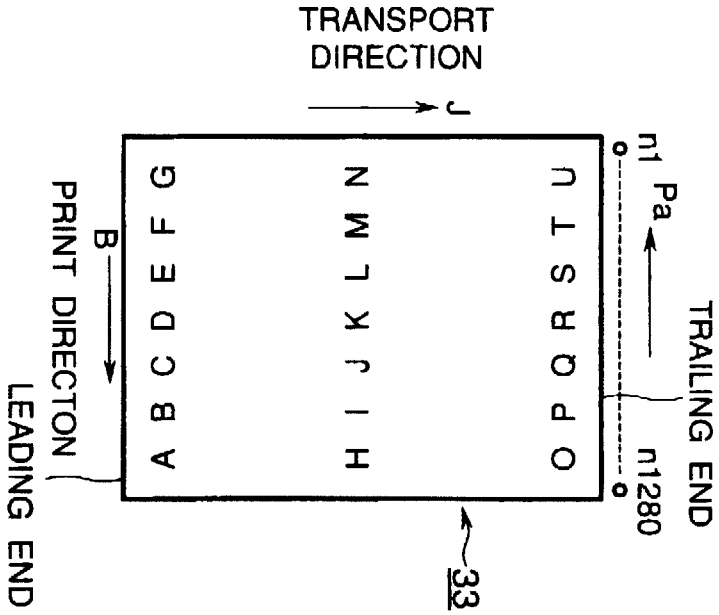
FIG. 15 shows the medium at a sixth position in the first embodiment.

FIG. 13 shows the medium 33 when it is at a fourth position in the first embodiment and FIG. 14 when it is at a fifth position. FIG. 15 shows the medium 33 when it is at a sixth position.

When printing on the front side of the medium 33 fed by the paper feeding mechanism 62 (FIG. 1), the image data DA in serial form is transmitted in the direction of arrow Pa to the LED head 22 (FIG. 4) and print is effected while transporting the medium 33 in the direction of arrow J. The LEDs 22*d* of the LED head 22 are aligned in the order of LEDn1, LEDn2, . . . . LEDn1280 from the left end in FIG. 13 (the number of the LED 22*d* is assumed to be 1280).

After print on the front side of the medium 33, the medium 33 is advanced by the transportation rollers 77 and 78 and the guide path 83 in the direction of arrow N to the transportation rollers 75 and 76. At this time, the medium 33 is positioned face down so that the characters printed on the front side of the medium 33 now appears on the underside of the medium 33 as denoted by dotted lines in FIG. 14.

Then, the image data DA is transmitted in the direction of arrow Pa to the LED head 22 while the medium 33 is delivered in the direction of arrow J to print on the back side of the medium 33. It is to be noted that the print on the back side of the medium 33 is effected beginning from the final image data DA stored in the page memory 122. It is also to be noted that the bit translator 120 translates the bit structure of the image data D0 so that higher bits are substituted by lower bits just as in the color print on both sides of the medium performed by the color ink jet printing mechanism 50.

The bit translator 120 translates the image data D0, received via the interface 101, into the image data DS which in turn is outputted to the data bus DB upon a command issued from the controller 100 to the selector 121. Then, the controller 100 causes the address counter 123 to count up to store the image data DA into the page memory 122 beginning from the smallest address. Upon storing the image data DA of one page, the controller 100 causes the address counter to count down to read the image data DA line by line i.e., 1280 dots (160 bytes) in order beginning from the final address of the page memory 122. Then, an electrostatic latent image is formed on the surface of the photosensitive body 25 and the toner 32 is deposited from the developing roller 28 onto the surface of the photosensitive body 25 so that the electrostatic latent image is developed into a toner image.

When the medium 33 arrives at a position between the photosensitive body 25 and the transfer roller 23, the controller 100 issues a command to the transfer power supply 114 in order to apply a high voltage to the transfer roller 23. Thus, the toner image on the surface of the photosensitive body 25 is electrically transferred to the back side of the medium 33. The transferred toner image is fixed in the fixing device 38. After fixing the toner image, the medium 33 is guided by the second feed-direction-switching means 47 and the guides 41 and 48 in the direction of K1 and is then discharged by the discharge rollers 43 and 44 through the copy exit to the exit stacker.

Upon discharging the medium 33, the controller 100 causes the motors 106 and 106 to stop. This completes printing operation.

The printing operation of the combination of color and monochromatic prints on both sides of the medium will now be described which is performed by the color ink jet printing mechanism 50 and LED printing mechanism 20.

The medium 33 is fed by the paper feeding mechanism 62 to a position immediately below the ink jet recording head 54 of the color ink jet printing mechanism 50. The mechanism 50 performs printing operation on the front side of the medium 33 while the medium 33 is subjected to line-feed operation in the direction of arrow L and is transported in the direction of arrow M through the guide path 83. Upon completion of print, the medium 33 is transported in the direction of arrow N till the leading end of the medium 33 arrives at the transportation rollers 75 and 76. Then, the medium 33 is transported in the direction of arrow J for printing operation performed by the LED printing mechanism 20.

The medium 33 is transported by the transportation rollers 77 and 78, being guided by the second feed-direction-switching means 47 and the guides 42 and 48 in the direction of N and again returned to the color ink jet printing mechanism 50 through the guide path 83. The mechanism 50 performs printing operation on the back side of the medium 33 while the medium 33 is subjected to line-feed operation in the direction of arrow P and the leading end of the medium 33 projects outwardly of the apparatus through the supply/take-up slot 86*a*.

After that, the medium 33 is delivered in the direction of arrow J of printing operation on the back side of the medium performed by the LED printing mechanism 20. The medium 33 is transported in the direction of arrow N till the leading end of the medium 33 arrives at the transportation rollers 75 and 76. Then, the medium 33 is transported in the direction of arrow J for printing operation performed by the LED printing mechanism 20. The medium 33 is then guided by the second feed-direction-switching means 47 and guides 41 and 48 in the direction of K, and is discharged by the supply/discharge rollers 43 and 44 to the copy exist 46. This completes the combination of color and monochromatic prints on both sides of the medium 33.

If the combination of color and monochromatic prints is consecutively performed on an odd number of sheets of the medium 33, the final sheet of the medium 33 is printed only on one side thereof. The number of the media 33 can be specified via the host computer, not shown. The present embodiment provides high quality monochromatic image print performed by the line type LED printing mechanism 20 and low cost color image print performed by the serial type color ink jet printing mechanism 50.

The apparatus of the embodiment can print on both sides of the medium 33, saving running cost.

The first feed-direction-switching means 80 is placed at the solid line position as shown in FIG. 1 while the color ink jet printing mechanism is performing printing operation, allowing the medium 33 to be guided substantially straight through the guide path 83. Thus, the medium need not be halted while the color ink jet printing mechanism 50 is performing printing operation, ensuring stable transportation of thick medium such as OHP sheet, envelopes, and post cards.

When only the color ink jet printing mechanism 50 performs printing operation, the medium 33 does not pass through the LED printing mechanism 20 after completion of print. This prolongs the life of the LED printing mechanism 20. The color ink jet printing mechanism 50 is located upstream of the transportation direction of the medium 33 and the LED printing mechanism 20 downstream thereof. This arrangement allows fixing of the toner image on the medium after the color print and the transfer of monochromatic image have been carried out. Therefore, expansion and contraction of the medium 33 due to heat does not cause poor registration of the image.

If a part of a document is to be highlighted by the use of a color image, only a very limited number of lines of character is printed by the color ink jet printing mechanism 50. Thus, line-feed operation can be performed at a high speed to the line immediately before the line on which color print is to be made, then color print is made. Then, the medium 33 can be transported backwards at high speed after the color print, and is then advanced to the LED printing mechanism 20 for high speed monochromatic image print.

While the first embodiment has been described with respect to automatic feeding of the medium, the medium 33 can also be manually fed through the supply/take-up slot 86*a*.

Although the line type recording means takes the form of the LED printing mechanism 20, laser type electrophotography printers and line type thermal transfer printers may also be used. Although the color ink jet printing mechanism 50 is used as a serial type recording means, serial type color thermal transfer printing mechanism and color dot matrix printing mechanism may also be used.

In this embodiment, the color ink jet printing mechanism 50 is disposed upstream of the LED printing mechanism 20 in the path through which the medium 33 is transported, the LED printing mechanism 20 may be disposed upstream of the color ink jet printing mechanism 50.

Second Embodiment

A second embodiment of the invention will now be described in detail.

Figure 16:
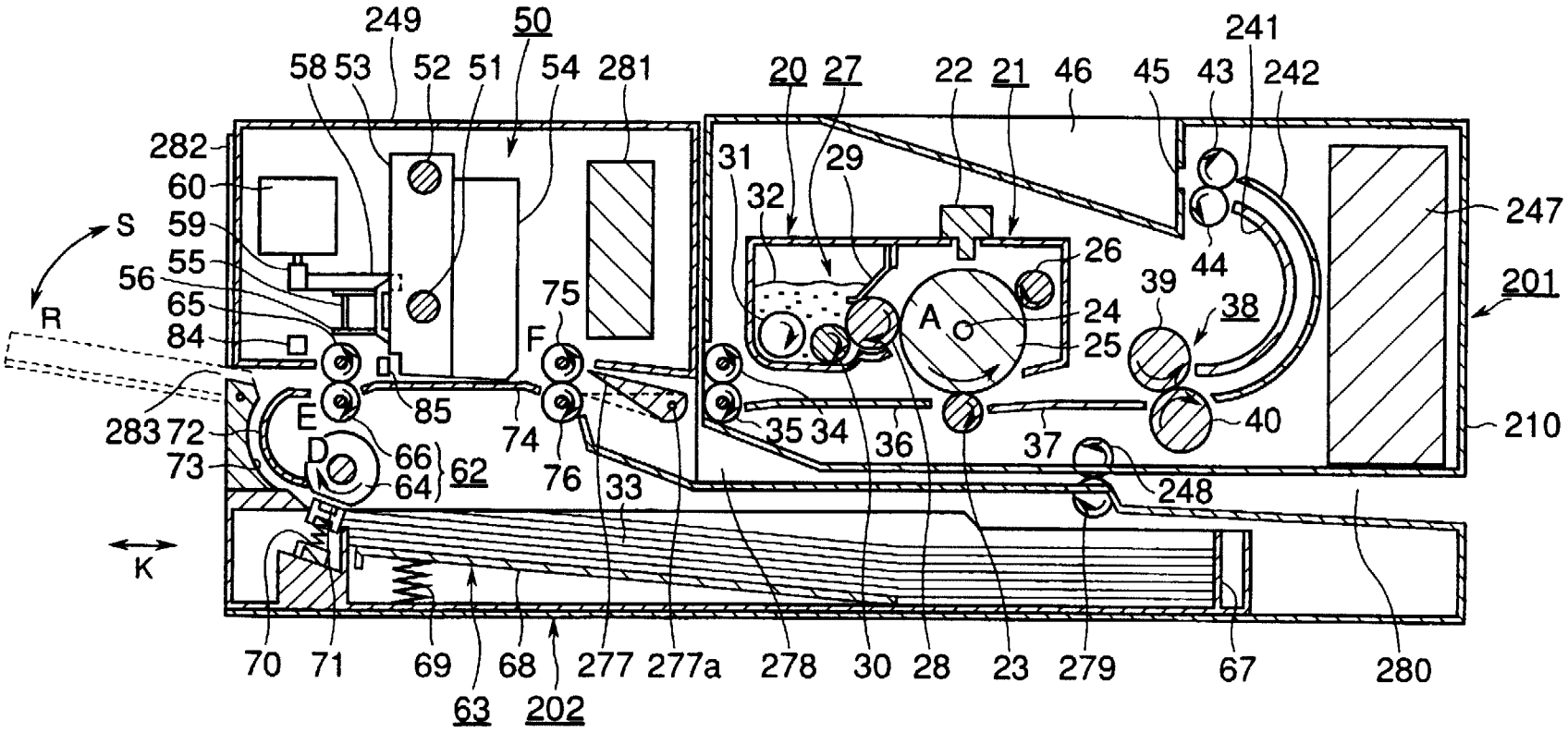
FIG. 16 is a cross-sectional view of a recording apparatus according to a second embodiment.
Figure 17:
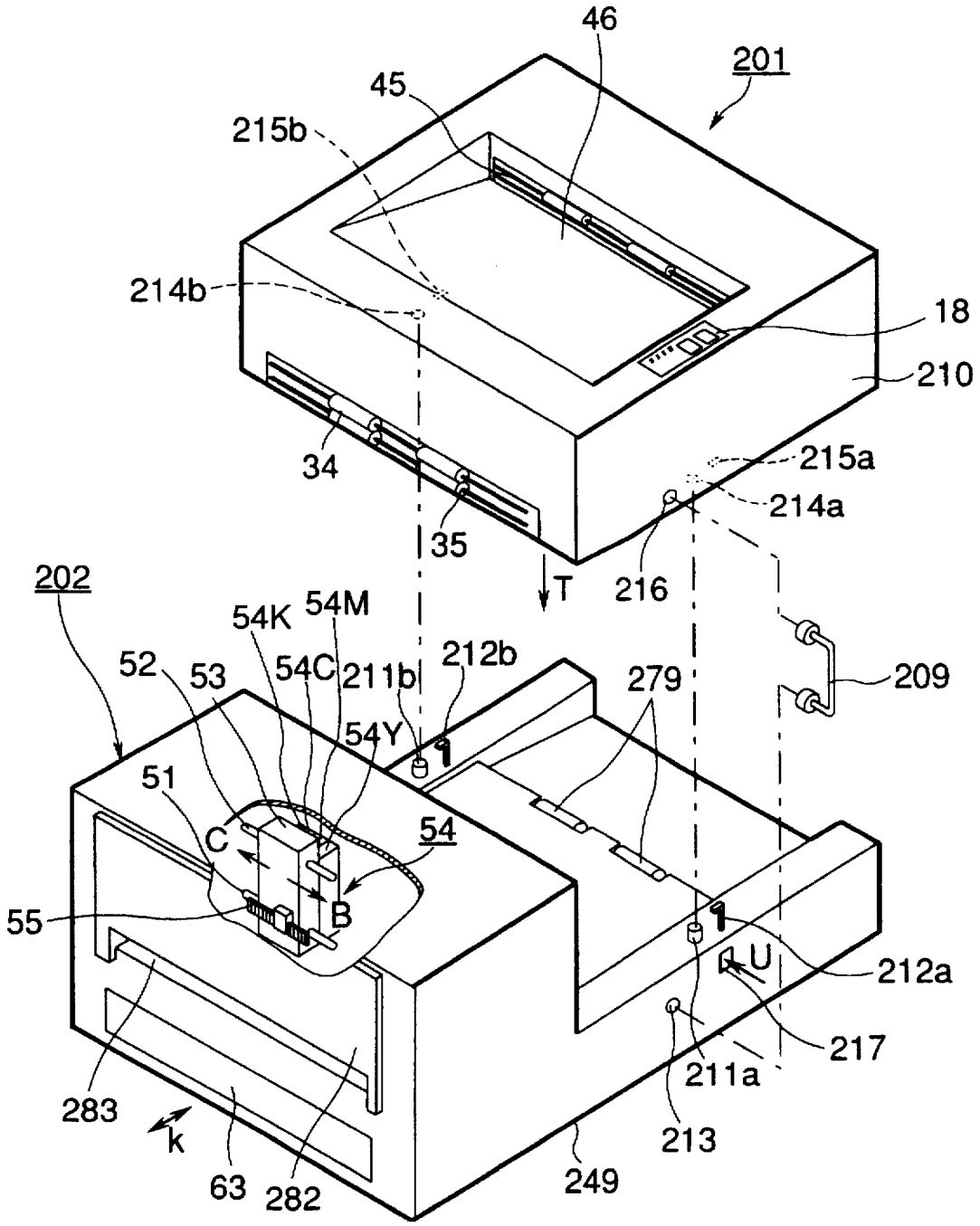
FIG. 17 is a perspective view of the recording apparatus of the second embodiment.

FIG. 16 is a cross-sectional view of a recording apparatus according to a second embodiment of the invention, FIG. 17 is a perspective view of the recording apparatus of the second embodiment.

In the figures, a line recording unit 201 operates as a first unit which has a line type LED printing mechanism 20 as a first recording means. A serial recording unit 202 operates as a second unit which has a paper-feeding mechanism 62 and a serial type color ink jet printing mechanism 50 as a second recording means. The line recording unit 201 and serial recording unit 202 are adapted to be separated.

As shown in FIG. 17, the serial recording unit 202 has guide pins 211*a* and 211*b* and hooks 212*a* and 212*b* rotatably supported thereon. The case 210 of the line recording unit 201 has in the underside thereof guide holes 214*a* and 214*b* that engage the guide pins 211*a* and 211*b*, and engagement holes 215*a* and 215*b* that engage the hooks 212*a* and 212*b*.

The hooks 212*a* and 212*b* are held in the engagement positions by means of, for example, spring, not shown so that when the line recording unit 201 is moved in the direction of arrow T to place the unit 201 onto the serial recording unit 202, the guide holes 214*a* and 214*b* are guided by the guide pins 211*a* and 211*b* an the hooks 212*a* and 212*b* are engaged with the engagement holes 215*a* and 215*b*. This completes mounting of the line recording unit 201 to the serial recording unit 202.

A connector cable 209 has one end thereof adapted to be inserted into a connector insertion hole 216 formed in the side of the line recording unit 20, and the other end thereof adapted to be inserted into a connector insertion hole 213 formed in the side of the serial recording unit 202. Thus, the line recording unit 201 is connected to later described power supplies and control circuits in the serial recording unit 202.

When dismounting the serial recording unit 202 from the line recording unit 201, the connector cable 209 is disconnected from the units 201 and 202, a button 217 disposed on a side of the serial recording unit 202 is depressed in the direction of arrow U to cause hooks 212*a* and 212*b* to move out of engagement with the engagement holes 215*a* and 215*b*, respectively. Then, lifting the line recording unit 201 in the direction opposite to the arrow T permits dismounting of the line recording unit 201 from the serial recording unit 202.

The line recording unit 201 is provided with an operating section 18 which includes a paper feed key, on-line/off-line selection key, and alarm lamps for indicating, for example, run out of paper.

The LED printing mechanism of the line recording unit 201 will now be described.

Referring to FIG. 16, the line type LED printing mechanism 20 includes an image-forming section 21, LED head 22, and transfer roller 23. The image-forming section 21 includes a charging roller 26, developing section 27 and photosensitive body 25 which is rotated about a shaft 24 in the direction of arrow A. The developing section 27 includes a developing roller 28, developing blade 29, sponge roller 30, stirring shaft 31, and black toner 32 made of a single non-magnetic compound. The toner 32 is supplied by the stirring shaft 31 to the developing roller 28 via the sponge roller 30, and is formed into a thin layer on the surface of the developing roller 28 by the developing blade 29. Thus, the thin layer is therefore supplied between the photosensitive body 25 and the developing roller 28.

The LED head 22 illuminates the photosensitive body 25 to form an electrostatic latent image on the surface of the photosensitive body 25. The toner 32 on the surface of the developing roller 28 is deposited on the electrostatic latent image by electrostatic attraction to form a toner image. The toner image is then transferred to the medium 33 by electrostatic attraction of the transfer roller 23. On the left side of the LED printing mechanism 20 in FIG. 16 are disposed pull-in rollers 34 and 35 that pull in the medium 33 discharged from the serial recording unit 202 into the line recording unit 201. Guides 36 and 37 guide the medium 33 to a fixing device 38 of the LED printing mechanism 20 for fixing.

The fixing device 38 consists of a heat roller 39 and a pressure roller 40. The medium 33 having the toner image fixed thereon is then guided by the guides 241 and 242 to the discharge rollers 43 and 44 which discharges the medium 33 through a copy exit 45 to an exit stacker 46.

The line recording unit 201 has a power supply/control circuit board 247 and idle roller 248.

The color ink jet printing mechanism 50 in the serial recording unit 202 will now be described.

In FIG. 16, a case 249 houses the serial recording unit 202 and the color ink jet printing mechanism 50 disposed over the serial recording unit 202.

The color ink jet printing mechanism 50 includes a carriage 53 that runs along the guide shafts 51 and 52 in the direction of arrows B and C, ink jet recording head 54, belt 55, a pair of pulleys 56 (only one pulley is shown in FIG. 16), drive gear 58, motor gear 59 and spacing motor 60.

The spacing motor 60 drives the pulleys 56 in rotation which in turn causes the belt 55 to run. The belt 55 has one end fixed to the carriage 53 and therefore causes the carriage 53 to run together with the belt 55.

The ink jet recording head 54 is for color printing operation and has four recording heads 54Y, 54M, 54C, and 54K as shown in FIG. 17. Each of the recording heads has a plurality of nozzles (e.g., 64 nozzles) on the surface thereof opposing the medium 33, the nozzles being longitudinally aligned in line with predetermined intervals.

A paper-feeding mechanism 62 is disposed under the color ink jet printing mechanism 50. The paper-feeding mechanism includes a paper-accommodating cassette 63, hopping roller 64 having a D-cut portion and registering rollers 65 and 66. The paper-accommodating cassette 63 is detachably inserted in the direction of arrow K into and out of the case 249, and includes medium cassette 67, lift plate 68, pressing spring 69, separating means 70, and spring 71. When the hopping roller 64 is rotated slightly less than one complete rotation in the direction of arrow D, the medium 33 is guided by the guides 72 and 73 to the pair of registering rollers 65 and 66.

When the hopping roller 64 rotates in the direction of arrow D while pressing the medium 33, the separating means 70 feeds the medium 33 one sheet at a time. The rotation of the registering rollers 65 and 66 in the direction of arrow E guides the medium 33 along the platen surface 74 to a pair of transportation rollers 75 and 76.

A feed-direction-switching means 277 selectively guides the medium 33 passing between the transportation rollers 75 and 76 either to the pull-in rollers 34 and 35 or to the guide path 278. As is apparent from FIG. 16, the feed-direction-switching means 277 is driven by a magnet plunger, not shown, to pivot about a shaft 277*a* either to a solid line position or to the dotted line position. The medium 33 advances through the guide path 278 to a space between the idle roller 248 and the transportation roller 279 when the feed-direction-switching means 277 is shifted to the solid line position, and to the rollers 34 and 35 when the feed-direction-switching means 277 is shifted to the dotted line position.

Reference numeral 280 denotes a second exit stacker to which the medium 33 is discharged after printing operation by the color ink jet printing mechanism 50. Reference numeral 281 denotes a power supply/control circuit board on the side of serial recording unit 202 and reference 282 a manual-feed guide.

Rotating the manual-feed guide 282 in the direction of arrow R to the dotted line position in FIG. 16 permits the operator to manually feed the medium 33 one sheet at a time.

Photo interrupters 84 and 85 detect the medium 33.

Figure 18:
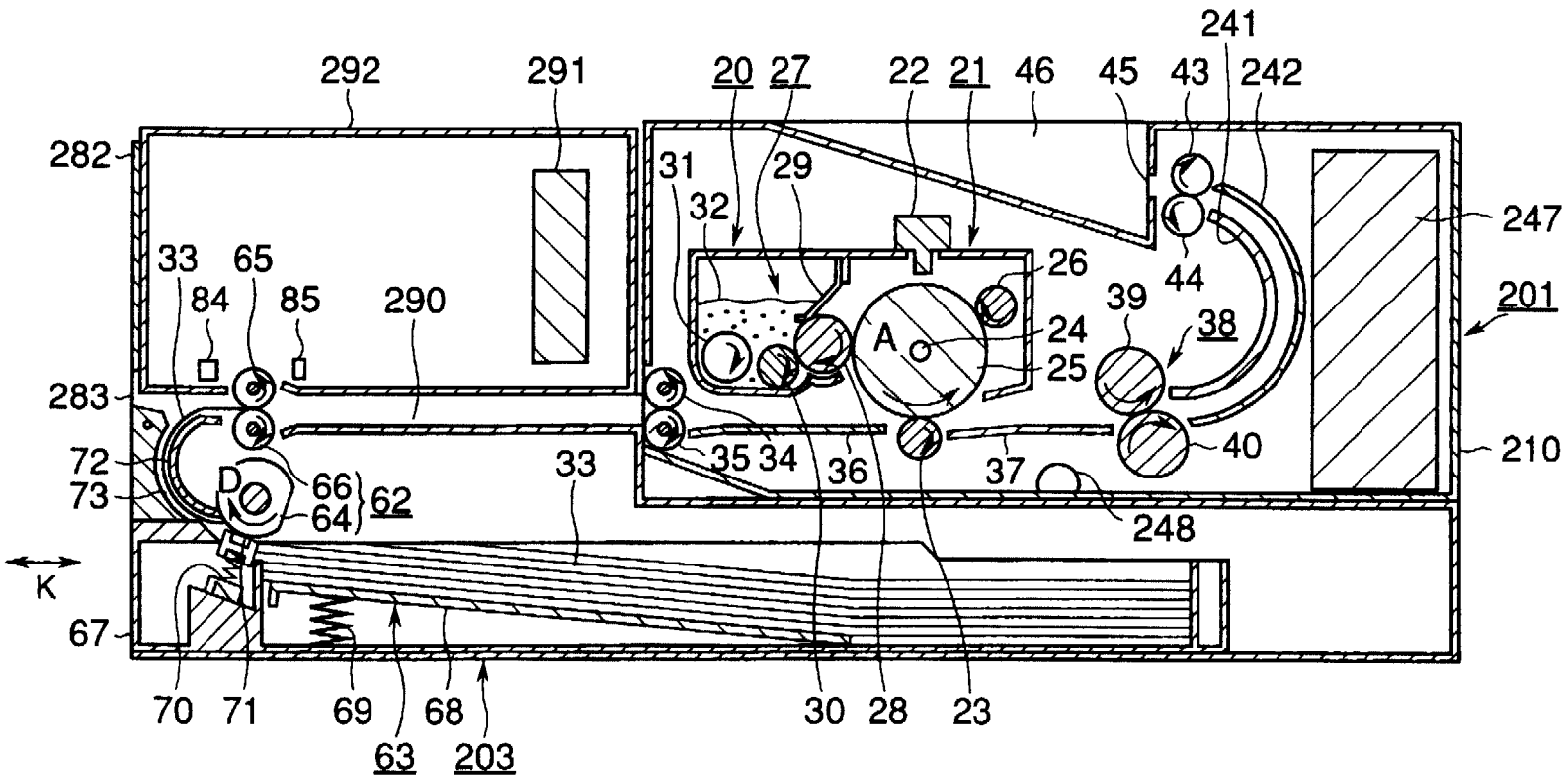
FIG. 18 is a cross-sectional view of a modified recording apparatus of the second embodiment.

FIG. 18 is a cross-sectional view of a modified recording apparatus of the second embodiment. Structural elements similar to those in FIGS. 16 and 17 have been given similar reference numerals and omitted the description thereof. Referring to FIG. 18, a paper feeding mechanism 62 is disposed under the paper-feeding unit 203, and includes a paper-accommodating cassette 63, hopping roller 64, and registering rollers 65 and 66. In this modification, the paper-feeding unit 203 is of a construction similar to the serial recording unit 202 in FIG. 16 but has not the color ink jet printing mechanism 50.

The medium 33 fed from the paper-accommodating cassette 63 by the hopping roller 64 and registering rollers 65 and 66 is transported always to the line recording unit 201 via the guide 290.

The paper feeding unit 203 has a control circuit board 291 disposed therein. Within the case 292 of the paperfeeding unit 203 are disposed guide pins 211*a* and 211*b* and the hooks 212*a* and 212*b* supported therein as shown in FIG. 17. The guide pins 211*a* and 211*b* and the hooks 212*a* and 212*b* are adapted to engage guide holes 214*a* and 214*b* and engagement holes 215*a* and 215*b*, respectively, formed in the underside of the case 210 of the recording unit 201.

Likewise, the paper feeding unit 203 and the line recording unit 201 are formed with a connector insertion hole 213 and a connector insertion holes 216, respectively, in side walls thereof into which the connector cable 209 is inserted. As previously described, the construction in FIG. 18 allows high speed monochromatic image print by the LED printing mechanism 20 while the construction in FIG. 16 permits color image print by the color ink jet printing mechanism 50 and the LED printing mechanism 20. In other words, the operator can select either the serial recording unit 202 or the paper feeding unit 203 depending on the desire.

Figure 19:
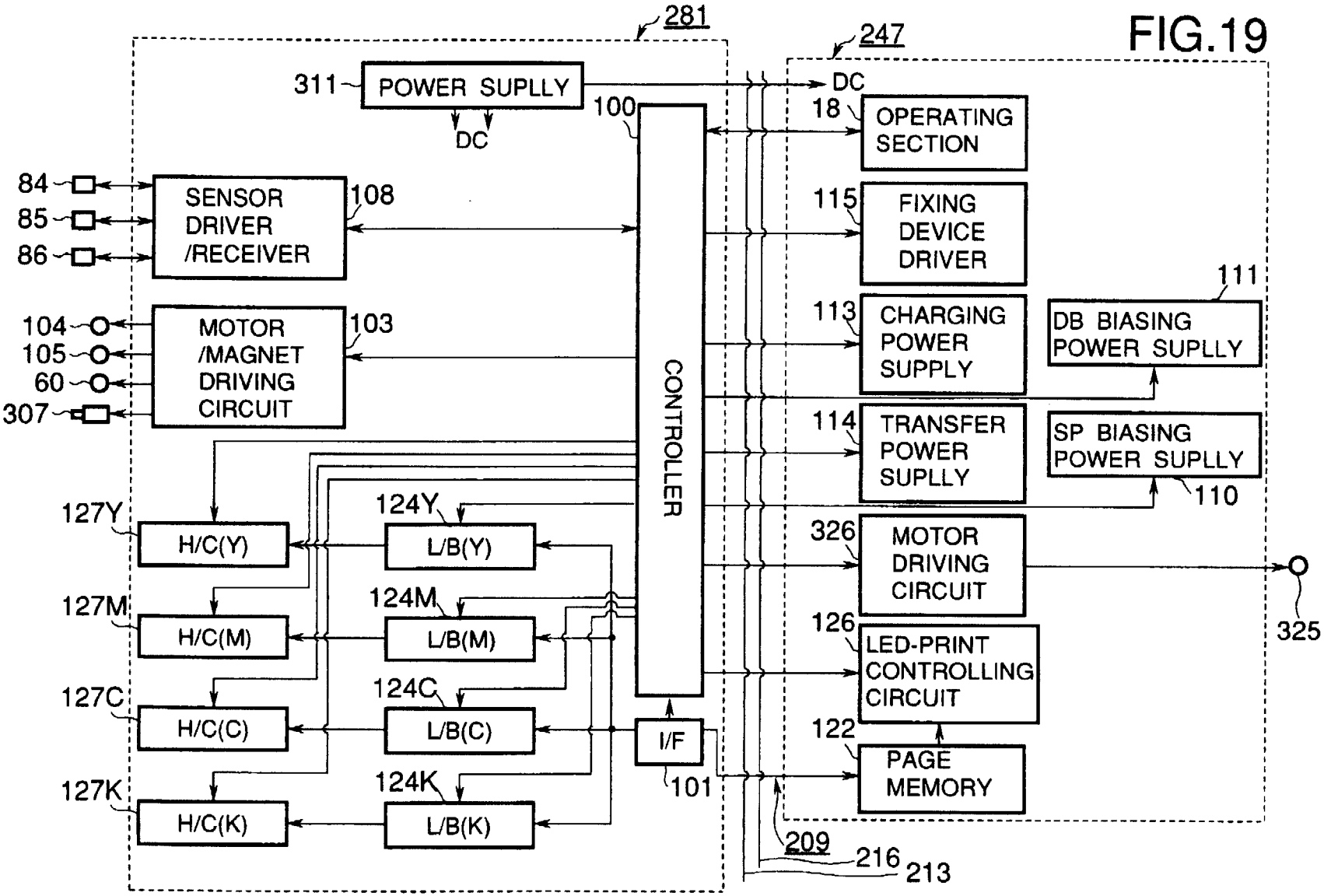
FIG. 19 is a block diagram showing a control section of the second embodiment.

FIG. 19 is a block diagram showing a control section of the second embodiment. Referring to FIG. 19, the control section includes the power supply/control circuit board 247 disposed in the line recording unit 202 and the power supply/control circuit board 281. These two boards 247 and 281 are connected to each other by means of the connector cable 209 inserted into the connector insertion holes 213 and 216.

The power supply circuit board 281 will now be described.

Referring to FIG. 19, a controller 100 takes the form of, for example, a microprocessor and controls the entire operation of the recording apparatus. The controller 100 is connected to recording head controlling circuits 127Y, 127M, 127C, and 127K which correspond to recording heads 54Y, 54M, 54C, and 54K (FIG. 17), respectively.

The recording head controlling circuits 127Y, 127M, 127C, 127K receive image data DA from line buffers 124Y, 124M, 124C, 124K and drive the respective heads 54Y–54K upon a command from the controller 100 to cause the corresponding nozzles to discharge ink. The line buffers 124Y, 124M, 124C and 124K hold the image data D0 as the image data DA of one line, the image data being transmitted from the host computer via an interface 101.

The interface 101 separates the image data D0 according to color and store yellow, magenta, cyan, and black image data DA into the line buffers 124Y, 124M, 124C, and 124K, respectively.

In accordance with commands from the controller 100, the motor/magnet driving circuit 103 drives the spacing motor 60 that drives the carriage 53 to run in the directions of arrows B and C, a motor 104 that drives the hopping roller 64 in rotation in the direction of arrow D, a motor 105 that drives the registering rollers 65 and 66 and transportation rollers 75 and 76 in the directions of arrows E and F or in the opposite directions, a plunger magnet 307 that causes the feed-direction-switching means 277 to pivot.

A sensor driver/receiver 108 drives the a photo interrupter 86 for detecting the home position of the carriage 53 and photo interrupters 84 and 85 as well as receives signals from the photo interrupters 84–86 and sends the signals to the controller 100. A power supply 311 provides d-c voltages to all the circuits.

The power supply/control circuit board 247 of the line recording unit 201 will now be described.

The power supply/control circuit board 247 includes a SP biasing power supply 110, DB biasing power supply 111, charger power supply 113, transfer power supply 114, and fixing device driver 115. The power supply/control circuit board 247 includes a motor driving circuit 326 which causes a motor 325 to drive the pull-in rollers 34 and 35, photosensitive body 25, charging roller 26, developing roller 28, sponge roller 30, transfer roller 23, heat roller 39, and discharge rollers 43 and 44 in the directions shown in FIG. 16.

The power supply/control circuit board 247 includes a page memory 122 that stores the black image data DA transmitted from the interface 101, an LED-print controlling circuit 126 that controls exposure time of LED, no shown, to form an electrostatic latent image on the surface of the photosensitive body 25, and an operating section 18.

The power supply/control circuit board 247 is connected with the controller 100 via the connector cable 209 to receive a d-c voltage from the power supply 311.

Figure 20:
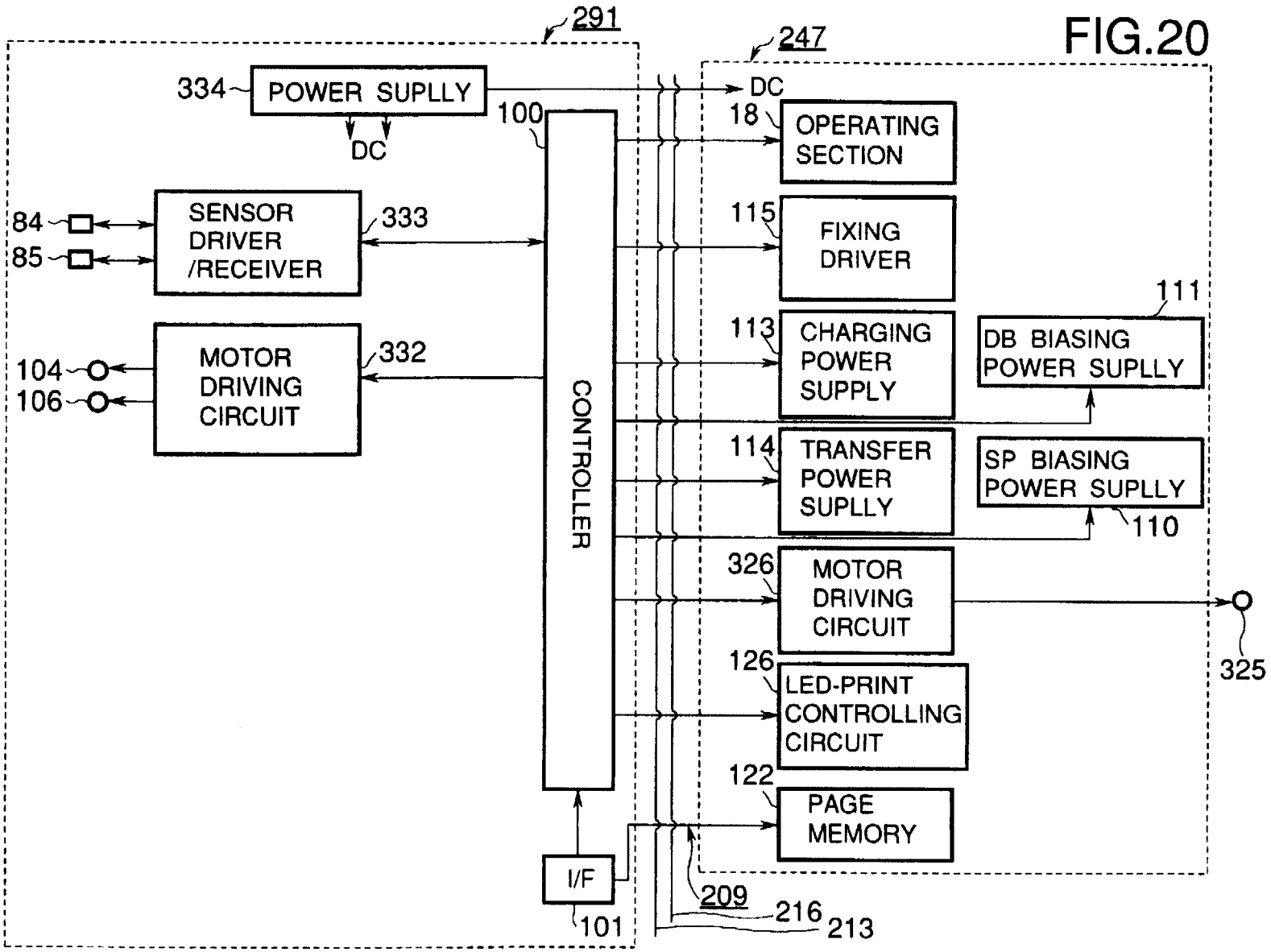
FIG. 20 is a block diagram showing a modification of the control section of the second embodiment.

FIG. 20 is a block diagram showing a modification of the control section of the second embodiment. Structural elements similar to those in FIG. 16 have been given the same reference numerals and omitted the description thereof.

The control section includes the power supply/control circuit boards 247 and 291 which are connected with each other by means of the connector cable 209 inserted into connector insertion holes 213 and 216 just as in FIG. 19.

The power supply/control circuit board 291 is disposed in the paper feeding unit 203 (FIG. 18.) The controller 100 takes the form of, for example, a microprocessor and controls the entire the recording apparatus. An interface 101 stores the image data D0 transmitted from the host computer, not shown, into the page memory 122 via the connector cable 209.

A motor driving circuit 332 of the power supply/control circuit board 291 drives a motor 104 that drives the hopping roller 64 in rotation, and a motor 105 that drives the registering rollers 65 and 66 in rotation. Sensor driver/receiver 333 drives the photo interrupters 84 and 85 and sends signals received form the photo interrupters 84 and 85 to the controller 100. The power supply 334 supplies d-c voltages to the power supply/control circuit board 247.

Monochromatic print performed by the LED printing mechanism 20 will now be described with reference to FIGS. 16, 17, and 19.

When the power supply 311 is turned on, the controller 100 carries out predetermined initialization, and then drives a fixing-device driver 115 to warm up the heat roller 39 of the fixing device 38 to a predetermined temperature. The initialization completes when the heat roller 39 has warmed up to the predetermined temperature.

Upon receiving the command and image data D0 via the interface 101, the controller 100 issues a command to the interface 101 and the page memory 122 so that the received image data D0 is stored as the image data DA into the page memory 122. The image data DA for one page of the medium 33 to be printed is stored into the page memory 122 in sequence beginning from the smallest address.

Then, the controller 100 causes the motor 104 to drive the hopping roller 64 in rotation in the direction of arrow D through slightly less than one rotation to feed one sheet of medium 33 accommodated in the medium cassette 67.

Upon detecting that the medium 33 is fed from the medium cassette 67, the controller 100 causes the motor 105 to drive the registering rollers 65 and 66 in rotation. The registering rollers 65 and 66 causes the medium 33 to advance along the platen surface 74 to the transportation rollers 75 and 76, and the medium 33 is then guided by the feed-direction-switching means 277 to the pull-in rollers 34 and 35.

The controller 100 causes via the motor driving circuit 326 the motor 325 to drive pull-in rollers 34 and 35, photosensitive body 25, charging roller 260 developing roller 28, sponge roller 30, transfer roller 23, stirring shaft 31, heat roller 39, and discharge rollers 43 and 44 in rotation in the direction of arrows in FIG. 16. Then, the controller 100 turns on the charging power supply 113, DB biasing power supply 111, and SP biasing power supply 110 in order to apply voltages to the charging roller 26, developing roller 28, an sponge roller 30.

The controller 100 issues a command to cause transmission of the image data DA for one line from the page memory 122 to the LED-print controlling circuit 126, which in turn transmits the image data received from the page memory 122 to the LED head 22.

The LED head 22 causes the LEDs, not shown, in accordance with the received image data DA to form an electrostatic latent image on the surface of the photosensitive body 25. The toner 32 on the developing roller 32 is deposited onto the electrostatic latent image to form a toner image on the photosensitive body 25.

When the leading end of the medium 33 reaches a space between, the controller 100 issues a command to the transfer power supply 114 which in turn applies a high voltage to the transfer roller 23 causing the toner image on the surface of the photosensitive body 25 to electrically transfer to the medium 33. Upon completion of transfer of the toner image, the controller 100 turns off the charging power supply 113, SP biasing power supply 110, DB biasing power supply 111, and transfer power supply 114.

The toner image on the medium 33 passes between the heat roller 39 an the pressure roller 40. The heat roller has been maintained to a proper temperature for fixing and the pressure roller 40 has been urged to the heat roller 39, so that the toner image on the medium 33 is fixed in the fixing device 38. After fixing, the medium 33 is guided by the guides 241 and 242 to the discharge rollers 43 and 44 which in turn drives the medium through the copy exit 45 to the exit stacker 46.

The color image printing operation performed by the color ink jet printing mechanism 50 will now be described. As is apparent from FIG. 16, even if the line recording unit 201 has been dismounted, the serial recording unit 202 alone can carry out color printing operation. Color image printing operation performed by the serial recording unit 202 alone will be described with reference to FIGS. 16, 17, and 19.

When the power supply 311 is turned on, the controller 100 carries out predetermined initialization in order to position the feed-direction-switching means 277 to the solid line position. Then, the controller 100 waits for a command and the image data D0 which are to be transmitted from the host computer, not shown, via the interface 101.

Upon receiving the command and the image data D0, the interface 101 decodes and sends them to the controller 100. The controller 100 causes the spacing motor 60 to drive the carriage 53 to run, and receives a signal from the photo interrupter 86 via the sensor/driver receiver 108. This signal received from the photo interrupter 86 indicates the home position of the carriage 53.

Then, the controller 100 causes the motor 104 to drive the hopping roller 64 to rotate through slightly less than one complete rotation in the direction of arrow, which rotation feeds one sheet of the medium 33 accommodated in the medium cassette 67 to the guides 72 and 73. Detecting the feed of the medium from the medium cassette 67, the controller 100 causes the motor 105 to rotate the registering rollers 65 and 66, so that the medium 33 is transported to a position immediately below the nozzles, not shown, of the ink jet recording head 54.

Upon receiving the image data D0 of one line transmitted from the host computer via the interface 101, the controller 100 outputs commands to the line buffers 124Y, 124M, 124C, and 124K. In accordance with the command, the interface 101 separates the received image data D0 according to color, and stores the separated image data D0 as the image data DA of one line into the corresponding line buffers 124Y, 124M, 124C, and 124K.

When the image data DA have been stored in the corresponding line buffers, the controller 100 drives the spacing motor 60 in rotation so that the carriage 53 runs in the direction of arrow B, thus the carriage 53 performing spacing operation for printing. Upon completion of printing of one line, the controller 100 causes the motor 105 to drive the registering rollers 65 and 66 and transportation rollers 75 and 76 in the directions of E and F, respectively, to transport the medium 33, thus performing line-feed operation.

The controller 100 also causes the spacing motor 60 to rotate in the reverse direction in order to drive the carriage 53 to the home position in the direction of arrow C, thereby performing return-to-home operation.

While the reception of the image data D0, printing operation, line-feed and return-to-home operations are repeatedly carried out, the medium 33 is transported by the transportation rollers 75 and 76 and is then guided by the feed-direction-switching means 277 through the guide path 278 to a second exit stacker 280.

The combined image printing operation performed by the color ink jet -printing mechanism 50 and the LED printing mechanism 20 will be described.

The ink jet recording head 54 performs color image printing operation of one page in accordance with yellow, magenta, and cyan image data DA while the medium 33 being transported. Thereafter, the rotations of the registering rollers 65 and 66 and transportation rollers 75–76 and 279 are reversed to transport the medium 33 till the leading end of the medium 33 reaches a space between the transportation rollers 75 and 76.

Then, the feed-direction switching means 277 is shifted to the dotted line in FIG. 16 and the motor 105 is caused to drive the registering rollers 65 and 66, and the transportation rollers 75 and 76 to rotate in the forward directions, so that the medium 33 is guided by the feed-direction-switching means 277 for printing operation performed by the LED printing mechanism 20.

When the power supply 311 is turned on, the controller 100 carries out predetermined initialization, and then drives a fixing device driver 115 to warm up the heat roller 39 of the fixing device 38 to a predetermined temperature. The initialization completes when the heat roller 39 has warmed up to the predetermined temperature, and the control circuit waits for the image data D0 transmitted from the host computer via the interface 101.

Prior to transmission of the image data D0, the host computer transmits a command indicating that the combination of color print and monochromatic print is to be performed by the color ink jet printing mechanism 50 and LED printing mechanism 20. The interface 101 receives and decodes the command and the image data D0, and sends them to the controller 100 which in turn causes the plunger magnet 307 to shift the feed-direction-switching means 277 to the solid line position in FIG. 16.

The controller 100 causes the spacing motor 60 to drive the carriage 53 to run, and also receives a signal from the photo interrupter 86 via the sensor driver/receiver 108. The signal from the photo interrupter 86 indicates the home position of the carriage 53.

The controller 100 causes the motor 104 to drive the hopping roller 64 in the direction of arrow D through slightly more than one complete rotation so as to feed one sheet of medium 33 from the medium cassette 67 to the guides 72 and 73.

Being informed of the feed of the medium from the medium cassette 67, the controller 100 causes the motor 105 to rotate the registering rollers 65 and 66, so that the medium 33 is transported to a position immediately below the nozzles, not shown, of the ink jet recording head 54. Upon receiving the image data D0 of one line from the host computer via the interface 101, the controller 100 outputs commands to the interface 101, line buffers 124Y, 124M, 124C, and 124K, and page memory 122.

In accordance with the command, the interface 101 separates the received image data D0 according to color, and stores the separated image data D0 as yellow, magenta, cyan, and black image data DA of one line into the corresponding line buffers 124Y, 124M, 124C, and page memory 122, respectively. It is to be noted that the black image data DA is not stored into the line buffer 124K and therefore print is not performed by the recording head 54K.

Upon storing the image data DA into the corresponding line buffers 124Y, 124M, and 124C, the controller 100 causes the spacing motor 60 to drive the carriage 53 in the direction of arrow B, thus the carriage 53 performing spacing operation for printing. Upon completion of print of one line, the controller 100 cause the motor 105 to drive the registering rollers 65 and 66 and transportation rollers 75 and 76 in rotation in the directions of E and F, respectively, to transport the medium 33, thus performing line-feed operation.

The controller 100 also causes the spacing motor 60 to rotate in the reverse direction in order to drive the carriage 53 to run in the direction of arrow C to the home position, thereby performing return-to-home operation.

While performing line-feed operation, return-to-home operation, the controller 100 receives the image data D0 for the next line, and again performs printing operation, line-feed operation and return-to-home operation upon receiving the image data D0 for the next line.

While the reception of the image data D0, printing operation, line-feed and return-to-home operations are repeatedly carried out, the medium 33 is transported by the transportation rollers 75 and 76, guided by the feed-direction-switching means 277 through the guide path 278, and further advanced by the transportation roller 279 and idle roller 248 to project into the second exit stacker 280.

While color printing operation is being carried out, the black image data DA is stored line by line into the page memory 122.

When the color ink jet printing mechanism 50 completes the print of the final line, the controller 100 causes the motor 105 to rotate in the reverse direction so that the registering rollers 65 and 66 and transportation rollers 75, 76, and 279 are rotated in the reverse directions. The reverse rotations of the rollers 65–66, 75–76, and 279 transport the medium in the reverse direction so that the the trailing end of the medium 33 projects outwardly of a medium-feeding slot 283. When the leading end of the medium 33 arrives at the transportation rollers 75 and 76, the controller 100 causes the motor 105 to stop and drives the plunger magnet 307 to shift the feed-direction-switching means 277 to the dotted line position as shown in FIG. 16.

Then, the controller 100 causes the motor 105 to rotate in the forward direction so that the registering rollers 65 and 66 and transportation rollers 75 and 76 are rotated in the directions of arrows E and F, respectively. The control circuit also causes the motor 106 to drive the pull-in rollers 34 and 35, photosensitive body 25, charging roller 26, developing roller 28, sponge roller 30, stirring shaft 31, transfer roller 23, heat roller 39, and discharge rollers 43 and 44 in the directions shown in FIG. 16.

Thus, the medium 33 is directed by the feed-direction-switching means 277 to the LED printing mechanism 20.

The controller 100 turns on the charging power supply 113, DB biasing power supply 111, and SP biasing power supply 106 in order to apply voltages to the charging roller 26, developing roller 28, and sponge roller 30, respectively.

The controller 100 outputs a command to the page memory 122, in response to which the memory 122 sends the black image data DA of one page stored therein to the LED-print controlling circuit 126. In response to a command outputted from the controller 100, the LED-print controlling circuit 126 transmits the image data DA received from the page memory 122 to the LED head 22, which in turn causes the LEDs, not shown, to form an electrostatic latent image on the surface of the photosensitive body 25 in accordance with the image data DA. Then, the toner 32 is deposited on the electrostatic latent image to form a toner image.

When the leading end of the medium 33 arrives at a space between the photosensitive body 25 and the transfer roller 23, the controller 100 outputs a command to the transfer power supply 114 to apply a high voltage to the transfer roller 23, thereby electrically transferring the tone image of the photosensitive body 25 onto the medium 33. Upon completion of the transfer of the toner image, the controller 100 turns off the charging power supply 113, SP biasing power supply 110, DB biasing power supply 111, and transfer power supply 114.

The medium 33 passes between the heat roller 39 and the pressure roller 40 so that the toner image is fixed on the medium 33. After fixing of the toner image, the medium 33 is guided by the guides 241 and 242 and is then discharged by the discharge rollers 43 and 44 through the copy exit 45 to the exit stacker 46. After the medium is discharged, the controller 100 causes motors 105 and 106 to stop, completing the printing operation.

It is to be noted that the medium 33 is intermittently advanced during the color print performed by the mechanism 50 but continuously advanced during the monochromatic print performed by the mechanism 20.

In the aforementioned manner, the color ink jet printing mechanism 50 and LED printing mechanism perform1 the combined mode of printing operation.

Thus, the users can purchase only the serial recording unit 202 and may buy the line recording unit 201 optionally at a later time and vice versa. This construction frees the users from purchasing a recording apparatus of one model for color print and a recording apparatus of other model for monochromatic print. This construction saves both cost and installation space. The serial recording unit 202 and line recording unit 201 share the paper-feeding mechanism 62, implementing a miniaturized recording apparatus.

Third Embodiment

A third embodiment will now be described.

Figure 21:
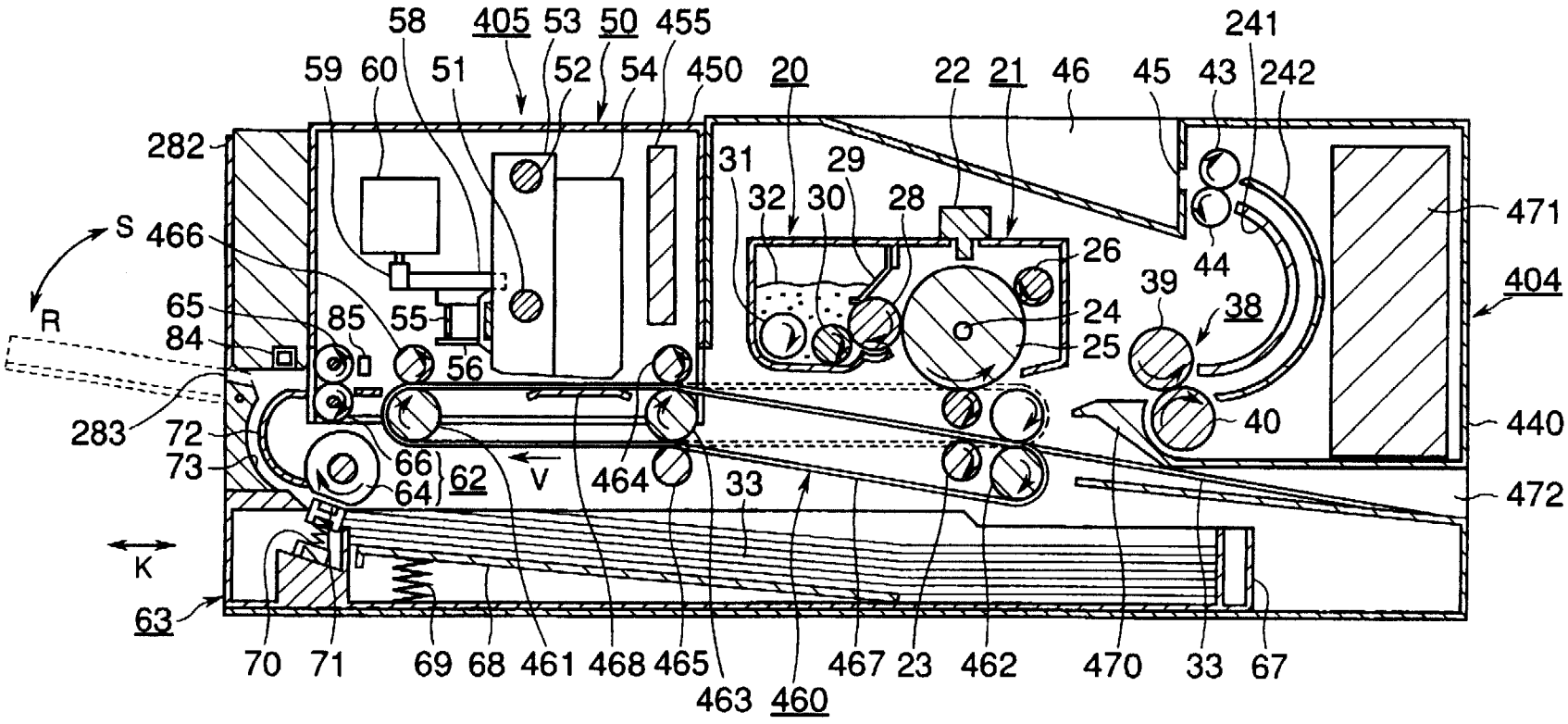
FIG. 21 is a cross-sectional view of a recording apparatus of a third embodiment.
Figure 22:
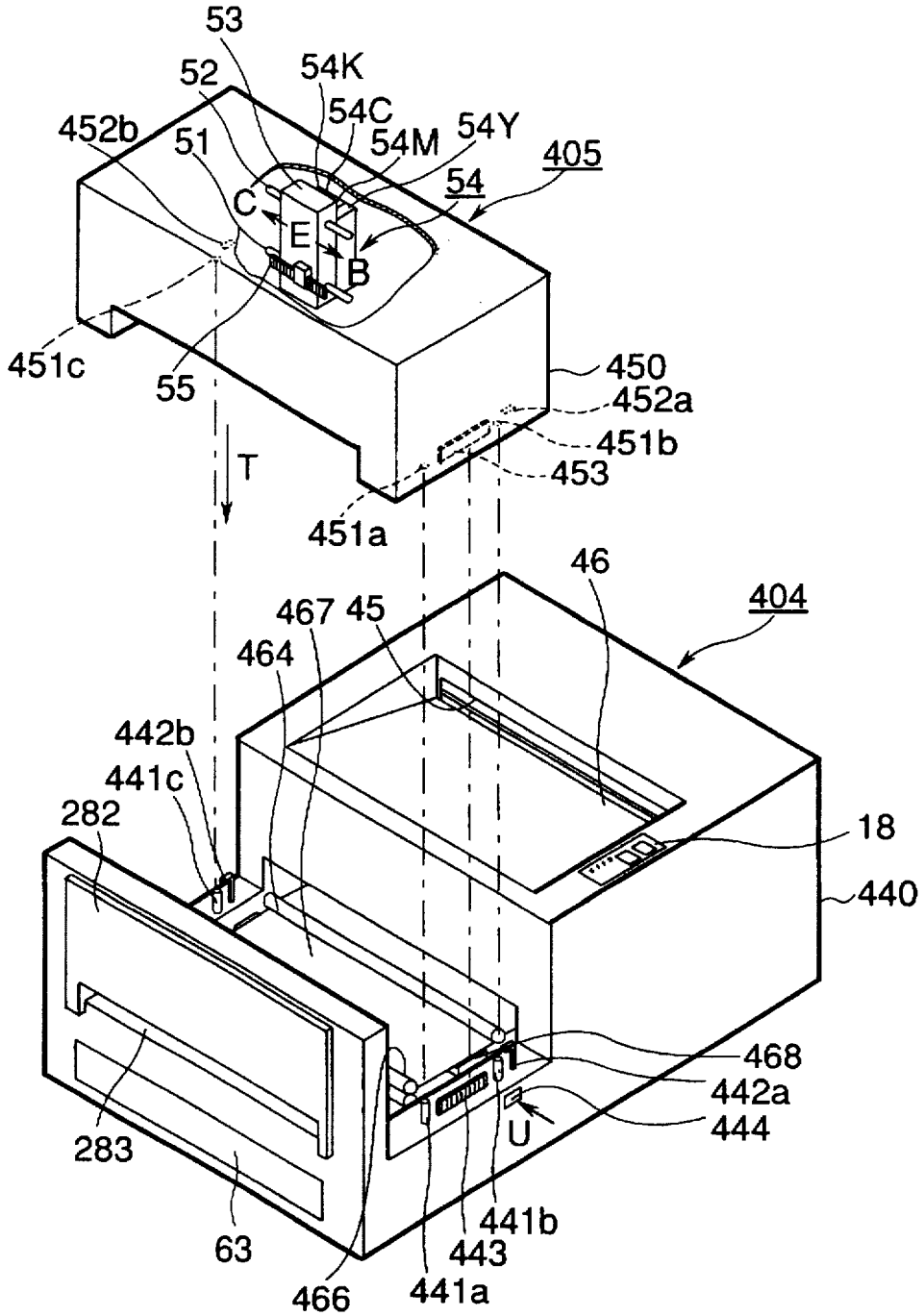
FIG. 22 is a perspective view of the recording apparatus of the third embodiment.

FIG. 21 is a cross-sectional view of a recording apparatus of the third embodiment, and FIG. 22 is a perspective view of the recording apparatus.

In the figures, a line recording unit 404 serves as a third unit which has an LED printing mechanism 20 as a first recording means and a paper-feeding mechanism 62, and a serial recording unit serves as a fourth unit which has a color ink jet printing mechanism 50 as a second recording means. As shown in FIG. 22, within the case 440 of the line recording unit 404 are disposed guide pins 441*a*–441*c*, hooks 442*a* and 442*b*, and male connector 443. On the bottom of a case 450 of the serial recording unit 405 are formed guide holes 451*a*–451*c* that engage the guide pins 441*a*–441*c*, engagement holes 452*a* and 452*b* that engage the hooks 442*a* and 442*b*, and a female connector 453 which fits to the male connector 443.

The hooks 442*a* and 442*b* are held in place by springs, not shown, so that when the serial recording unit 405 is lowered in the direction of arrow T onto the line recording unit 404, the guide holes 451*a*–451*c* are guided by the guide pins 441*a*–441*c* and the hooks 442*a* and 442*b* are automatically engaged with engagement holes 452*a* and 452*b*, and the female connector 453 fits over the male connector 443. In this manner, the serial recording unit 405 is mounted to the line recording unit 404.

In order to dismount the serial recording unit 405 from the line recording unit 404, the user pushes a button 444 disposed on the side of the line recording unit 404 in the direction of arrow U, and lifts the serial recording unit 405 in the direction opposite to the arrow T to remove the serial recording unit 405 from the line recording unit 404.

The LED printing mechanism 20 of the line recording unit 404 will be described.

The LED printing mechanism 20 includes an image-forming section 21, LED head 22, and transfer roller 23.

A belt conveyer mechanism 460 is disposed below the LED printing mechanism 20. The belt conveyer mechanism 460 includes a drive roller 461, driven roller 462, roller 463, guide rollers 464 and 465, attraction roller 466 as an attraction means, and guide plate 468 and conveying belt 467.

The conveying belt 467 is made of high resistance semi-conductive plastic sheet in a seamless fashion, and is mounted on the drive roller 461, driven roller 462, roller 463, and transfer roller 23. The belt conveyer mechanism 460 is switched by a plunger, not shown, between the solid line position and the dotted line position in FIG. 21.

The fixing device 38 is disposed on the right side of the LED printing mechanism 20. The fixing device 38 consists of a heat roller 39 and a pressure roller 40, and the toner image formed on the medium 33 by the LED printing mechanism 20 is fixed while the medium 33 passes between the heat roller 39 and pressure roller 40. After fixing, the medium 33 is guided by the guides 241 and 242 to discharge rollers 43 and 44, which in turn advances the medium 33 through the copy exit 45 to the exit stacker 46. The line recording unit 404 has a power supply/control circuit board 471.

A paper-feeding mechanism 62 is located below the line recording unit 404, and includes a paper-accommodating cassette 63, hopping roller 64, and registering rollers 65 and 66. The paper-accommodating cassette 63 is detachably inserted into the case 440 in the direction of arrow K.

Reference numeral 472 denotes a guide/copy exit through which the medium 33 is transported and discharged after printing operation performed by the serial recording unit 405. Reference numeral 202 denotes a manual feed guide which allows feeding of the medium 33 sheet by sheet through the medium feeding slot 283 when pivoted in the direction of arrow R to the dotted line position in FIG. 21. The manual feed guide 282 may also be pivoted in the direction of arrow S to the solid line position. References 84 and 85 denote photo interrupters for detecting the medium 33.

The serial recording unit 405 will now be described.

Within the serial recording unit 405 is disposed the color ink jet printing mechanism 50 which includes guide shafts 51 and-52, carriage 53 driven to run along the guide shafts 51 and 52, ink jet recording head 54, belt 55, a pair of pulleys 56, drive gear 58, motor gear 59, and spacing motor 60. Reference 450 denotes a case and 455 a control circuit board.

Figure 23:
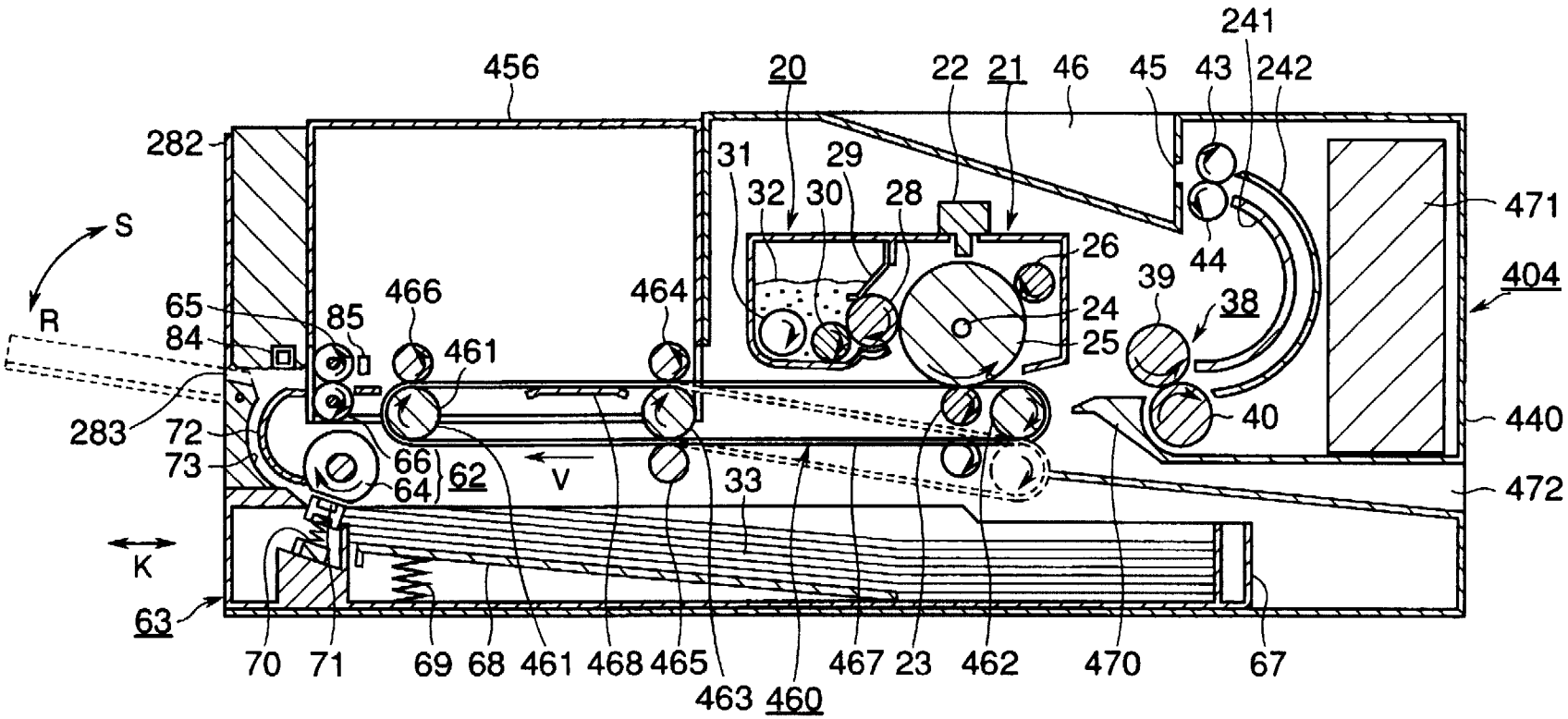
FIG. 23 is a cross-sectional view of a modified example of the recording apparatus according to the third embodiment.

As shown in FIG. 22, the ink jet recording head 54 includes four recording heads 54Y, 54M, 54C, and 54K aligned in the direction perpendicular to the direction in which the medium 33 is transported. FIG. 23 is a cross-sectional view of a modified example of a recording apparatus according to the third embodiment. Structural elements similar to those in FIGS. 21 and 22 have been given the same references and omitted the description thereof.

In this modification, the serial recording unit 405 shown in FIGS. 21 and 22 is replaced by a case 456. The case 456 has guide pins 441*a*–441*c*, guide holes 451*a*–451*c*, and engagement holes 452*a* and 452*b* as shown in FIG. 22. The modified apparatus in FIG. 23 is capable of printing only a monochromatic image by LED printing mechanism 20 while the apparatus in FIG. 21 is capable of performing combined mode of printing operation by the use of both the color ink jet printing mechanism 50 and LED printing mechanism 20. In other words, the third embodiment and the modification thereof allows the operator to select either the configuration in FIG. 21 or that in FIG. 23 depending on the purpose.

FIG. 24 is a block diagram showing a control section of the third embodiment. Referring to FIG. 24, the control section includes a power supply 471 located in the line recording unit 404 (FIG. 21), and a control circuit board 455 located in the serial recording unit 405. The power supply/control circuit board 471 and the control circuit board 455 are connected with each other via a male connector 443 and a female connector 453.

The power supply/control circuit board 471 is located in the line recording unit 404. Referring to FIG. 24, a controller 100 controls the entire operation of recording apparatus. An interface 101 separates the image data D0 (FIG. 3) transmitted from the host computer, not shown, and stores the yellow, magenta, and cyan image data DA1 into the corresponding line buffers 124Y, 124M, and 124C, and the black image data DA into the line buffer 124K or page memory 122, respectively.

A motor/magnet driving circuit 481 drives motors 104, 482, 106, and plunger magnet 483 in accordance with commands from the controller 100. The motor 104 drives the hopping roller 64 in rotation in the direction of arrow. The motor 482 drives the registering rollers 65 and 66, drive roller 461, driven roller 462, roller 463, guide rollers 464 and 465, attraction roller 466, and transfer roller 23. The motor 106 drives the photosensitive body 25, charging roller 26, developing roller 28, sponge roller 30, stirring shaft 31, heat roller 39, and discharge rollers 43 and 44 in rotation. The plunger magnet 483 switches the belt conveyer mechanism between the solid line position and dotted line position in FIG. 21.

The sensor driver/receiver 333 drives the photo interrupters 84 and 85 as well as receives signals from the photo interrupters 84 and 85 and sends the signals to the controller 100.

The power supply/control circuit board 471 includes a SP biasing power supply 110, DB biasing power supply 113, transfer power supply 114, fixing device driver 115, page memory 122, LED-print controlling circuit 126, power supply 485, and operation section 18. The power supply supplies a high voltage to the attraction roller 466 that attracts the medium 33 to the conveying belt 467. The power supply 486 supplies d-c voltages to all the circuits.

The control circuit board 455 will now be described. The control circuit board 455 is provided with recording head controlling circuits 127Y, 127M, 127C, and 127K corresponding to the recording heads 54Y, 54M, 54C, and 54K (FIG. 22), respectively. The recording head controlling circuits 127Y, 127M, 127C, and 127K receive the image data DA from the corresponding line buffers 124Y, 124M, 124C, 124K, respectively, and drives the recording heads 54Y, 54M, 54C, and 54K in accordance with the commands from the controller 100 to cause the nozzles, not shown, to discharge ink for print. The line buffers 124Y, 124M, 124C, and 124K receives the image data D0 transmitted from the host compute via the interface 101, and stores the image data D0 as the image data DA of one line.

The sensor driver/receiver 487 drives a photo interrupter 409 for detecting the home position of carriage 53. The sensor driver/receiver 784 also receives signals from the photo interrupter 109 and sends the received signals to the controller 100. The motor driving circuit 488 drives the spacing motor 60.

A switch 489 informs the controller 100 when the serial recording unit 405 is mounted to the line recording unit 404, i.e., when the control circuit board 455 is connected to the controller 100 via the male and female connectors 443 and 453. The control circuit board 455 is supplied with d-c voltages via the male and female connectors 443 and 453.

The power supply/control circuit board 471 alone may operate the line recording unit 404.

The printing operation of the recording apparatus of the aforementioned construction will now be described.

The operation is described with respect to a case where the line recording unit 404 is mounted on the serial recording unit 405. The combined use of the recording means 404 and 405 provides monochromatic image print performed by the LED printing mechanism 20, color image print performed by the color ink jet printing mechanism 50, and combined image print performed by the color ink jet printing mechanism 50 and LED printing mechanism 20.

First, the monochromatic image print performed by the LED printing mechanism 20 will be described. When the power supply 486 is turned on, the controller 100 carries out the predetermined initialization, and then drives a fixing device driver 115 to warm up the heat roller 39 of the fixing device 38 to a predetermined temperature. The initialization completes when the heat roller 39 has warmed up to the predetermined temperature.

Then, controller 100 waits for the command and image data D0 that are transmitted from the host computer via the interface 101. Upon receiving the command and the image data from the host computer, the interface 101 decodes the command and the image data and sends them to the controller 100. Then, the controller 100 issues a command to the motor/magnet driving circuit 481 which in turn drives the plunger magnet 483 to shift the belt conveyer mechanism 460 to the dotted line position in FIG. 21. When the interface 101 receives the image data D0, the controller 100 issues a command to the interface 101 and page memory 122, in response to which the interface 101 stores therein the image data D0 as an image data DA to be printed on one page of the medium 33.

After the page memory 122 stores the image data DA for one page of the medium 33, the controller 100 causes the motor 104 to drive the hopping roller 64 in rotation in the direction of arrow D through slightly less than one complete rotation to feed one sheet of medium 33 accommodated in the medium cassette 67 to the guide 72 and 73. Upon detecting that the medium 33 has been fed from the medium cassette 67, the controller 100 causes the motor 482 to drive the registering rollers 65 and 66, driven roller 462, roller 463, guide rollers 464 and 465, attraction roller 466, and transfer roller 23 in rotation, and the conveying belt 467 to run in the direction of arrow V.

The controller 100 turns on the power supply 485 in order to apply a high voltage to the attraction roller 466. Thus, the medium 33 is attracted by electrostatic attraction to the conveying belt 467 when the medium 33 is driven by the registering rollers 65 and 66 to the attraction roller 466. The controller 100 causes the motor 106 to drive the photosensitive body 25, charging roller 26, developing roller 28, sponge roller 30, stirring shaft 31, heat roller 39, and discharge rollers 43 and 44 in the directions of arrows in FIG. 21. The controller 100 turns on the charging power supply 113, DB biasing power supply 111, and SP biasing power supply 110 in order to apply voltages to the charging roller 26, developing roller 28, and sponge roller 30, respectively.

The controller 100 issues a command to the page memory 122 so that the image data DA of one line is transmitted from the page memory 122 to the LED-print controlling circuit 126. The LED-print controlling circuit 126 transmits the image data received from the page memory 122 to the LED head 22 in response to a command from the controller 100.

The LED head 22 causes the LEDs, not shown, to form an electrostatic latent image on the surface of the photosensitive body 25 in accordance with the received image data DA. The toner 32 on the developing roller 32 is deposited onto the electrostatic latent image so that the electrostatic latent image is converted into a toner image.

When the leading end of the medium 33 arrives at a position between the photosensitive body 25 and transfer roller 23, the controller 100 issues a command to the transfer power supply 114 so as to apply a high voltage to the transfer roller 23, thereby electrically transferring the toner image formed on the surface of the photosensitive body 25 onto the medium 33. Upon completion of transfer of the toner image, the controller 100 turns off the charging power supply 113, SP biasing power supply 110, DB biasing power supply 111, and transfer power supply 114.

Then, the medium 33 having a toner image transferred thereon arrives at the fixing device 38 where the medium 33 passes between the heat roller 39 maintained to a proper temperature for fixing and the pressure roller 40 urged to the heat roller 39, so that the toner image on the medium 33 is fixed. After fixing, the medium 33 is guided by the guides 241 and 242 to the discharge rollers 43 and 44 which in turn discharges the medium through the copy exit 45 to the exit stacker 46.

The color printing operation performed by the color ink jet printing mechanism 50 will be described.

Upon receiving the command and image data D0 transmitted from the host computer, the interface 101 decodes and sends them to the controller 100. The controller 100 issues causes the plunger magnet 483 to shift the belt conveyer mechanism to the solid line position in FIG. 21.

The controller 100 causes the spacing motor 60 to drive the carriage 53 to run, and receives a signal via the sensor driver/receiver 487 from the photo interrupter 409. The received signal indicates the home position of the carriage 53. Then, the controller 100 causes the motor 104 to drive the hopping roller 64 to rotate through slightly less than one complete rotation to feed one sheet of medium 33 accommodated in the medium cassette 67 to the guides 72 and 73.

Upon detecting that the medium 33 is fed from the medium cassette 67, the controller 100 causes the motor 482 to drive the registering rollers 65 and 66, drive roller 461, driven roller 462, roller 463, guide rollers 464 and 465, attraction roller 466, and transfer roller 23 in rotation, and the conveying belt 467 to run in the direction of arrow V. The controller 100 turns on the supply power supply 485 to apply a high voltage to the attraction roller 466, thereby attracting the medium 33 to the conveying belt 467 with the aid of electrostatic attraction when the medium 33 is advanced by the registering rollers 65 and 66 to the attraction roller 466.

The controller 100 causes the motor 482 to run the conveying belt 467 to transport the medium 33 to a position immediately below the nozzle of the recording head 54.

Upon receiving the image data D0 of one line transmitted from the host computer via the interface 101, the controller 100 issues commands to the interface 101 and the line buffers 124Y, 124M, 124C, and 124K. In response to the command, the interface 101 separates the received image data D0 according to color, and stores the image data DA of each color into the corresponding line buffers 124Y, 124M, 124C, and 124K.

When the image data DA has been stored into the line buffers 124Y, 124M, 124C, and 124K, the controller 100 causes the spacing motor 60 to drive the carriage 53 to run in the direction of arrow B, thereby carrying out spacing for print.

After print of one line, the controller 100 causes the motor 482 to run the conveying belt 467 for one line in the direction of arrow V, thereby performing line spacing operation.

The controller 100 also causes the spacing motor 60 to to rotate in the reverse direction so that the carriage 53 runs in the direction of arrow C to the home position thereof, thereby performing return-to-home operation. Then, while the line-feed operation and return-to-home operation are being carried out, the controller 100 receives the image data D0 for the next line and again performs the printing operation, line-feed operation, and return-to-home operation.

While the controller 100 performs the reception of image data D0, printing operation, line-feed operation, and return-to-home operation, the medium 33 is conveyed by the conveying belt 467 and is discharged to the guide/copy exit 472 after completion of one page of the medium 33.

The combined mode of image printing performed by the color ink jet printing mechanism 50 and LED printing mechanism 20 will now be described.

The ink jet recording head 54 performs color image printing operation of one page of the medium 33 in accordance with yellow, magenta, and cyan image data DA while the medium 33 is transported. Thereafter, the directions of rotation of the registering rollers 65 and 66 and transportation rollers 75–76 and 279 are reversed to transport the medium 33 till the leading end of the medium 33 arrives at a space between the transportation rollers 75 and 76. Then, the registering rollers 65 and 66 are rotated in the reverse directions to run the conveying belt 467 in the direction opposite to arrow V till the leading end of the medium 33 returns to a position between the guide roller 464 and transfer roller 23.

Then, the conveying belt 460 is shifted to the dotted line position and the motor 482 drives the registering rollers 65 and 66 in rotation and the conveying belt 467 to run in the direction of arrow V, so that the medium 33 is transported to the line recording unit 404 for printing operation performed by the LED printing mechanism 20.

Prior to the transmission of the image data D0 from the host computer, a command is transmitted which indicates that the combined mode of printing operation is to be performed by means of the color ink jet printing mechanism 50 and LED printing mechanism 20. Upon receiving the command and the image data D0, the interface 101 decodes the received command and the image data D0 and sends them to the controller 100.

The controller 100 then causes the plunger magnet 483 to shift the conveying belt 460 to the solid line position as shown in FIG. 21.

The controller 100 causes the spacing motor 60 to drive the carriage 53 to run to the home position. Further, the controller 100 causes the motor 104 to drive the hopping roller 64 in rotation through slightly less than one complete rotation so that the medium 33 is fed one sheet at a time from the medium cassette 67 to the guides 72 and 73.

Detecting that the medium 33 has been fed from the medium cassette 67, the controller 100 causes the motor 105 to rotate the registering rollers 65 and 66, while also turning on the supply power supply 485 to apply a high voltage to the attraction rollers 466. Thus, the medium 33 is transported to a position immediately below the nozzle of the ink jet recording head 54 while being attracted by electrostatic attraction to the conveying belt 467.

Upon receiving the image data D0 of one line transmitted from the host computer via the interface 101, the controller 100 outputs a command to the line buffers 124Y, 124M, 124C, and page memory 122. In accordance with the command, the interface 101 separates the received image data D0 according to color, and stores the separated image data D0 as the image data DA of one line into the corresponding line buffers 124Y, 124M, 124C, and page memory 122. Since the black image data DA is not stored into the line buffer 124K, the recording head 54K does not perform printing operation.

When the respective line buffers 124Y, 124M, 124C, and 124K store the corresponding image data DA, the controller 100 causes the motor 60 to drive the carriage 53 to run in the direction of arrow B for spacing, thus effecting printing operation. Upon completing the print of one line, the controller 100 causes the motor 482 to run the conveying belt 467 in the direction of arrow V by only one line for line-feed operation.

The controller 100 also drives the spacing motor 60 to run the carriage 53 in the direction of arrow C to the home position, thereby effecting return-to-home operation. During the line-feed and return-to-home operations, the controller 100 receives the image data D0 of the next line, and upon receiving of which the controller 100 resumes printing, line-feed, and return-to-home operations.

In this manner, while the reception of the image data D0, printing operation, line-feed and return-to-home operations are repeatedly carried out, the medium 33 is transported by the conveying belt 467 to be discharged through the guide/copy exit 472. After the color ink jet printing mechanism 50 completes the printing operation of the final line, the controller 100 causes the motor 482 to rotate in the reverse direction, so that the registering rollers 65 and 66 are rotated in the reverse direction and the conveying belt 467 in the direction opposite to the arrow V.

Thus, the medium 33 is transported backward till the trailing end of the medium 33 projects outwardly of the apparatus through the medium-feeding slot 283. When the leading end of the medium 33 arrives at a position between the guide roller 464 and transfer roller 23, the controller 100 causes the motor 482 to stop and then to rotate in the forward direction so that the registering rollers 65 and 66 rotate in the forward directions and the conveying belt 467 in the direction of arrow V. Thus, the medium 33 is transported by the conveying belt 467 into the LED printing mechanism 20.

The controller 100 issues a command to the page memory 122 in which the image data DA of one page is stored, to transmit the stored image from the page memory 122 to the LED-print controlling circuit 126, which in turn transfers the received image data DA to the LED head 22. The LED head 22 causes the corresponding LEDs, not shown, to form an electrostatic latent image of one line on the surface of the photosensitive body 25 in accordance with the received image data DA.

Then, the toner 32 is deposited onto the electrostatic latent image formed on the developing roller 28, thereby converting the electrostatic latent image into a toner image. When the leading end of the medium 33 arrives at a position between the photosensitive body 25, the controller 100 issues a command to the transfer power supply 114 to apply a high voltage to the transfer roller 23. The high voltage applied to the transfer roller 23 causes the toner image on the surface of the photosensitive body to be transferred on the medium 33.

The medium 33 passes between the heat roller 39 and pressure roller 40 which presses the medium 33 against the heat roller, thereby the toner image being fixed on the medium 33.

Once the toner image has been fixed, the medium 33 is guided by the guides 241 and 242 to the discharge rollers 43 and 44 which discharges the medium to the exit stacker 46 through the copy exit 45. Upon discharging the medium 33, the controller 100 causes the motors 106 and 482 to stop, completing the printing operation.

In the third embodiment, the medium 33 is discharged through the guide/copy exit 472 after the color printing operation performed by the color ink jet printing mechanism 50, and to the exit stacker 46 after the printing operation performed by the LED printing mechanism 20. This indicates that the medium 33 will not pass through the LED printing mechanism 20 if print is performed by only the color ink jet printing mechanism 50. This construction enhances durability of the LED printing mechanism 20.

The medium 33 is transported while being attracted to the conveying belt 467. Thus, when the combination of color print and monochromatic print is to be performed by means of the color ink jet printing mechanism 50 and LED printing mechanism 20, the medium 33 will not be subjected to skew problem which causes misregistration of colors.

Fourth Embodiment

A fourth embodiment will now be described.

Figure 25:
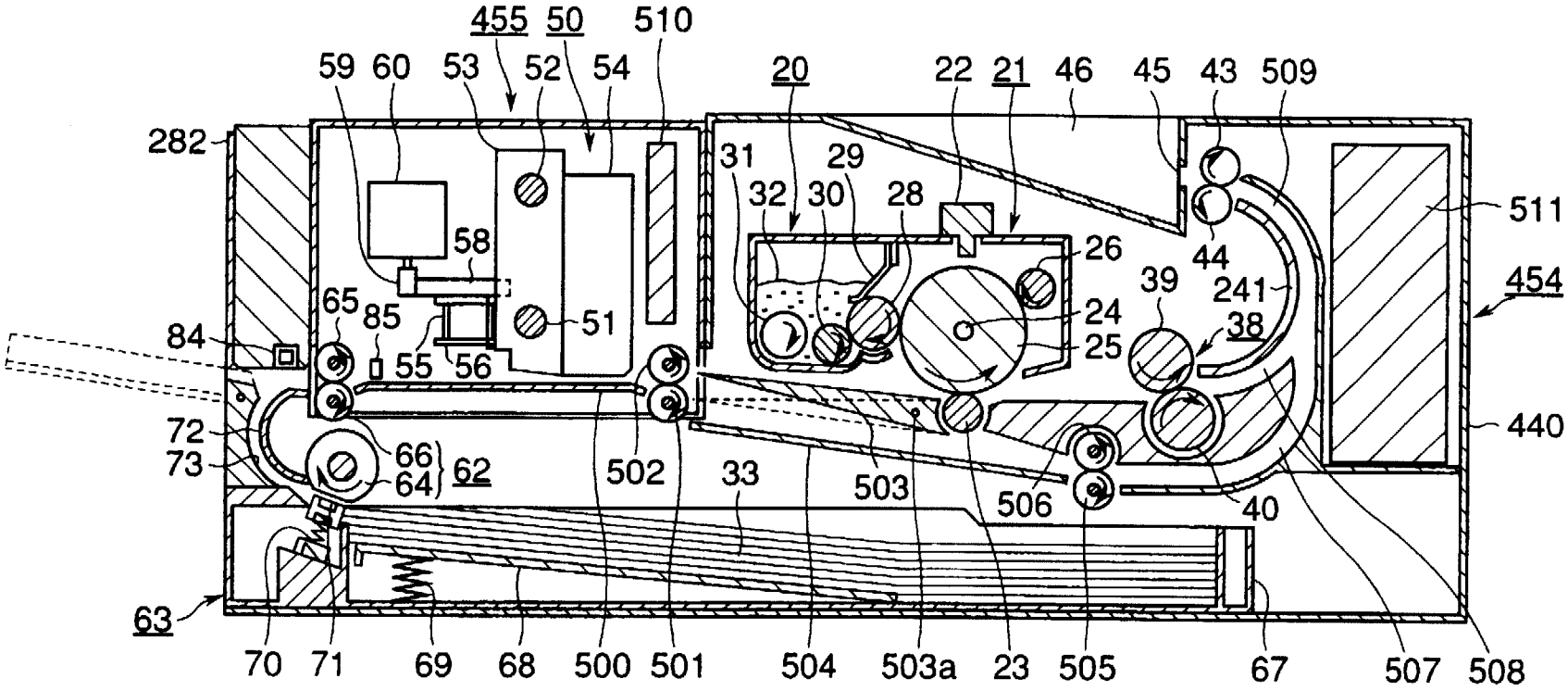
FIG. 25 shows a cross-sectional view of a recording apparatus according to a fourth embodiment.

FIG. 25 shows a cross-sectional view of a recording apparatus according to the fourth embodiment. Elements similar to those in FIGS. 21 and 22 have been given like references and the description thereof is omitted.

An exit stacker 46 is used in common when the medium 33 is discharged after printing operation performed by a serial recording unit 455, and when the medium 33 is discharged after printing operation performed by a line recording unit 454.

Referring to FIG. 25, an LED printing mechanism 20 as a first recording means includes an image-forming section 21, LED head 22, and transfer roller 23. A color ink jet printing mechanism 50 operates as a second recording means. A paper-feeding mechanism 62 includes a paper-accommodating cassette 63, hopping roller 64, and registering rollers 65 and 66.

A fixing device 38 is shown on the right half in FIG. 25. The medium 33 having a toner image fixed thereon passes through the guide paths 508 and 509 to the discharge rollers 43 and 44 which in turn drive the medium 33 to an exit stacker 46 through a copy exit 45. A paper guide 500 guides the medium 33, and conveying rollers 501 and 502 transport the medium 33. A plunger magnet, not shown, causes the feed-direction-switching means 503 to pivot about a shaft 503 to switch between the solid line position and dotted line position.

The medium 33 is guided to the LED printing mechanism 20 when the feed-direction switching means 503 is at the dotted line position, and guided by the paper guide 504 to the transportation rollers 505 and 506 when positioned at the dotted line position. The medium 33 transported by the rollers 505 and 506 passes through guides 507 and 509 to the discharge rollers 43 and 44. A control board 510 drives a color ink jet printing mechanism 50 and a power supply/control board 511 drives an LED printing mechanism 20.

The operation of a recording apparatus of the aforementioned construction will now be described. Here, only the operation of feeding the medium 33 is described. When the color ink jet printing mechanism 50 performs color printing operation, the aforementioned plunger magnet causes the feed-direction-switching means 503 to shift to the solid line position. Thus, the medium 33 having been printed by the color ink jet printing mechanism 50 is guided by the feed-direction-switching means 503 and paper guide 504 to the transportation rollers 505 and 506, which in turn drive the medium 33 into the guide paths 507 and 509 to the discharge rollers 43 and 44. The discharge rollers 43 and 44 drive the medium 33 through the copy exit 45 to the exit stacker 46.

When the color ink jet printing mechanism 50 performs color printing operation, the aforementioned plunger magnet causes the feed-direction-switching means 503 to shift to the dotted line position. Thus, the medium 33 transported by the transportation rollers 501 and 502 is guided by the feed-direction switching means 503 so that the medium 33 is introduced into the LED printing mechanism 20 which prints a toner image on the medium 33. The toner image on the medium 33 is then fixed by means of the heat roller 39. The medium 33 passes through the guide paths 508 and 509 and is discharged by the discharge rollers 43 and 44 through the copy exit 45 to the exit stacker 46.

When performing the combined mode of printing operation using the color ink jet printing mechanism 50 and LED printing mechanism 20, the plunger magnet first causes the feed-direction-switching means 503 to shift to the solid line position for performing color print. The medium 33 is guided by the feed-direction switching means 503 and paper guide 504 and is transported by the transportation rollers 505 and 506 through the guide paths 508 and 509.

When the color ink jet printing mechanism 50 completes printing of the final line, the registering rollers 65 and 66 and transportation rollers 501, 502, 505, and 506 are rotated in the reverse directions so that the medium 33 is moved backward till the leading end of the medium 33 arrives at the transportation rollers 501 and 502. Then, the feed-direction-switching means 503 is shifted to the dotted line position, and the registering rollers 65 and 66 and transportation rollers 501 and 502 are rotated in the forward directions to direct the medium 33 to the LED printing mechanism 20 which in turn performs monochromatic image printing operation.

Then, the medium 33 passes the guide paths 508 and 509, and is transported through the copy exit 45 to the discharge stacker 46. When performing the combined mode of color and monochromatic printing operations using the color ink jet printing mechanism 50 and LED printing mechanism 20, the print operation may be designed to halt after the color print until the ink on the medium 33 dries up and then proceed to the monochromatic image print. This ensures high quality monochromatic image print.

The combined mode of operation may also be modified so that the medium 33 may be stored in the exit stacker 46 after color print and then the medium 33 is delivered to the LED printing mechanism 20 for monochromatic print.

In the fourth embodiment, The medium 33 may be passed through the guide path 507 after color print and through the guide path 508 after monochromatic print. Thus, when only color print is to be made, the medium 33 does not pass through the LED printing mechanism 20 after color print. This provides prolonged life time of the LED printing mechanism 20.

The guide paths 507 and 508 are merged into the guide path 509, so that exit stacker 46 may be used in common for the color image print and monochromatic print. This construction permits miniaturization of the recording apparatus.

Fifth Embodiment

A fifth embodiment will now be described.

Figure 26:
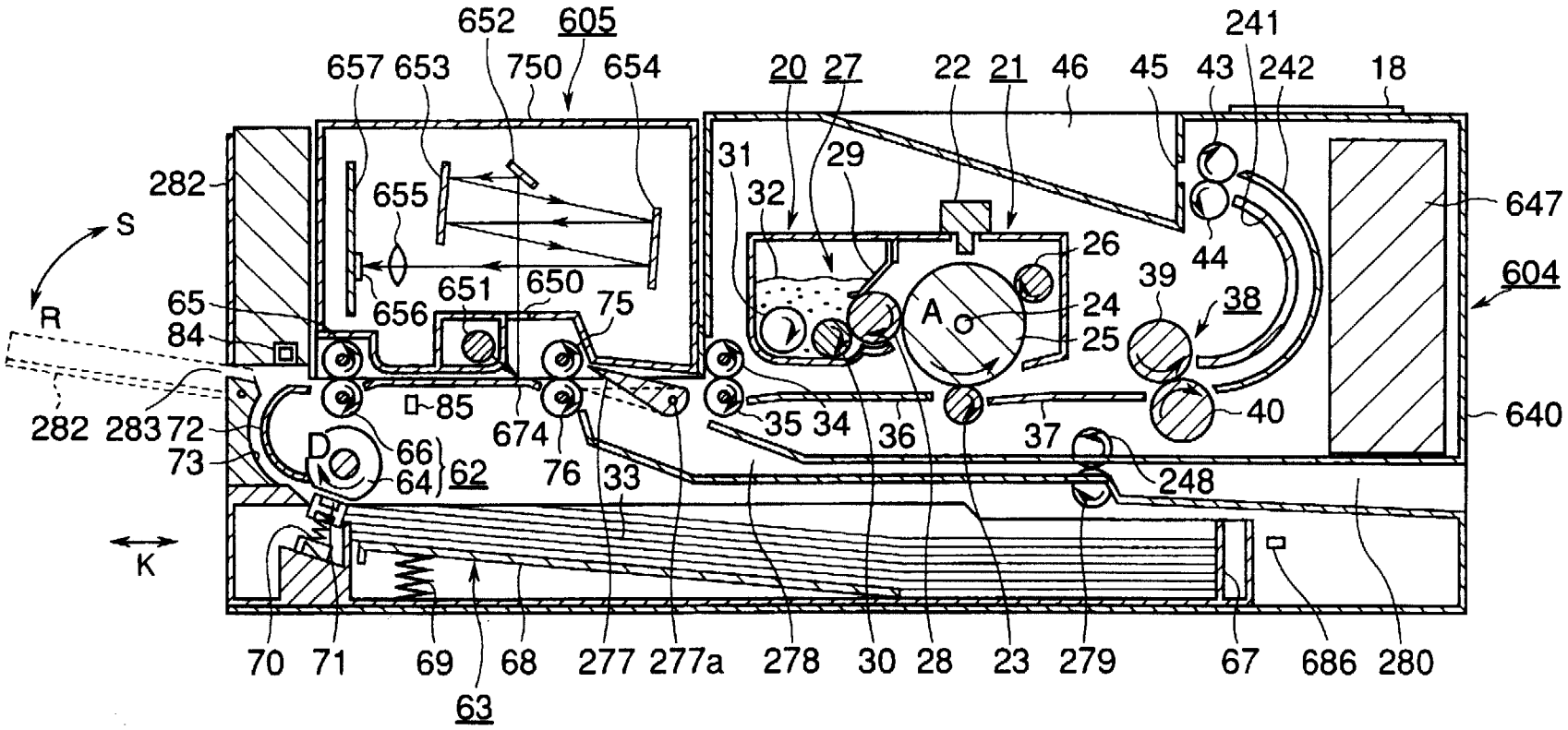
FIG. 26 is a cross-sectional view of a recording apparatus according to the fifth embodiment.
Figure 27:
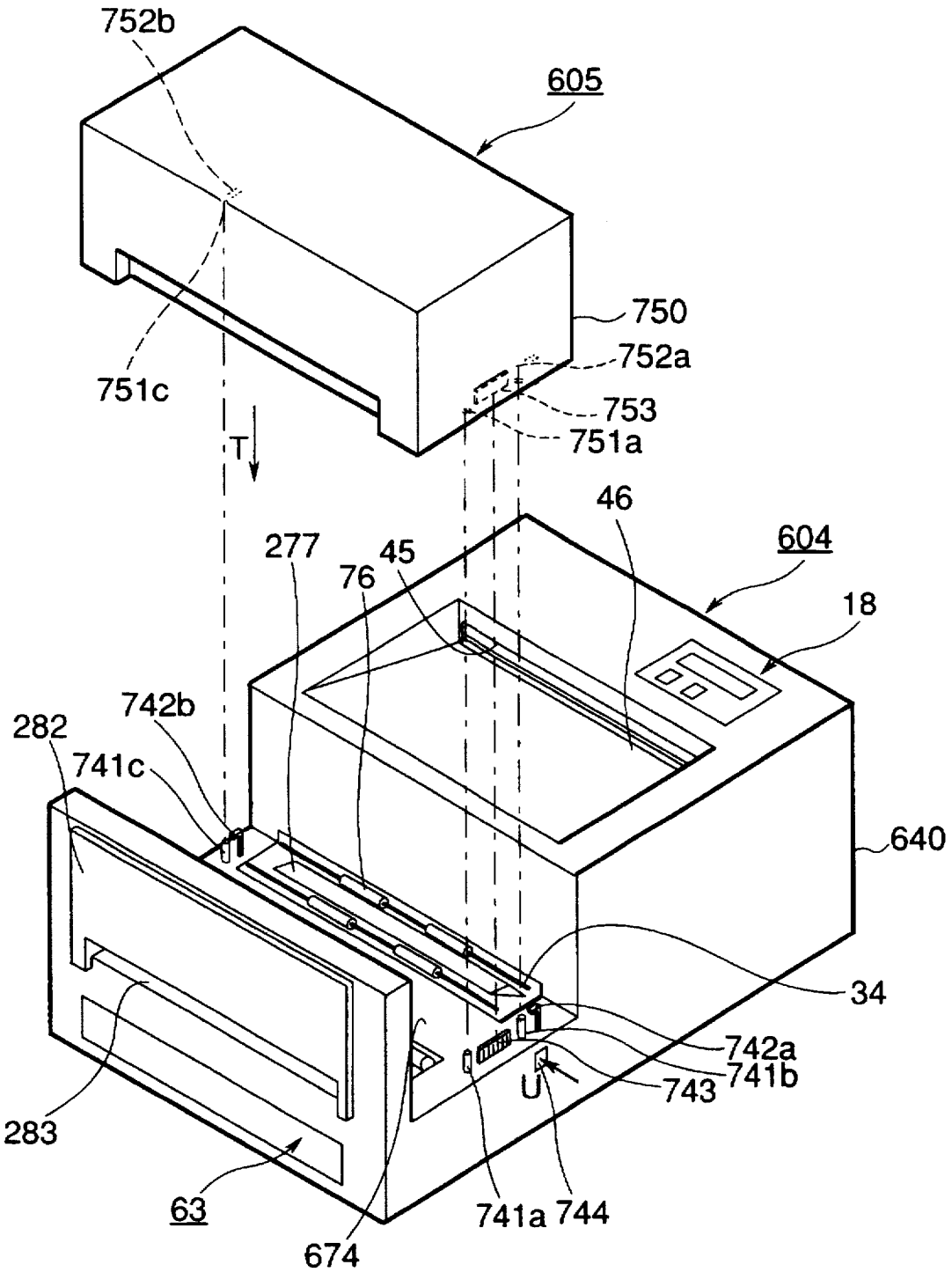
FIG. 27 is a perspective view of the recording apparatus of the fifth embodiment.

FIG. 26 is a cross-sectional view of a recording apparatus according to the fifth embodiment and FIG. 27 is a perspective view.

In the fifth embodiment, the recording apparatus is adapted to perform image print and image reading and may be equipped with an optional image reader. Referring to FIG. 26, a line recording unit 604 has a paper feeding mechanism 62 and an LED printing mechanism 20 as a recording means. An image-reading unit 605 operates as an image-reading means. The line recording unit 604 includes a case 640 that houses guide pins 741*a*–741*c*, hooks 742*a* and 742*b*, and male connector 743. The image-reading unit 605 includes a case 750 having guide holes 751*a*–751*c* that engage the guide pins 741*a*–741*c*, and engagement holes 752*a* and 752*b* that engage the hooks 742*a* and 742*b* formed in the bottom thereof. A female connector 753 is disposed on the bottom of the case 750 and fits to the male connector 743.

The hooks 742*a* and 742*b* are held in position by means of springs or the like, not shown, so that when the image-reading unit 605 is lowered in the direction of arrow T onto the line recording unit 604, the guide pins 741*a*–741*c* are guided into the guide holes 751*a*–751*c* causing the hooks 742*a* and 742*b* to automatically engage the engagement holes 752*a* and 752*b*, thereby the male connector fitting into the female connector. In this manner, the image-reading unit 605 is mounted to the line recording unit 604.

In order to dismount the image-reading unit 605 from the line recording unit 604, a button 744 disposed on the side surface of the line recording unit 604 is pressed in the direction of arrow U. Then, lifting the image-reading unit 605 in the direction opposite to the arrow T permits dismount of the line recording unit 604.

An operating section 18 is disposed on the top surface of the line recording unit 604. The operating section 18 includes a paper feed key, on-line/off-line selection key, copy key, indicator for indicating various operation conditions, alarm lamps for warning, for example, run out of paper, and buzzer for alarming the operator.

The line type LED printing mechanism 20 will now be described.

The LED printing mechanism 20 includes an image-forming section 21, LED head 22, and transfer roller 23. The image-forming section 21 includes a photosensitive body 25 rotated about a shaft in the direction of arrow A, charging roller 26, and developing section 27. The developing section 27 includes a developing roller 28, developing blade 29, sponge roller 30, stirring shaft 31, and black toner 32 made of a single non-magnetic compound.

The toner 32 supplied by the stirring shaft 31 is delivered to the developing roller 28 via the sponge roller 30 so that the developing blade 29 forms a thin layer of toner on the surface of the photosensitive body 25 in contact with the surface of the developing roller 28. The LED head 22 illuminates the photosensitive body 25 to form an electrostatic latent image on the surface of the photosensitive body 25. The toner 32 on the surface of the developing roller 28 is deposited on the electrostatic latent image by electrostatic attraction to form a toner image. The toner image is then transferred to the medium 33 by electrostatic attraction of the transfer roller 23.

On the left side of the LED printing mechanism 20 in FIG. 16 are disposed pull-in rollers 34 and 35 that pull in the medium 33, discharged from the serial recording unit 202, into the line recording unit 201. Guides 36 and 37 guide the medium 33 to a fixing device 38 of the LED printing mechanism 20 for fixing.

The medium 33 having the toner image fixed thereon is then guided by the guides 241 and 242 to the discharge rollers 43 and 44 which discharge the medium 33 through a copy exit 45 to an exit stacker 46. For the time period during which the line recording unit 604 prints on the medium 33 and the medium 33 is discharged to the exit stacker 46, the respective rollers are rotated by the motors, not shown, in the directions of arrows in FIG. 26. The line recording unit 604 has a power supply/control board 647 and an idle roller 248 disposed therein.

Below the image-reading unit 605 is disposed a paper feeding mechanism 62. The paper feeding mechanism 62 includes a paper-accommodating cassette 63, hopping roller 64 having a D-cut and registering rollers 65 and 66.

The paper-accommodating cassette 63 is disposed such that the cassette 63 may be detachably inserted in the direction of arrow K. The paper-accommodating cassette 63 includes a medium cassette 67, lift plate 68, pressing spring 69, separating means 70 and a spring 71. When the hopping roller 64 is rotated slightly less than one complete rotation in the direction of arrow D, the medium 33 is guided by the guides 72 and 73 to the pair of registering rollers 65 and 66.

The medium 33 housed in the medium cassette 67 is urged against hopping roller 64 by the spring 69 via the lift plate 68 so that the rotation of the hopping roller 64 causes the separating means 70 to feed the medium one sheet at a time. With this condition, the rotation of the hopping roller slightly less than one complete rotation in the direction of arrow D drives the medium 33 to advance to be guided by the guides 72 and 73 to the registering rollers 65 and 66. The further rotation of the registering rollers 65 and 66 in the directions of arrows transports the medium 33 to a pair of transportation rollers 75 and 76, the medium 33 being guided by the guide 674. The surface of the guide 674 is an image-reading plane and serves as a white reference.

A feed-direction-switching means 277 selectively guides the medium 33 passing between the transportation rollers 75 and 76 either to the pull-in rollers 34 and 35 or to the guide path 278. As is apparent from FIG. 16, the feed-direction-switching means 277 is driven by a magnet plunger, not shown, to pivot about a shaft 277*a* either to a solid line position or to the dotted line position. The medium 33 is advanced through the guide path 278 to a space between the idle roller 248 and the transportation roller 279 when the feed-direction-switching means 277 is at the solid line position, and to the rollers 34 and 35 when the feed-direction-switching means 277 is at the dotted line position.

Reference numeral 280 denotes a second exit stacker to which an original having been read an image thereof is discharged, and reference numeral 282 denotes a manual-feed guide.

Rotating the manual-feed guide 282 in the direction of arrow R to the dotted line position in FIG. 26 permits the operator to manually feed the medium 33 one sheet at a time. The manual-feed guide 282 may be pivoted in the direction of arrow S to the solid line position in FIG. 26. Photo interrupters 84 and 85 detect the medium 33. Photo interrupter 686 detects when the paper-accommodating cassette 63 is inserted and drawn out.

The image-reading unit 605 will now be described. The image-reading unit 605 includes a case 750 having a rectangular image-reading window 650 formed in the bottom thereof, fluorescent lamp 651 disposed in parallel to the image-reading window 650, mirrors 652–654 disposed in the case 750, lens 655, and circuit board 657 having photoelectric conversion element 656 mounted thereon.

Figure 28:
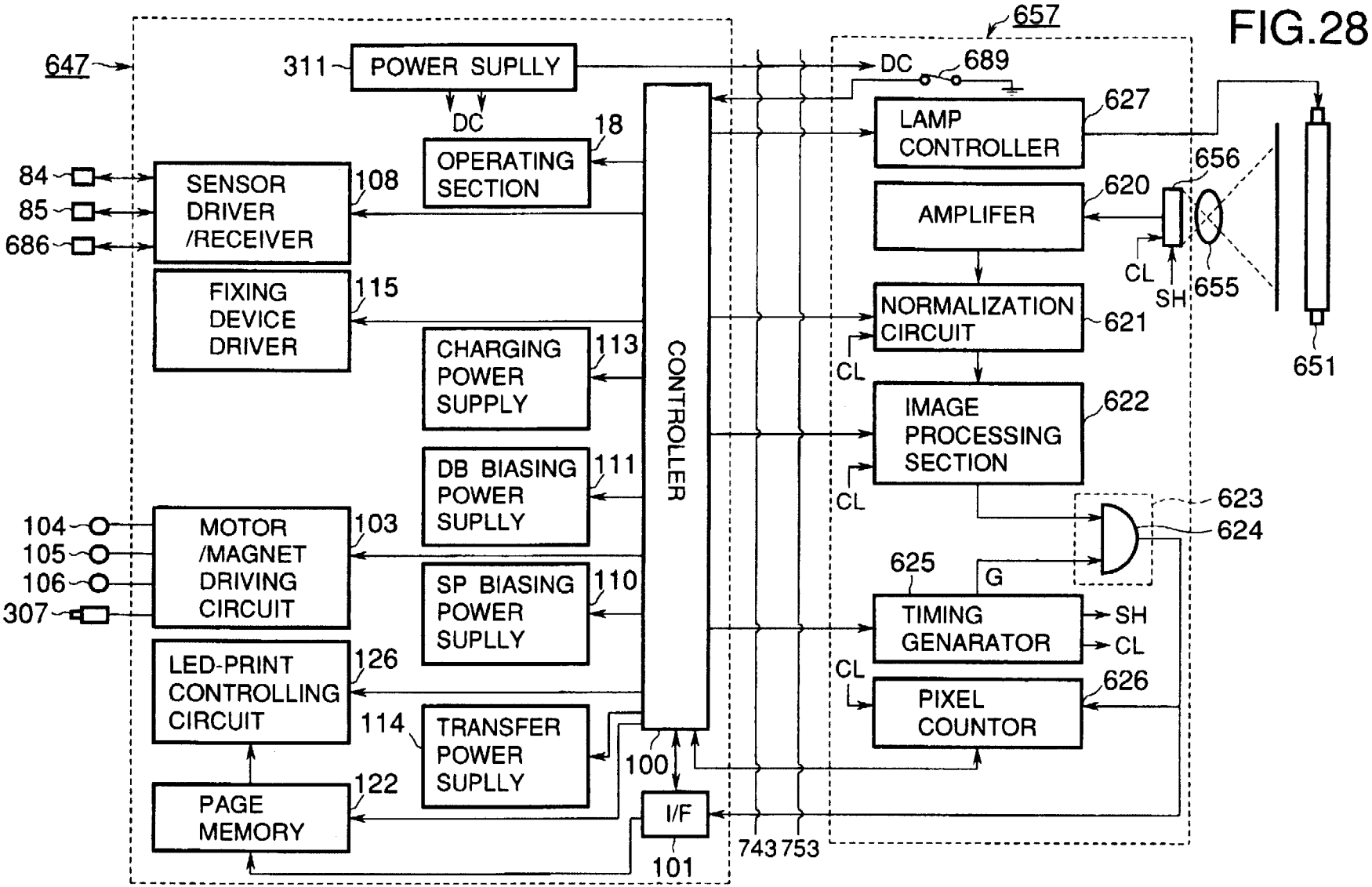
FIG. 28 is a block diagram showing a control section of the fifth embodiment.

The light emitted from the fluorescent lamp 651 illuminates the image-reading plane i.e., the surface of the original to be read an image thereof. The light reflected by the surface passes through the image-reading window 650 and the mirrors 652–654, and is condensed by the lens 655 to form an image on the photoelectric conversion element 656 which converts the light into an image signal. FIG. 28 is a block diagram showing a control section of the fifth embodiment of the invention.

Referring to FIG. 28, the control section includes a power supply/control circuit board 647 disposed in the line recording unit 604 (FIG. 26), and a board 657 disposed in the image-reading unit 605. The power supply/control circuit board 647 is connected with the board 657 via a male connector 743 and female connector 753.

First, the power supply/control circuit board 647 will be described.

Referring to FIG. 28, a controller 100 takes the form of, for example, a microprocessor and controls the entire operation of the recording apparatus. An interface 101 directs the image data D0 (FIG. 3) transmitted from the host computer, not shown, to a page memory 122. The interface 101 also transmits the signal, which is read by the photoelectric conversion element 656, as the image data to the host computer.

The motor/magnet driving circuit 103 drives motors 104, 105, 106, and plunger magnet 307 in accordance with the commands from the controller 100. The motor 104 causes the hopping roller 64 to rotate in the direction of arrow D. The motor 105 causes the registering rollers 35 and 66, transportation rollers 75 and 76 and idle roller 248 to rotate in the directions of arrows or opposite to the arrows. The motor 106 drives the pull-in rollers 34 and 35, photosensitive body 25, charging roller 26, developing roller 28, sponge roller 30, transfer roller 2, heat roller 39, and discharge roller 43 and 44 in rotation. The plunger magnet 307 drives the feed-direction-switching means 277 to pivot.

The sensor driver/receiver 108 drives the photo interrupters 84, 85, 686 and receives signals from the photo interrupters 84, 85, 686 and transmits the received signals to the controller 100.

The power supply/control circuit board 647 has a SP biasing power supply 110, DB biasing power supply 111, charging power supply 113, transfer power supply 114, fixing device driver 115, the page memory 122 for storing the image data DA from the interface 101, LED print controlling circuit 126 and operating section 18. The LED print controlling circuit 126 receives the image data DA from the page memory 122 and transmits the received image data to the LED head 22 and controls the exposure time of the LEDs not shown to form an electrostatic latent image on the surface of the photosensitive body 25. The power supply 311 supplies d-c voltages to all the circuits.

The board 657 will now be described. Referring to FIG. 28, an amplifier 620 amplifies the image from the photoelectric conversion element 656 to a certain level. A normalization circuit 621 compensates non-uniformity of illumination of the fluorescent lamp 651, and degradation characteristic of an amount of ambient light. The normalization circuit 621 includes an A/D converter, D/A converter, and a shading compensation memory.

An image processing section 622 performs an operation for converting the image signal outputted from the normalization circuit 621 into a bi-level image signal with reference to a predetermined threshold level, produces halftones of the image signal, performs an operation for converting the image signal outputted from the normalization circuit 621 into a gray-scale or a dithered halftone signal (i.e., 4-bit or 8-bit etc. signal) representative of gradation of the image signal, and mirror-image processing. A signal-sampling section takes the form of a two-input AND gate 628. A timing generator 625 takes the form of, for example, a programmable counter, and provides a shift pulse SH and a control clock CL used for image-reading operation to the photoelectric conversion element 656, and a gate control signal G to the signal sampling section 623.

The image signal processed by the image processing section 622 and outputted to the signal sampling section 623, is directed to the pixel counter 626 and to the interface 101 via the male connector 743 and female connector 753.

The pixel counter 626 takes the form of a counter and counts the number of white and black pixels of the image signal outputted from the signal sampling section 623 in accordance with the control clock CL. The content of the pixel counter 626 is sent to the controller 100. A lamp controller 627 causes the fluorescent lamp to come on and off.

The interface 101 allows bilateral transmission of the image data between the host computer. Reference numeral 689 denotes a switch.

Monochromatic printing operation performed by the LED printing mechanism 20 will now be described.

When the power supply 311 is turned on, the controller 100 carries out the predetermined initialization. Then, the controller 100 drives the fixing device driver 115 to warm up the heat roller 39 of the fixing device 38 to a predetermined temperature. The initialization completes when the heat roller reaches a predetermined temperature and the controller 100 waits for the command and image data D0 from the host computer.

Upon receiving the command and data D0, the controller 100 issues a command to the interface 101 and page memory 122. In this manner, the received image data D0 is stored as the image data DA into the page memory 122.

When the image data DA of one page has been stored into the page memory 122, the controller 100 causes the plunger magnet 307 to shift the feed-direction-switching means 277 to the dotted line position in FIG. 26. The controller 100 also causes the motor 104 to drive the hopping roller 64 in rotation in the direction illustrated by arrow D through slightly less than one complete rotation. The rotation of the hopping roller 64 feeds the medium 33 from the medium cassette 67 one sheet at a time to the guides 72 and 73.

Detecting that the medium 33 has been fed from the medium cassette 67, the controller 100 causes the motor 105 to drive registering roller 65 and 66 in rotation. The rotation of the registering roller 65 and 66 transports the medium 33 through the guide 674 to the transportation rollers 75 and 76, which in turn drive the medium 33 through the feed-direction-switching means 277 to the pull-in rollers 34 and 35.

The motor 104 is caused to stop when the hopping roller 64 has rotated till the D-cut portion opposes the separating means 70, and the motor 105 is caused to stop when the trailing end of the medium passes the photo interrupter 85.

The controller 100 causes the motor 106 to drive the pull-in roller 34 and 35, photosensitive body 25, charging roller 26, developing roller 28, sponge roller 30, stirring shaft 31, transfer roller 23, heat roller 39, discharge rollers 43 and 44 in rotation in the directions shown in FIG. 26. Then, the controller 100 turns on the charging power supply 113, DB biasing power supply 111, and SP biasing power supply 110 in order to apply voltages to the charging roller 26, developing roller 28, and sponge roller 30.

The controller 100 issues a command to the page memory 122, in response to which the page memory 122 transmits the image data DA of one line to the LED-print controlling circuit 126. Upon receiving the command from the controller 100, the LED-print controlling circuit 126 transmits the image data DA received from the page memory 122 to the LED head 22. The LED head 22 causes the LEDs corresponding to the received image data DA to light up to form an electrostatic image on the surface of the photosensitive body 25. Then, the toner 32 on the developing roller 28 is deposited on the electrostatic latent image to form a toner image.

When the leading end of the medium 33 arrives a position between the photosensitive body 25 and transfer roller 23, the controller 100 issues a command to the transfer power supply 114 in order to apply a high voltage to the transfer roller 23. This causes the toner image on the surface of the photosensitive body 25 to be electrically transferred onto the medium 33. Upon completion of the transfer of the toner image, the controller 100 turns off the charging power supply 113, SP biasing power supply 110, DB biasing power supply 111, and transfer power supply 114.

The medium 33 passes between the heat roller 39 and the pressure roller 40 so that the toner image is fixed on the medium 33. Then, the medium 33 is guided by the guides 241 and 242 and is discharged by the discharge rollers 43 and 44 to the exit stacker 46 through the copy exit.

The image-reading operation of the image-reading unit 605 will now be described.

Figure 29:
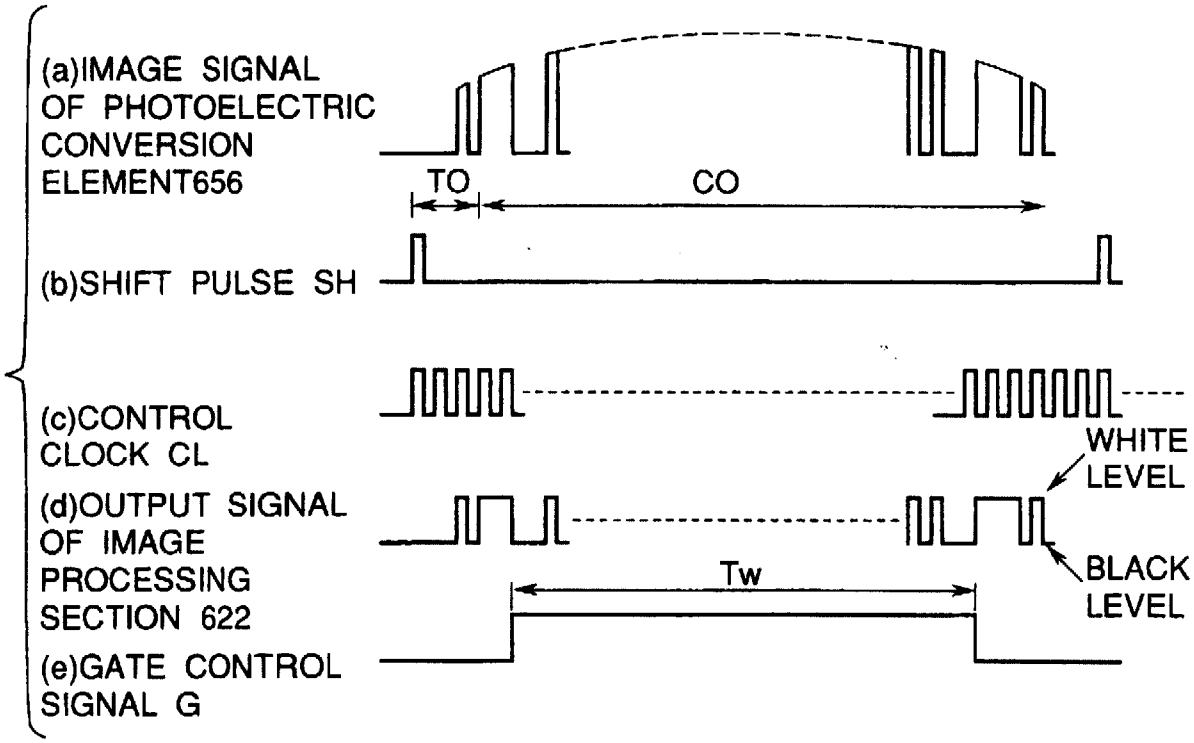
FIG. 29 is a time chart showing the operation of an image-reading unit according to the fifth embodiment.

FIG. 29 is a time chart showing the operation of the image-reading unit according to the fifth embodiment.

First, the paper-accommodating cassette 63 (FIG. 26) is drawn out of the case 750 in the direction of arrow K and the medium 33 is replaced by an original to be read an image thereof. The original is placed face down.

Then, the paper-accommodating cassette 63 is set in place in the case 750. The controller 100 (FIG. 28) causes the sensor driver/receiver 108 to drive the photo interrupter 686 in order to determine whether the paper-accommodating cassette 63 has been properly placed in the case. The controller 100 starts image-reading operation upon receiving the image-reading command transmitted from the host computer, not shown.

The controller 100 drives the plunger magnet 307 to shift the feed-direction-switching means 277 to the solid line position in FIG. 26. The controller 100 then sends a signal to the lamp controller 627, in response to which the fluorescent lamp 651 lights up to read the reference white background. The reference white background data is stored as a reading reference signal into the shading compensation memory of the normalization circuit 621. Thus, the shading compensation of the image data which has been read from the original can be performed with reference to the reading reference signal.

The controller 100 causes the motor 104 to drive the hopping roller 64 through slightly less than one complete rotation in the direction of arrow D, so that one sheet of the originals in the medium cassette is fed to the guides 72 and 73.

Upon detecting when the original to be read an image thereof has been fed from the medium cassette 67, the controller 100 causes the motor 105, registering roller 65 and 66, and transportation rollers 75 and 76 to rotate so that the original is delivered to a position immediately below the image-reading window 650. When the original arrives at the position immediately below the image-reading window 650. The controller 100 issues a command to the timing generator 625, in response to which the timing generator 625 outputs shift pulse SH and control clock CL as shown in FIG. 29 to the photoelectric conversion element 656.

Time T0 after the shift pulse SH has been inputted to the photoelectric conversion element 656, the photoelectric conversion element 656 outputs the image signal to the amplifier 620 in serial form in a timed relation with the control clock CL. The time T0 and the number of total pixels are determined by the characteristic of the photoelectric conversion element 656.

The image data outputted from the photoelectric conversion element 656 is directed to the amplifier 620, through a normalization circuit 621, image processing section 622 for appropriate signal processing, and the image processing section 622 provides an output signal as shown in FIG. 29 to one of the input terminals of a two-input AND gate 624 of the signal sampling section 623. The timing generator 625 provides the gate control signal G to the other input terminals of the AND gate 624, the gate control signal G going high only for the time period Tw during which image-reading operation takes place.

Thus, the output signal of the image processing section 622 is directed to the pixel counter 626 and interface 101 only for the time period Tw. The interface 101 transmits the output signal, received from the image processing section 622, as the image data to the host computer. In this manner, the image of the original is read line by line. The original is transported further while repeatedly performing the image-reading operation, so that the image processing section 622 transmits its output signal in sequence via the interface 101 to the host computer.

The original is transported by the transportation rollers 75 and 76, being guided by the feed-direction-switching means 277 through the guide path 278 and transported by the transportation roller 279 and idle roller 248 to the second exit stacker 280. Likewise, the following sheet of the original is fed from the paper-accommodating cassette 63 for image-reading operation thereof.

When performing image-reading operation on an original manually inserted, the manual guide 282 is rotated in the direction of arrow R as shown in FIG. 26 before inserting the original to be read from. The controller 100 detects the original to be read from by means of the sensor driver/receiver 108 and causes the motor 105 to drive the registering rollers 65 and 66, transportation rollers 75, 76, 279 and idle roller 248 in rotation in the directions shown in FIG. 26. Thus, the original is delivered to the image-reading plane on the guide 674 for image-reading operation.

With the recording apparatus of the aforementioned construction, the image of the manually inserted original can be copied onto the medium 33.

The copying operation performed by the LED printing mechanism 20 will now be described. The original is placed on the manual feed guide 282 and inserted through the medium-feeding slot 283, and then a copy key, not shown, of the operating section 18 is pressed.

The controller 100 causes the plunger magnet 307 to shift the feed-direction-switching means 277 to the solid line position in FIG. 26 for image-reading operation. The controller 100 issues a command to the interface 101 so as to store the image signal obtained through image-reading operation into the page memory 122 via the interface 101. The original is then discharged to the second exit stacker 280 after having been read the image thereof.

When the image data of one page has been stored into the page memory 122, the monochromatic image printing operation is initiated. The controller 100 causes the plunger magnet 307 to shift the feed-direction-switching means 277 to the dotted line position in FIG. 26. The controller 100 causes the motor 104 to drive the hopping roller 64 in rotation through slightly less than one complete rotation in the direction of arrow D, thereby feeding the medium 33 in the medium cassette 67 to the LED printing mechanism 20 for monochromatic printing operation.

In this manner, the monochromatic printing is performed on the medium 33 fed from the medium cassette 67 in accordance with the image data of the original stored in the page memory 122. Thereafter, the medium 33 is discharged to the exit stacker 46. Upon completion of the copying operation, the original is discharged to the second exit stacker 280 while the medium 33 having a monochromatic image printed thereon is discharged to the exit stacker 46.

With the recording apparatus of the aforementioned construction, the medium 33 and the original to be read an image thereof are accommodated in the same medium cassette 67. Therefore, the user may inadvertently perform monochromatic image printing on the original to be read an image thereof or make a copy of the original. The original-identifying operation of the invention is for preventing the user from such mistakes.

The original-identifying operation will be described.

The controller 100 resets the count of the pixel counter 626 to zero and causes the plunger magnet 307 to shift the feed-direction-switching means 277 to the solid line position in FIG. 26 for image-reading operation. During the image-reading operation, the controller 100 continues to transport the original accommodated in the medium cassette 67 by rotating the hopping roller 64 till the trailing the end of the original is detected by the photo interrupter 85 during the image-reading operation.

During the image-reading operation, the image processing section 622 converts the image signal into a two-state signal and outputs the two-state signal to the two-input AND gate 624. The two-input AND gate 624 calculates the logic state of the two-state image signal and the gate control signal G, and provides an output thereof to the interface 101 and original-identifying counter 626.

The pixel counter 626 counts the number of pixels of black level in timed relation with the control clock C.

Upon completion of the image-reading operation of one page of the original, the controller 100 issues a command to the pixel counter 626 to read the total count of the pixels of black level. The total count corresponds to the number of black pixels of the surface of the original. If the ratio of the total count to the number C0 of the total pixels is equal to or less than, for example, 0.1%, then the original can be considered to be a white medium 33. Thus, monochromatic image printing operation is now performed on the thus identified white medium 33.

In contrast, the ratio of the total count to the number C0 of the total pixels is more than 0.1%, it can be said that the original subjected to the image-reading operation is in fact an original to be read an image thereof and not a white medium. Therefore, the original is discharged to the second exit stacker 280.

If the original to be read an image thereof is determined as being a white medium 33 which may be used for monochromatic image print, the controller 100 causes the motor 105 to rotate in the reverse direction so that the registering rollers 65 and 66, transportation rollers 76, 77, 279 and idle roller 248 are rotated in the directions opposite to the directions of arrows in FIG. 26, thereby moving the medium backward. Thus, the trailing end of the medium 33 projects outwardly of the recording apparatus through the manual feeding slot 283. The backward movement of the medium 33 completes when the leading end of the medium 33 arrives at a position where the leading end is sandwiched by the transportation rollers 76 and 77 and the motor 105 stops.

The controller 100 causes the plunger magnet 307 to shift the feed-direction-switching means 307 to the dotted line position in FIG. 26, and causes the motor 105 to rotate in the forward direction so that the registering rollers 65 and 66, transportation rollers 76, 77, 279 and idle rollers 248 rotate in the directions of arrows shown in FIG. 26, guiding the medium 33 by means of the feed-direction switching means 277 to the pull-in rollers 34 and 35.

Before the medium 33 reaches the pull-in rollers 34 and 35, the controller 100 drives the motor 106 to drive the pull-in rollers 34 and 35, photosensitive body 25, charging roller 26, developing roller 28, sponge rollers 34 and 35, stirring shaft 31, transfer roller 23, heat roller 39 and discharge rollers 43 and 44 in rotation in the direction of arrows shown in FIG. 26.

Then, the LED printing mechanism 20 performs monochromatic image printing on the medium 33 and discharge the medium 33 to the exit stacker 46, completing monochromatic printing operation.

If the ratio of total count to the number of the total pixels C0 subjected to the image-reading operation is more than, for example, 0.1%, the original may be an actually colored original or a medium on which image print has been performed. Therefore, the apparatus may be designed so that the controller 100 causes the indicator on the operating section 18 to indicate such a condition to the operator.

Then the operator presses the "print" key if the medium is identified to be a medium on which monochromatic image print can be made, and presses the "print prohibited" key if not. Upon pressing the "print prohibited" key, the controller 100 discharges the medium 33 to the second exit stacker 280.

The original-identifying operation is carried out only when the first image-printing operation is to be performed after power is turned on. If the operator presses the "print" key, then original-identifying operation will not be performed thereafter. The original-identifying operation is also carried out when the first image-printing operation is performed after the paper-accommodating cassette 63 has been drawn out of the case 750 and then placed back thereinto. Detecting the paper-accommodating cassette 63, the photo interrupter 686 informs the controller 100 that the paper-accommodating cassette 63 has been set in place.

It is possible to provide the operator with a recording apparatus having only the case 750 of the image-reading unit 605 mounted to the line recording unit 604, if the operator does not need the image-reading unit 605. The present embodiment allows purchasing of only the line recording unit 604 and the image-reading unit 605 may be optional.

The fifth embodiment eliminates the inconvenience of separately purchasing an image-reading apparatus and a recording apparatus for image print, reducing the total cost and installing space. Further, the paper feeding mechanism 62 is shared by the image-reading unit 605 and the line recording unit 604, allowing miniaturization of the recording apparatus.

During the image-reading operation performed by the image-reading unit 605, the original that has been read an image thereof does not pass through the LED printing mechanism 20, increasing the durability of the LED printing mechanism 20. This also prevents the original to be read an image thereof from soiling.

The embodiment allows checking of the surface of the medium to determine whether the medium is a non-printed recording medium or an original to be read an image thereof. This prevents the operator from performing monochromatic print or copying on the original to be read an image thereof.

Sixth Embodiment

Figure 30:
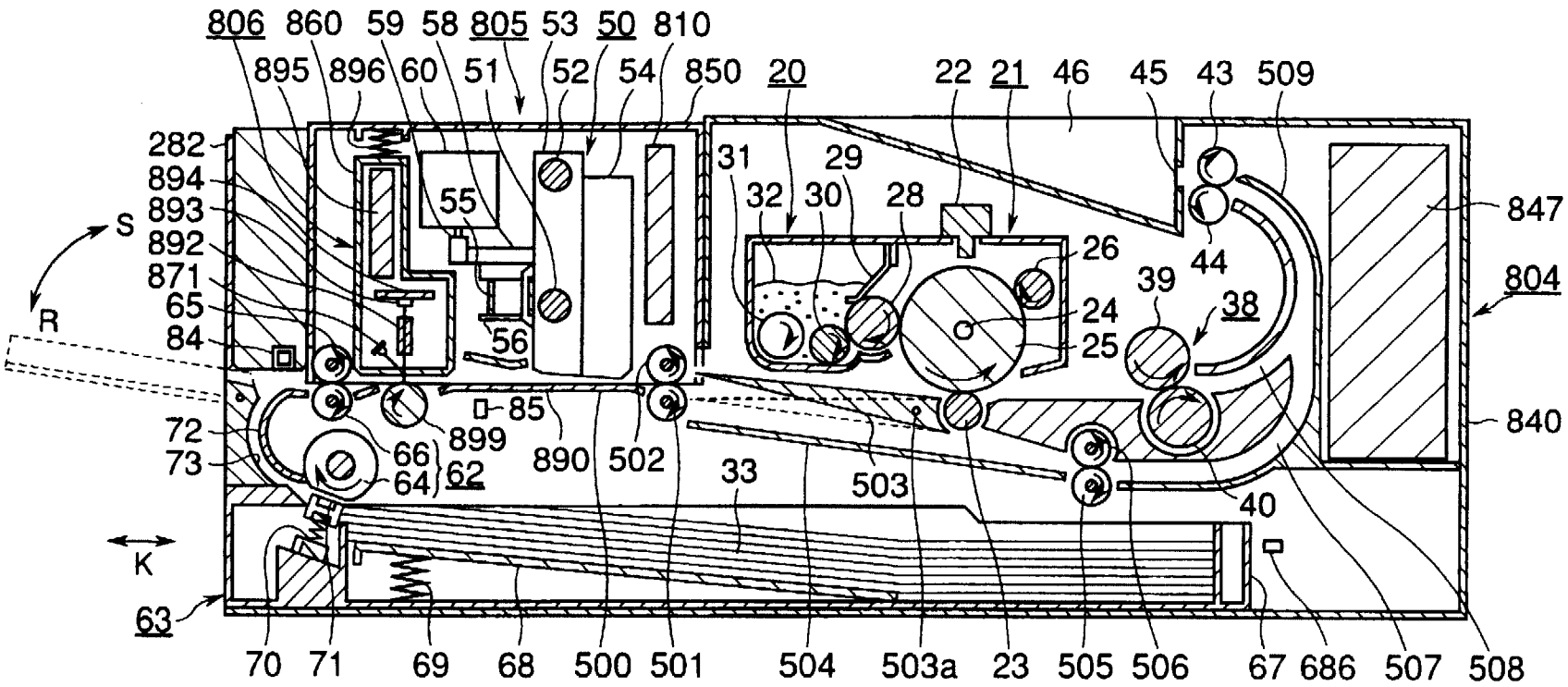
FIG. 30 is a cross-sectional view of a recording apparatus according to a sixth embodiment.
Figure 31:
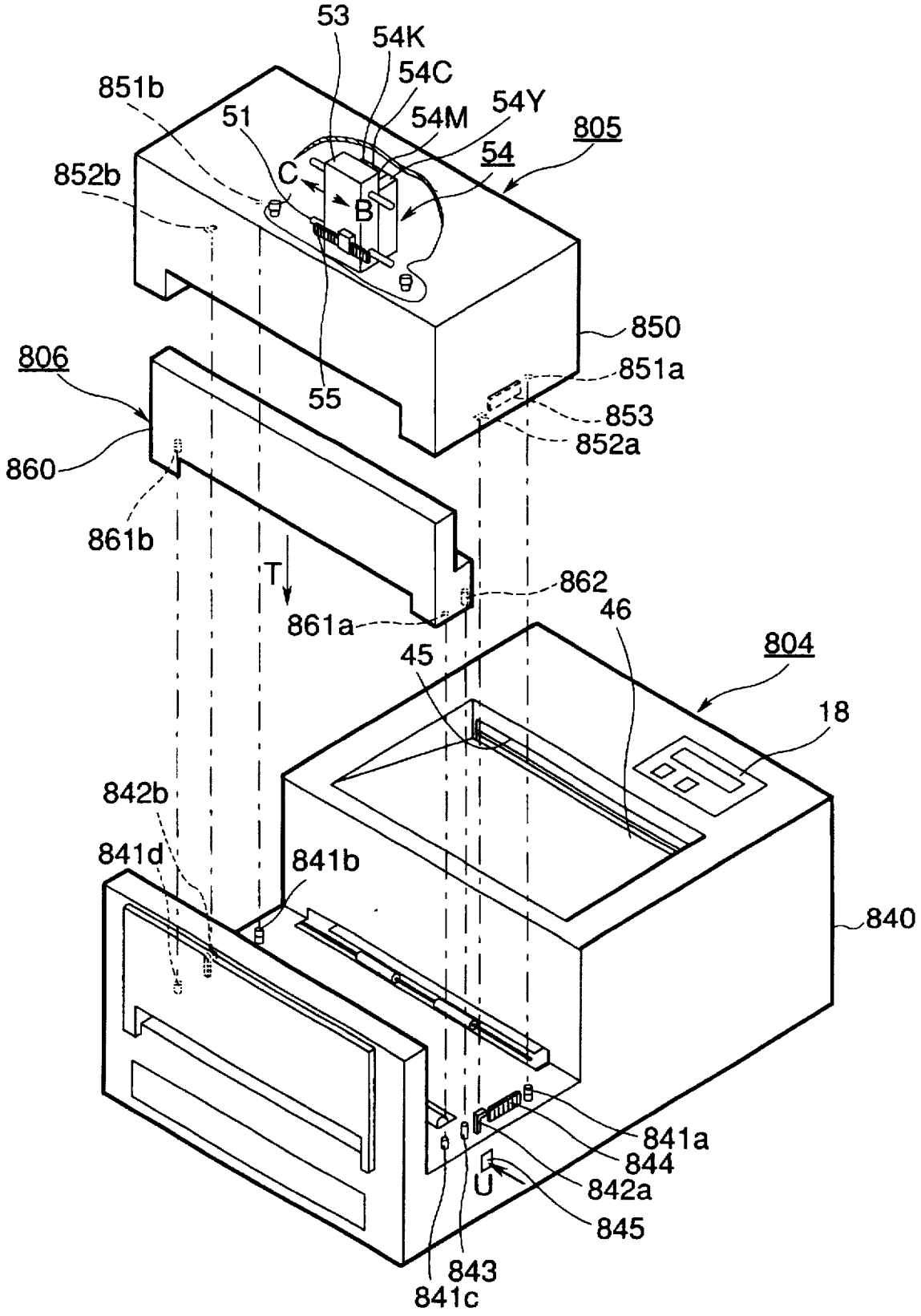
FIG. 31 is a perspective view of the recording apparatus according to the sixth embodiment.

A sixth embodiment will now be described. FIG. 30 is a cross-sectional view of a recording apparatus according to the sixth embodiment of the invention. FIG. 31 is a perspective view of the recording apparatus.

In the sixth embodiment, the recording apparatus can perform monochromatic image print, color image print, the combination of color and monochromatic prints, and image-reading. A serial recording unit 805 and image-reading unit 806 are optionally available. The image-reading unit 806 serves as an image-reading means.

As shown in FIGS. 30 and 31, the line recording unit 804 is provided with a paper feeding mechanism 62 and an LED printing mechanism 20 as a first recording means. A case 840 of the line recording unit 804 has guide pins 841*a*–841*d*, hooks 842*a* and 842*b*, round male connector 843, and round male connector 844. On the bottom of the case 850 of the serial recording unit 805 are provided guide holes 851*a* and 851*b* that engage the guide pins 841*a* and 841*b*, engagement holes 822*a* and 852*b* that engage the hook 842*a* and 842*b*, and female connector 853 that engages the male connector 844. On the bottom of the case 860 of the image-reading unit 806 are disposed a round female connector 862 that fits to the round male connector 843, and guide holes 861*a* and 861*b* that engage the guide pins 841*c* and 841*d*.

The hooks 842*a* and 842*b* are held in engagement positions by means of, for example, springs. Lowering the serial recording unit 805 in the direction of arrow T onto the line recording unit 804, causes the guide holes 851*a* and 851*b* to guide the guide pins 841*a* and 841*b*, the hooks 842*a* and 842*b* to automatically engage the engagement holes 852*a* and 852*b*, and female connector 853 to fit into the male connector 844. In this manner, the serial recording unit 805 is mounted to the line recording unit 804.

When dismounting the serial recording unit 805 from the line recording unit 804, the operator pushes a button 845 disposed on the side of the line recording unit 804 in the direction of arrow U. Lifting the serial recording unit 805 in the direction opposite to arrow T while pushing the button 845, permits dismounting of the serial recording unit 805 from the line recording unit 804.

Lowering the image-reading unit 806 in the direction of arrow T onto the line recording unit 804, causes the guide holes 861*a* and 861*b* to guide the guide pins 841*c* and 841*d*, and the round female connector 862 to fit to the round male connector 843. In this manner, the image-reading unit 806 is mounted to the line recording unit 804.

When dismounting the image-reading unit 806 from the line recording unit 804, the serial recording unit 805 is first dismounted. Then, lifting the image-reading unit 806 in the direction opposite to arrow T permits dismounting of the image-reading unit 806 from the line recording unit 804. The line recording unit 804 will now be described.

Referring to FIG. 30, the LED printing mechanism 20 includes an image-forming section 21, LED head 22, and transfer roller 23. A paper feeding mechanism 62 includes a paper accommodating cassette 33, hopping roller 64 and registering rollers 65 and 66.

Referring to FIG. 30, a fixing device 38 is disposed to the right of the LED printing mechanism. The medium 33 having a toner image fixed thereon in the fixing device 38 is transported through the guide paths 508 and 509 to the discharge rollers 43 and 44. The rotation of the discharge rollers 43 and 44 drives the medium 33 to the exit stacker 46 through the copy exit 45.

A paper guide 500 guides the medium 33 and the transportation rollers 501 and 502 transport the medium 33. A plunger magnet, not shown, causes a feed-direction-switching means 503 to pivot about a shaft 503*a* to shift between the solid line position and the dotted line position. The medium 33 is fed to the LED printing mechanism 20 when the feed-direction-switching means 503 takes up the dotted line position, and guided by the paper guide 504 to the transportation rollers 505 and 506 when the feed-direction-switching means 503 takes up the solid line position. The medium 33 is then transported by the transportation rollers 505 and 506 through the guide paths 507 and 509 to the discharge rollers 43 and 44. A power supply/control circuit board 847 drives the LED printing mechanism 20.

The serial recording unit 805 will be described.

In an upper space of the serial recording unit 805 is disposed the color ink jet printing mechanism 50 as a second recording means. The color ink jet printing mechanism 50 includes guide shafts 51 and 52, carriage 53 that runs in the directions of arrow B and C, ink jet recording head 54, belt 55, a pair of pulleys 56, driving gear 58, motor gear 59, and spacing motor 60.

The rotation of the spacing motor 60 drives the motor gear 59 and drive gear 58*c* in rotation which in turn cause the pulleys 56 to rotate, allowing the belt 55 to run. The belt 55 is fixed at a portion thereof to the carriage 53 so that the carriage 53 runs with the belt 55. The ink jet recording head 54 is for performing color print, and includes four recording heads 54Y, 54M, 54C, and 54K aligned in the direction perpendicular to the direction in which the medium 33 is transported. Each of the respective recording heads 54Y, 54M, 54C, 54K has on its surface opposing the medium 33 a plurality of nozzles (e.g., 64 nozzles) aligned in the direction in which the medium 33 is transported.

The case 850 houses a control board 810 that drives the color ink jet printing mechanism 50.

The image-reading unit 806 will now be described.

The image-reading unit 806 includes the case 860, a clear glass window 890 disposed on the bottom of the case 860, LED light source 871, rod array lens 892, circuit board 894 having a photoelectric conversion element 893 mounted thereon, and control circuit board 895.

The light emitted from the LED light source 871 illuminates the image-reading plane in which the surface of the original to be read an image thereof is placed, passing through the glass window 890, thereby forming the image of the original on the photoelectric conversion element 893 with the aid of the rod array lens 892.

A spring 896 fixed to the case 850 urges the image-reading unit 806 against the case 850 to retain the image-reading unit 806 in place. A platen roller 899 is disposed on the serial recording unit 805. The surface of the platen roller 899 is white and forms a reference white background.

Figure 32:
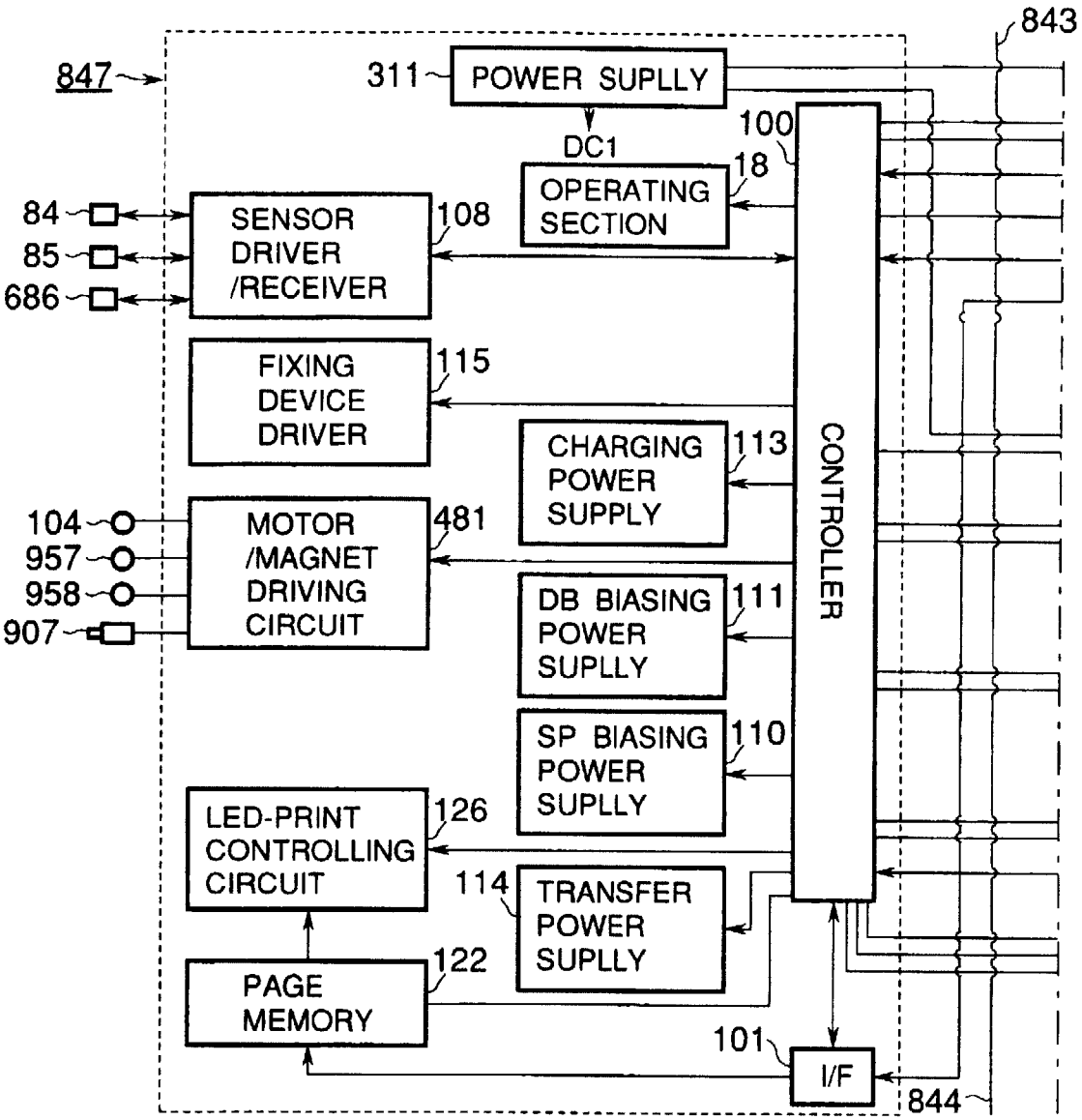
FIG. 32 is a block diagram showing a first half of a controlling section of the sixth embodiment.
Figure 33:
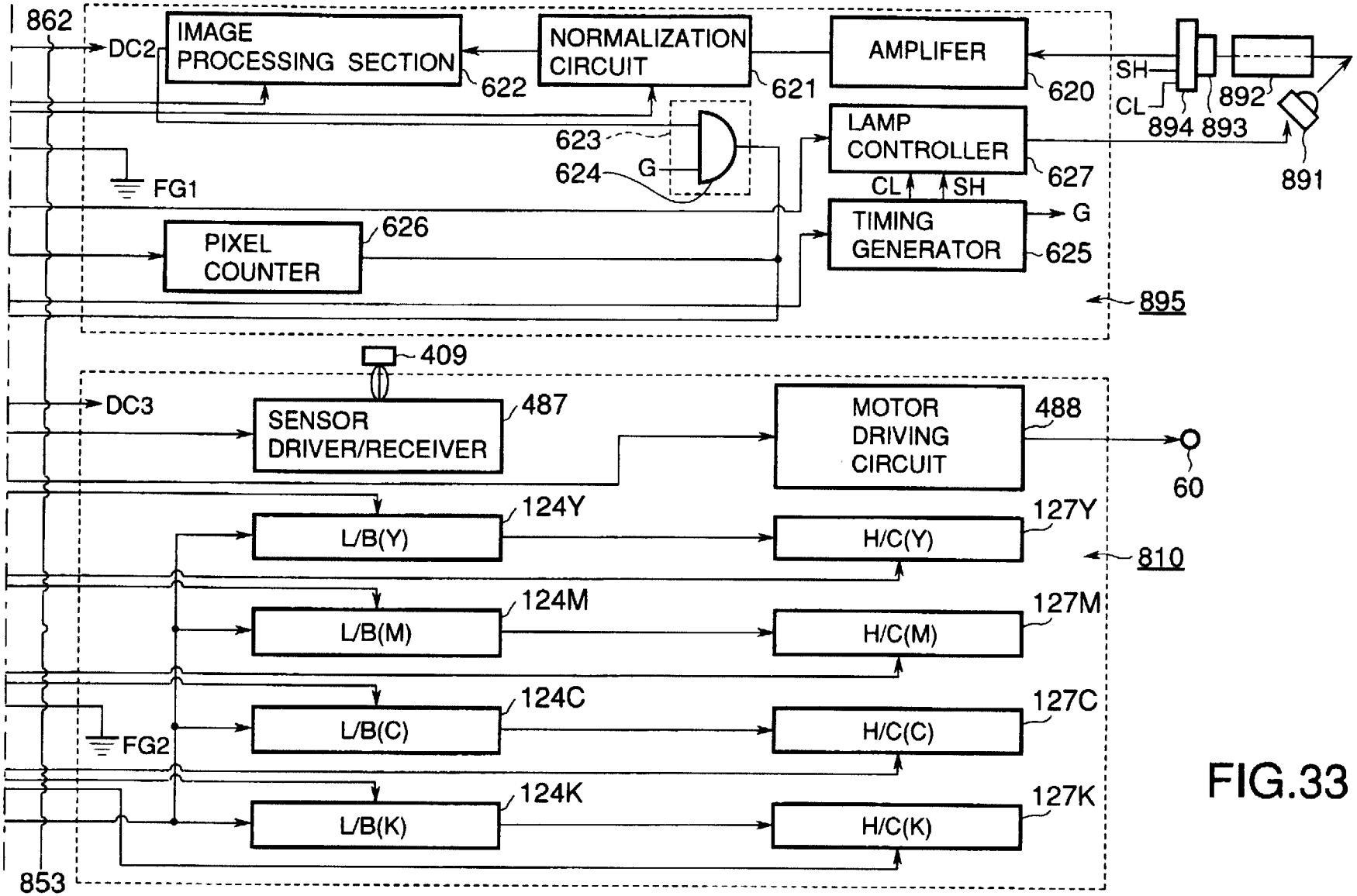
FIG. 33 is a block diagram showing a second half of a controlling section of the sixth embodiment.

FIG. 32 is a block diagram showing a controlling section of the sixth embodiment, and FIG. 33 is a block diagram showing the controlling section of the sixth embodiment. In the figures, the controlling section includes a power supply/control circuit board 847 disposed in the line recording unit 804 (FIG. 30), control circuit board 810 disposed in the serial recording unit 805, and control circuit board 895 disposed in the image-reading unit 806. The power supply/control circuit board 847 is connected with the control circuit board 810 by means of the male and female connectors 844 and 853. The power supply/control circuit board 847 is connected with the control circuit board 895, round male connector 843, and female connector 862.

The power supply/control circuit board 847 disposed in the line recording unit 804 will now be described.

Referring to FIG. 32, the controller 100 controls the entire operation of the recording apparatus. The interface 101 separates the image data D0 transmitted from the host computer, not shown, according to color, and stores the yellow, magenta, and cyan image data DA into line buffers 124Y, 124M, and 124C, respectively, and black image data DA into a line buffer 124K or page memory 122 if the control circuit board 810 is connected thereto. The interface 101 transmits the image signal produced by the photoelectric conversion element 893, as the image data to the host computer.

The motor/magnet driving circuit 480 drives a motors 104, 957, 958, and plunger magnet 907. The motor 104 drives the hopping roller 64 in rotation in the direction of arrow D. The motor 957 drives the platen roller 899, transportation rollers 501, 502, 505, and 506, and discharge rollers 43 and 44. The motor 958 drives the photosensitive body 25, charging roller 26, developing roller 28, sponge roller 30, transfer roller 23, stirring shaft 31, and heat roller 39. The plunger magnet 907 drives the feed-direction-switching means 503 to switch between the solid line position and dotted line position in FIG. 30.

The sensor driver/receiver 108 drives the photo interrupters 84, 85, 686 and receives signals therefrom and sends the received signals to the controller 100.

The power supply/control circuit board 847 has SP biasing power supply 110, DB biasing power supply 111, charging power supply 113, transfer power supply 114, fixing device driver 115, page memory 122, LED-print controlling circuit 126, and operating section 18. The power supply 311 applies a d-c voltage DC1 to all the circuits on the power supply/control circuit board 847.

The control board 895 will now be described.

An amplifier 620 amplifies the image signal outputted from the photoelectric conversion element 893 to a certain level. A normalization circuit 621 compensates for the degradation characteristic of amount of light caused by the rod array lens 892 and the non-uniform illumination of the LED light source 891. An image processing section 622 processes the image signal and outputs the processed image signal to a signal sampling section 623 which takes the form of a two-input AND gate 624. A timing generator 625 outputs shift pulse SH and control clock CL to a lamp controller 627 and photoelectric conversion element 893, and gate signal G to the signal sampling section 623.

The signal sampling section 623 directs the image signal inputted thereto to the interface 101 through the pixel counter 626, round male connector 843, and round female connector 862 only while the gate control signal G is outputted to the signal sampling section 623.

The pixel counter 626 counts the number of pixels of black level of the image signal outputted from the signal sampling section 623. The lamp controller 627 turns the LED light source 891 on and off. A ground line FG1 is connected to the controller 100 via the round male connector 843 and round female connector 862. The controller 100 receives a signal over the ground line FG1 to determine that the image-reading unit 806 is connected to the line recording unit 804. The d-c power supply voltage DC2 is supplied from the power supply 311 via the round male connector 843 and round female connector 862. The interface 101 is adapted to transmit the image data to and receive the image data from the host computer.

The control circuit board 810 of the line recording unit 805 will now be described.

The control circuit board 810 includes recording head controlling circuits 127Y, 127M, 127C, and 127K corresponding to recording heads 54Y, 54M, 54C, and 54K (FIG. 31), respectively. The recording head controlling circuits 127Y, 127M, 127C, and 127K receive the image data DA from the line buffers 124Y, 124M, 124C, and 124K, respectively, and drive the corresponding recording heads 54Y, 54M, 54C, and 54K according to the image data DA under the commands issued from the controller 100, causing the respective heads to eject ink to print an image. The line buffers 124Y, 124M, 124C, and 124K store the image data D0 as the image data DA of one line via the interface 101, the image data D0 being transmitted from the host computer.

The sensor driver/receiver 487 drives a photo interrupter 409 that detects the home position of the carriage 53. The sensor driver/receiver 487 receives the signal from the photo interrupter 409 and transmits the received signal to the controller 100. The motor driving circuit 488 drives the spacing motor 60.

A ground line FG2 is connected to the controller 100 via the male connector 844 and female connector 853. The controller 100 receives the signal over the ground line FG2 to determine that the serial recording unit 805 is connected to the line recording unit 804. A d-c power supply voltage DC3 is supplied from the power supply 311 via the male connector 844 and female connector 853.

The operation of the recording apparatus of the aforementioned construction will now be described. The recording apparatus can perform monochromatic image print, color image print, the combination of monochromatic image and color image prints, and image-reading. The monochromatic printing operation performed by the LED print mechanism 20 will now be described.

Upon turning on the power supply 311, the controller 100 drives the fixing device driver 115 to warm up the heat roller 39 of the fixing device 38 to a predetermined temperature. When the heat roller 39 has been warmed up to a predetermined temperature, the initialization of the apparatus completes and the controller 100 waits for the command and data D0 to be transmitted from the host computer.

Upon receiving the command and data D0, the controller 100 issues a command to the interface 101 and page memory 122. The received data D0 is stored as the data DA into the page memory 122.

When the image data DA of one page has been stored into the page memory 122, the controller 100 causes the motor 104 to drive the hopping roller 64 in rotation through slightly less than one complete rotation to feed the medium 33 stored in the medium cassette 67 to the guides 72 and 73.

Detecting that the medium 33 has been fed from the medium cassette 67, the controller 100 causes the motor 957 to drive the registering rollers 65 and 66, platen roller 899, transportation rollers 501, 502, 505, 506, and discharge rollers 43 and 44 in rotation. The medium 33 is therefore guided by the paper guide 500 to the transportation rollers 501 and 502.

The controller 100 causes the motor 958 to drive the photosensitive body 25, charging roller 26, developing roller 28, sponge roller 30, transfer 23, stirring shaft 31 and heat roller 39 in rotation in the directions as shown in FIG. 30. The controller 100 turn on the charging power supply 113, DB biasing power supply 111, and SP biasing power supply 110 to apply high voltages to the charging roller 26, developing roller 28, and sponge roller 30.

The controller 100 issues a command to the page memory 122, causing the page memory to output the image data DA of one line to the LED print controlling circuit 126. Upon receiving a command from the controller 100, the LED print controlling circuit 126 transmits the image data DA received from the page memory 122 to the LED head 22 which in turn causes the LEDs, not shown, corresponding to the received data DA to form an electrostatic latent image of one line on the surface of the photosensitive body 25.

Thus, the image data DA transmitted from the LED head 22 line by line, is converted into an electrostatic latent image on the surface of the photosensitive body 25. Then, the toner 32 on the developing roller 28 is deposited on the surface of the photosensitive body 25, converting the electrostatic latent image into a toner image.

When the leading end of the medium 33 arrives at a position between the photosensitive roller 25 and transfer roller 23, the controller 100 issues a command to the transfer power supply 114 to apply a high voltage to the transfer roller 23. This causes the toner image on the surface of the photosensitive body 25 to be transferred to the medium 33. In this manner, the toner images of the respective lines are transferred one after another as the photosensitive body 25 rotates, forming a toner image of one page. After transfer of the toner image, the controller 100 turns off the charging power supply 113, SP biasing power supplies 110, DB biasing power supply 111, and transfer power supply 114.

The medium 33 having the toner image transferred thereto passes between the heat roller 39 of the fixing device 38 maintained to a proper temperature for fixing and the pressure roller 40 urged against the heat roller 39. As the medium passes between the heat roller 39 and the pressure roller 40, the toner image on the medium 33 is fixed in the fixing device 38. After fixing, the medium 33 is guided by the guides 508 and 509 to the discharge rollers 43 and 44 which in turn discharges the medium 33 through the copy exit 45 to the exit stacker 46. Upon completion of the discharge of the medium 33, the controller 100 causes the motor 958 to stop, completing the printing operation.

The color printing operation performed by the color ink jet printing mechanism 50 will now be described.

When the power supply 311 is turned on, the controller 100 performs predetermined initialization of of the apparatus and causes the plunger magnet 907 to shift the feed-direction-switching means 503 to the solid line position in FIG. 30. Then, the controller 100 waits for the command and data D0 to be transmitted from the host computer via the interface 101. Upon receiving the command and data D0, the interface 101 decodes and sends the decoded command and data to the controller 100.

The controller 100 causes the spacing motor 60 to run the carriage 53, and receives a signal from the photo interrupter 409 via the sensor drive/receiver 487. The signal from the photo interrupter 409 indicates that the carriage 53 is at its home position. The controller 100 causes the motor 104 to drive the hopping roller 64 through slightly less than one complete rotation so that the medium 33 in the medium cassette 67 is fed one sheet at a time to the guides 72 and 73.

Being informed that the medium 33 has been fed from the medium cassette 67, the controller 100 causes the motor 957 to drive the registering rollers 65 and 66 in rotation. Thus, the medium 33 is transported to a location immediately below the nozzle, not shown, of the ink jet recording head 54.

Upon receiving the image data D0 of one line from the host computer via the interface 101, the controller 100 issues commands to the interface 101, line buffers 124Y, 124M, 124C and 124K.

In response to the command, the interface 101 separates the image data D0 according to color into the image data DA, and stores the image data DA of each color into the line buffers 124Y, 124M, 124C, and 124K, respectively.

Then, the controller 100 performs printing operation while driving the spacing motor 60 to run the carriage 53 in the direction of arrow B for spacing.

Upon completion of the printing operation of one line, the controller 100 causes the motor 957 to drive the registering rollers 65 and 66 and transportation rollers 501 and 502 in rotation in the directions of arrows, respectively, to advance the medium 33 by one line for line spacing.

The controller 100 also causes the spacing motor 60 to rotate in the reverse direction so that the carriage 53 runs in the direction of arrow C to its home position, thereby performing return-to-home operation.

While repeating the reception of the image data D0, printing operation, line spacing operation, and return-to-home operation, the controller 100 causes the medium 33 to be transported by the transportation rollers 501 and 502, guided by the feed-direction-switching means 503 through the guide paths 507 and 509, and discharged by the discharge rollers 43 and 44 to the exit stacker 46.

The combined mode of printing operation performed by the LED printing mechanism 20 and the color ink jet printing mechanism 50 will now be described.

The color ink jet printing mechanism 50 performs color print of one page in accordance with the yellow, magenta, cyan image data DA while transporting the medium 33. Then, the registering rollers 65 and 66, transportation roller 501, 502, 505, and 506 and discharge rollers 43 and 44 are rotated in the reverse directions to move the medium 33 backward till the leading end of the medium 33 arrives at a position between the transportation rollers 501 and 502.

Thereafter, the feed-direction-switching means 503 is shifted to the dotted line position shown in FIG. 30, and the motor 957 is driven so that the registering rollers 65 and 66, transportation rollers 501 and 502, 505, and 506 and discharge rollers 43 and 44 in the forward directions to guide the medium 33 by the feed-direction-switching means 503 into the LED printing mechanism 20 which performs monochromatic print.

The image-reading operation performed by the image-reading unit 806 will now be described.

Upon receiving from the host computer a command indicating that image-reading operation is to be performed by the image-reading unit 806, the interface 101 decodes the command and sends the decoded command to the controller 100. The original to be read an image thereof is placed face down in the paper-accommodating cassette 63.

Upon receiving the command indicative of image-reading operation, the controller 100 causes the plunger magnet 907 to shift the feed-direction-switching means 503 to the solid line position.

The controller 100 causes the lamp controller 627 to drive the LED light source 891 to light up so as to read the reference white level of the platen roller 899, and stores the data on the reference white level as a reading-reference signal into the shading correction memory in the normalization circuit 621. The shading correction is then carried out on the image data obtained by image-reading operation with reference to the reading-reference signal.

The controller 100 causes the motor 104 to drive the hopping roller 64 in rotation through slightly less than one complete rotation, so that the original to be read an image thereof is fed one sheet at a time to the guides 72 and 73. Being informed that the original to be read an image thereof has been fed from the medium cassette 67, the controller 100 causes the motor 957 to drive the registering rollers 65 and 66, platen roller 899, transportation rollers 501, 502, 505, and 506, and transportation rollers 43 and 44 in rotation, so that the original to be read an image thereof is guided by the paper guide 500 to the image-reading plane.

When the leading end of the original to be read an image thereof arrives at the image-reading plane, the controller 100 issues a command to the timing generator 625, which outputs shift pulse SH and control clock CL shown in FIG. 29 to the photoelectric conversion element 893 in response to the command. The photoelectric conversion element 893 serially outputs the image signal to the amplifier 620 in timed relation with the control clock CL time T0 after the photoelectric conversion element 893 receives the shift SH.

The image signal outputted form the photoelectric conversion element 893 passes through the amplifier 620, normalization circuit 621, and image processing section 622, so that the image signal is subjected to predetermined signal processing by the respective sections. The image processing section 622 outputs the output signal shown in FIG. 29 to one of the input terminals of the two-input AND gate 624. The timing generator 625 outputs the gate control signal G to the other terminal of the gate 624, which gate control signal goes high only for time Tw corresponding to a distance across which the image is read from the original.

Thus, the output signal of the image processing section 622 is outputted to the pixel counter 626 and interface 101 only for time Tw. The interface 101 transmits the output signal as the image data to the host computer. In this manner, the medium is transported while being read the image thereof on a line-by-line basis. The aforementioned image-reading operation is repeated so that the output signal of each line is transmitted from the image processing section 622 to the host computer via the interface 101.

The original to be read the image thereof is transported by the transportation rollers 501 and 502 while being guided by the feed-direction-switching means 503 to the transportation rollers 505 and 506 which in turn transport the medium through the guide paths 507 and 509 to the discharge rollers 43 and 44. The original is then discharged by the discharge rollers 43 and 44 through the copy exit 45 to the exit stacker 46. Likewise, the second original to be read the image thereof onward are fed from the paper-accommodating cassette 63 for image-reading operation.

The recording apparatus of the aforementioned construction can perform copying operation just as in the fifth embodiment. In the sixth embodiment, the medium 33 and the original to be read the image thereof are both discharged to the exit stacker 46.

The original-identifying operation can also be performed just as in the fifth embodiment.

The image-reading method based on image-reduction by a lens is used in the fifth embodiment while the intimate contact type image-reading method is used in the sixth embodiment. Either method may be used in the present invention.

The reference white background takes the form of the guide 674 in the fifth embodiment and the platen roller 899 in the sixth embodiment. The white surface of the guide 674 or roller 899 may be soiled in the long run. Thus, the data indicative of the reference white background may be previously stored in the non-volatile shading correction memory in the form of a ROM.

While the fifth and sixth embodiments have been described with respect to the monochrome type image-reading units 605 and 806, the apparatus may be constructed so that color image-reading can be carried out through the use of light sources of R (red), G (green), and B (blue) and filters.

In the fifth and sixth embodiments, while the pixel counter 626 counts the number of pixels of black level, the counter may also be adapted to count the number of pixels of white level in identifying the surface image of the medium 33.

The present invention is not limited to the described embodiments and various modifications thereof may be possible without departing from the scope of the invention.

What is claimed is:

1. A recording apparatus, comprising:

a medium-feeding mechanism for feeding a medium into a first path;

a first recording means arranged downstream of said medium-feeding mechanism in said first path, said first recording means recording information supplied thereto onto the medium;

a second path having a first end and a second end;

a feed-direction-switching means arranged upstream of said first recording means and said second path, said feed-direction-switching means being adapted to direct the medium to said first recording means when shifted to a first position and to direct the medium to said first end of said second path when shifted to a second position;

an image-reading means arranged in said first path downstream of said medium-feeding mechanism and upstream of said feed-direction-switching means, for reading information located on an original transported on the first path; and an exit stacker arranged downstream of said first recording means in the first path.

2. The recording apparatus according to claim 1, further including a second recording means arranged adjacent said image-reading means.

3. The recording apparatus according to claim 2, wherein said second end of said second path communicates with said exit stacker.

4. The recording apparatus according to claim 2, wherein said first recording means is a serial type recording means and said second recording means is a line type recording means.

5. The recording apparatus according to claim 2, wherein said first recording means is a line type recording means and said second recording means is a serial type recording means.

6. The recording apparatus according to claim 5, wherein said serial type recording means is an ink jet type recording means for performing color image print, and said line type recording means is an electrophotographic recording means for performing monochromatic image print.

7. A recording apparatus, comprising:

a medium-feeding mechanism for feeding a medium into a first path;

a first recording means arranged downstream of said medium-feeding mechanism in said first path, said first recording means recording information supplied thereto onto the medium;

a second path having a first end and a second end;

a feed-direction-switching means arranged upstream of said first recording means and said second path, said feed-direction-switching means being adapted to direct the medium to said first recording means when shifted to a first position and to direct the medium to said first end of said second path when shifted to a second position;

an image-reading means arranged downstream of said medium-feeding mechanism and upstream of said feed-direction-switching means, said first recording means and said medium-feeding mechanism forming a first unit, said image-reading means forming a second unit, and said first and second units being detachably mounted to each other; and an exit stacker arranged downstream of said first recording means in the first path.

8. A recording apparatus, comprising:

a medium-feeding mechanism for feeding a medium into a first path;

a first recording means arranged downstream of said medium-feeding mechanism in said first path, said first recording means recording information supplied thereto onto the medium;

a second path having a first end and a second end;

a feed-direction-switching means arranged upstream of said first recording means and said second path, said feed-direction-switching means being adapted to direct the medium to said first recording means when shifted to a first position and to direct the medium to said first end of said second path when shifted to a second position;

an image-reading means arranged downstream of said medium-feeding mechanism and upstream of said feed-direction-switching means;

a second recording means arranged adjacent to said image-reading means, said image-reading means and said second recording means forming a first unit, said first recording means and said medium-feeding mechanism forming a second unit, and said first and second units being detachably mounted to each other; and an exit stacker arranged downstream of said first recording means in the first path.

9. A recording apparatus, comprising:

a medium-feeding mechanism for feeding a medium into a first path;

a first recording means arranged downstream of said medium-feeding mechanism in said first path, said first recording means recording information supplied thereto onto the medium;

a second path having a first end and a second end;

a feed-direction-switching means arranged upstream of said first recording means and said second path, said feed-direction-switching means comprising a belt conveyer mechanism, said belt conveyer mechanism being oriented to direct the medium to said first recording means when shifted to a first position and to direct the medium to said first end of said second path when shifted to a second position; and an exit stacker arranged downstream of said first recording means in the first path.

10. The recording apparatus according to claim 9, wherein said belt conveyer mechanism includes attraction means for attracting the medium thereto.

11. A recording apparatus, comprising:

a medium-feeding mechanism for feeding a medium into a first path;

a first recording means arranged downstream of said medium-feeding mechanism in said first path, said first recording means recording information supplied thereto onto the medium;

a second path having a first end and a second end;

a feed-direction-switching means arranged upstream of said first recording means and said second path, said feed-direction-switching means being adapted to direct the medium to said first recording means when shifted to a first position and to direct the medium to said first end of said second path when shifted to a second position;

a second recording means arranged downstream of said medium-feeding mechanism and upstream of said feed-direction-switching means in the first path, said second recording means recording information supplied thereto onto the medium, said second recording means and said medium-feeding mechanism forming a first unit, said first recording means forming a second unit, and said first and second units being detachably mounted to each other; and an exit stacker arranged downstream of said first recording means in the first path.

12. A recording apparatus, comprising:

a medium-feeding mechanism for feeding a medium into a first path;

a first recording means arranged downstream of said medium-feeding mechanism in said first path, said first recording means recording information supplied thereto onto the medium;

a second path having a first end and a second end;

a feed-direction-switching means arranged upstream of said first recording means and said second path, said feed-direction-switching means being adapted to direct the medium to said first recording means when shifted to a first position and to direct the medium to said first end of said second path when shifted to a second position;

a second recording means arranged downstream of said medium-feeding mechanism and upstream of said feed-direction-switching means in the first path, said second recording means recording information supplied thereto onto the medium; and an exit stacker arranged downstream of said first recording means in the first path, said feed-direction-switching means being shifted to said second position to direct the medium into said first end of said second path when said second recording means records first information onto the medium;

the medium being then transported backward past said feed-direction-switching means in said second path when the second recording means completes recording of the first information;

said feed-direction-switching means then directing the medium into said first path to said first recording means; and the medium then being transported to said exit stacker when said first recording means completes recording second information on the medium.

13. The recording apparatus according to claim 12, wherein said first recording means is a serial type recording means and said second recording means is a line type recording means.

14. The recording apparatus according to claim 12, wherein said first recording means is a line type recording means and said second recording means is a serial type recording means.

15. The recording apparatus according to claim 14, wherein said serial type recording means is an ink jet type recording means for performing color image print and said line type recording means is an electrophotographic recording means for performing monochromatic image print.

16. The recording apparatus according to claim 12, further including a second feed-direction switching means arranged between said exit stacker and said first recording means, said second feed-direction-switching means being adapted to direct the medium to said exit stacker when shifted to a third position and to said second end of said second path when shifted to a fourth position.

17. The recording apparatus according to claim 16, wherein said second feed-direction switching means directs the leading end of the medium into said second end of said second path when said first and/or second recording means completes recording of the first and/or second information on a first side of the medium; and the medium is then transported through said second path, and said first feed-direction-switching means is shifted to said second position so that the medium is transported to said second recording means; whereby said medium is ready for being recorded on a second side thereof.

18. The recording apparatus according to claim 12, wherein said second end of said second path communicates with said exit stacker.

19. A method of recording comprising a first mode of operation and a second mode of operation, said first mode of operation including:

feeding a medium to a first recording means in a first path so that information is recorded on the medium by said first recording means;

said second mode of operation including:

feeding a medium to a second recording means upstream of said first recording means in said first path so that information is recorded on the medium by said second recording means;

guiding the medium having information recorded thereon into a second path, said second path having a first end and a second end opposite to said first end, the medium being guided into said second path through said first end; and transporting the medium backward from said second path to a position in the first path upstream of said first recording means after information has been recorded on the medium;

wherein the method of recording further comprises selecting between the first mode of operation and the second mode of operation.

20. The method according to any one of claim 19, further comprising a third mode of operation including the steps of:

feeding the medium being transported downstream of said first recording means into said second path through said second end, the medium having been recorded by at least one of said first recording means and said second recording means; and transporting the medium through said second path to said first path, said medium being placed with a recorded side thereof facing down.

21. The method according to claim 20, wherein said third mode of operation further includes the steps of:

transporting the medium through said second path to a position in said first path upstream of said second recording means; and feeding the medium to said second recording means so that information is recorded on the medium by said second recording means.

22. The method according to claim 20, wherein said third mode of operation further includes the steps of:

transporting the medium through said second path to a position in said first path upstream of said second recording means;

feeding the medium to said second recording means so that information is recorded on the medium by said second recording means;

transporting the medium backward from said second path to a position in the first path upstream of said first recording means after information has been recorded on the medium; and performing said first mode of operation.

23. The method according to claim 20, wherein said third mode of operation further includes the steps of:

transporting the medium through said second path to a position in said first path upstream of said first recording means; and performing said first mode of operation.

24. The method according to claim 19, further including the step of performing said first mode of operation after the step of transporting the medium backward from said second path to a position in the first path upstream of said first recording means after information has been recorded on the medium.

25. The method according to any one of claim 24, further comprising a third mode of operation including the steps of:

feeding the medium being transported downstream of said first recording means into said second path through said second end, the medium having been recorded by at least one of said first recording means and said second recording means; and transporting the medium through said second path to said first path, said medium being placed with a recorded side thereof facing down.

26. The method according to claim 25, wherein said third mode of operation further includes the steps of:

transporting the medium through said second path to a position upstream in said first path of said first recording means; and performing said first mode of operation.

27. The method according to claim 25, wherein said third mode of operation further includes the steps of:

transporting the medium through said second path to a position in said first path upstream of said second recording means; and feeding the medium to said second recording means so that information is recorded on the medium by said second recording means.

28. The method according to claim 25, wherein said third mode of operation further includes the steps of:

transporting the medium through said second path to a position in said first path upstream of said second recording means;

feeding the medium to said second recording means so that information is recorded on the medium by said second recording means;

transporting the medium backward from said second path to a position in the first path upstream of said first recording means after information has been recorded on the medium; and performing said first mode of operation.

29. A method of recording comprising a first mode of operation, a second mode of operation, and a third mode of operation, said first mode of operation including:

feeding a medium to a first recording means in a first path so that information is recorded on the medium by said first recording means;

said second mode of operation including:

feeding a medium to a second recording means upstream of said first recording means in said first path so that information is recorded on the medium by said second recording means; and guiding the medium having information recorded thereon into a second path, said second path having a first end and a second end opposite to said first end, the medium being guided into said second path through said first end; and wherein the method of recording further comprises selecting between the first mode of operation and the second mode of operation; and said third mode of operation including:

feeding the medium being transported downstream of said first recording means into said second path through said second end, the medium having been recorded by at least one of said first recording means and said second recording means; and transporting the medium through said second path to said first path, causing said medium to be flipped over with a recorded side thereof facing down and a non-recorded side facing up for subsequent recording by at least one of said first recording means and said second recording means.

30. The method according to claim 29, wherein said third mode of operation further includes the steps of:

transporting the medium through said second path to a position in said first path upstream of said first recording means; and performing said first mode of operation.

31. The method according to claim 29, wherein said third mode of operation further includes the steps of:

transporting the medium through said second path to a position in said first path upstream of said second recording means; and feeding the medium to said second recording means so that information is recorded on the medium by said second recording means.

32. The method according to claim 29, said third mode of operation further includes the steps of:

transporting the medium through said second path to a position in said first path upstream of said second recording means;

feeding the medium to said second recording means so that information is recorded on the medium by said second recording means;

transporting the medium backward from said second path to a position in the first path upstream of said first recording means after information has been recorded on the medium; and performing said first mode of operation.

33. A method of recording comprising a first mode of operation, a second mode of operation, and a third mode of operation, said first mode of operation including:

feeding a medium to a first recording means in a first path so that information is recorded on the medium by said first recording means;

said second mode of operation including:

feeding a medium to a second recording means upstream of said first recording means in said first path so that information is recorded on the medium by said second recording means; and guiding the medium having information recorded thereon into a second path, said second path having a first end and a second end opposite to said first end, the medium being guided into said second path through said first end; and wherein the method of recording further comprises selecting between the first mode of operation and the second mode of operation; and said third mode of operation including:

feeding an original to be read to an image-reading unit adjacent said second recording means;

reading an image of the original; and guiding the original through said second path to an exit stacker, said original having the image thereof read by said image-reading unit.

34. The method according to claim 33, wherein said information is a monochromatic image data.

35. The method according to claim 33, further including the step of:

performing any one of said first mode of operation and said second mode of operation after the step of guiding the original having been read the image thereof through said second path to an exit stacker, said information being the image read from the original.

36. A method of recording, comprising one mode of operation and another mode of operation, wherein said one mode of operation includes:

feeding an original to an image-reading unit which reads an image of the original; and guiding the original to an exit stacker, said original having the image thereof read by said image-reading unit; and said another mode of operation includes:

feeding a medium to a recording means arranged on a path in which said original is transported so that information is recorded on the medium, said recording means being arranged immediately adjacent and downstream of said image-reading unit; and guiding the medium through to the exit stacker; wherein the method of recording further comprises selecting between said one mode of operation and said another mode of operation.

37. The method according to claim 36, further including the step of:

checking a number of pixels read from the original to determine whether the fed original is in fact an original having been printed thereon or a medium on which information can be recorded.

38. The method according to claim 36, wherein said information recorded on the medium is the image read from the original.

* * * * *